US010413010B2

(12) United States Patent
Dutour et al.

(10) Patent No.: US 10,413,010 B2
(45) Date of Patent: Sep. 17, 2019

(54) HELMET

(71) Applicant: BOMBARDIER RECREATIONAL PRODUCTS INC., Valcourt (CA)

(72) Inventors: Gregory Dutour, Quebec (CA); Jerome Demers, Sherbrooke (CA); Antoine Tazbaz, Blainville (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 407 days.

(21) Appl. No.: 15/418,036

(22) Filed: Jan. 27, 2017

(65) Prior Publication Data

US 2017/0215509 A1 Aug. 3, 2017

Related U.S. Application Data

(60) Provisional application No. 62/288,096, filed on Jan. 28, 2016.

(51) Int. Cl.

| | |
|---|---|
| ***A42B 3/24*** | (2006.01) |
| ***H05B 3/84*** | (2006.01) |
| ***A42B 3/04*** | (2006.01) |
| ***A42B 3/22*** | (2006.01) |

(52) U.S. Cl.

CPC ..... *A42B 3/245* (2013.01); *A42B 3/0446* (2013.01); *A42B 3/222* (2013.01); *A42B 3/226* (2013.01)

(58) Field of Classification Search

CPC ..... A42B 3/24–245; H05B 3/84–845; B23K 9/321–322; A61F 9/06–068

See application file for complete search history.

(56) References Cited

U.S. PATENT DOCUMENTS

| | | | | |
|---|---|---|---|---|
| 5,351,339 | A * | 10/1994 | Reuber | A42B 3/226 2/15 |
| 5,500,953 | A * | 3/1996 | Reuber | A42B 3/226 2/15 |
| 5,694,650 | A | 12/1997 | Hong | |
| 5,765,235 | A * | 6/1998 | Arnold | A42B 3/226 2/15 |
| 6,417,491 | B1 * | 7/2002 | Taniuchi | A42B 3/24 2/424 |
| 6,425,143 | B1 * | 7/2002 | Benedict | A42B 3/24 2/171.3 |
| 6,795,978 | B2 | 9/2004 | Fournier et al. | |
| 7,120,940 | B2 | 10/2006 | Fournier et al. | |
| 9,801,425 | B2 * | 10/2017 | Ahn | A42B 3/24 |
| 2004/0098792 | A1 * | 5/2004 | Song | A42B 3/24 2/422 |
| 2008/0068825 | A1 | 3/2008 | Harris | |

* cited by examiner

*Primary Examiner* — Michael A Laflame, Jr.
(74) *Attorney, Agent, or Firm* — BCF LLP

(57) ABSTRACT

A helmet has a helmet shell and a visor pivotally connected to the helmet shell. The helmet further has an electrical device attached to the visor. First and second helmet electrical contacts are attached at both sides of the helmet and are adapted for electrically connecting to an electrical power source. First and second visor electrical contacts are attached to each side of the visor and are electrically connected to the electrical device. The first and second visor electrical contacts are pivotally connected to the helmet shell about first and second pivot axes passing through the first and second helmet electrical contacts respectively. The first and second visor electrical contacts are in contact with the first and second helmet electrical contacts respectively, at all positions of the pivoting visor.

19 Claims, 47 Drawing Sheets

HELMET

CROSS-REFERENCE

This application claims the benefit of U.S. provisional application Ser. No. 62/288,096, filed Jan. 28, 2016, the entirety of which is incorporated herein by reference.

TECHNICAL FIELD

The present technology relates to a helmet.

BACKGROUND

Full-face helmets have a helmet shell, a jaw shield, and a visor. The helmet shell protects the head of a wearer. The jaw shield is integrated with the helmet shell and forms a projection with the head portion and protects the lower part of the face of the wearer, more particularly the jaw. The visor is mounted on the helmet shell and protects the eyes of the wearer.

At low temperature, water vapor in the humid air exhaled by the wearer can create condensation in the visor. This condensation can cause water and/or ice to form on the inside of the visor.

To avoid the problem of condensation, it is possible to open the visor to allow outside air to flow into the helmet until the condensation is eliminated. This, however, presents the problem that the wearer may be exposed to cold air, which is uncomfortable at the very least.

Thus, there is a need to provide a device which is capable of avoiding or eliminating the condensation created inside of the visor.

Prior art helmets provide some solution against the condensation of the visor. Indeed, helmets that are adapted for cold-weather use are sometimes equipped with an electrically-heated visor that prevents water vapor from condensing and/or freezing on the visor. U.S. Pat. No. 5,694,650 illustrates an example of such heated visors.

In U.S. Pat. No. 5,694,650, an electric heating element extends across the visor. The visor is pivotally or otherwise movably connected to the helmet. The visor includes an electric connector that connects to an external power supply via power supply leads. If the wearer is riding a snowmobile, the power supply is typically the snowmobile's battery.

One of the inconveniences of the above implementation results from the direct connection of the battery to the power supply jack connected to the helmet via the power supply lead. This requires the wearer to unplug the power supply lead from the power supply jack each time the wearer moves away from the snowmobile. If the wearer accidently forgets or omits to unplug the power supply lead when moving away from the battery, this causes the power supply lead and/or the power supply jack to be damaged as a result of the stress caused by pulling directly on the power supply lead connected to the visor.

Therefore it would be desirable to have an alternative form of electrical power supply connection from the battery to the helmet.

SUMMARY OF THE TECHNOLOGY

It is an object of the present technology to ameliorate at least some of the inconveniences present in the prior art.

One broad aspect of the present technology provides a helmet having a helmet shell and a visor pivotally connected to the helmet shell. The visor pivots between a first position and a second position. The helmet further has an electrical device attached to the visor. A first helmet electrical contact is attached to the helmet, which is adapted for electrically connecting to an electrical power source. A first visor electrical contact is attached to the visor, which is electrically connected to the electrical device. The first visor electrical contact is pivotally connected to the helmet shell about a first pivot axis passing through the first helmet electrical contact. One of the first helmet electrical contact and the first visor electrical contact is biased against an other one of the first helmet electrical contact and the first visor electrical contact. The first visor electrical contact contacts the first helmet electrical contact at all positions between the first position and the second position of the visor. A second helmet electrical contact is attached to the helmet, which is adapted for electrically connecting to the electrical power source. A second visor electrical contact is attached to the helmet, which is electrically connected to the electrical device. The second visor electrical contact is pivotally connected to the helmet shell about a second pivot axis passing through the second helmet electrical contact. One of the second helmet electrical contact and the second visor electrical contact is biased against an other one of the second helmet electrical contact and the second visor electrical contact. The second visor electrical contact contacts the second helmet electrical contact at all positions between the first position and the second position of the visor.

In a further aspect, the visor is removable.

In yet another aspect, the electrical device is a visor heating element.

In yet a further aspect, the visor has an outer visor and an inner visor. The visor heating element is attached to the inner visor.

In yet another aspect, the visor has an outer visor and an inner visor. The visor heating element is integrated within the inner visor.

In another aspect, a left side of the visor is pivotally connected to the helmet shell about the first pivot axis on a left side of the helmet shell. A right side of the visor is pivotally connected to the helmet shell about the second pivot axis on a right side of the helmet shell.

In yet a further aspect, the first pivot axis and the second pivot axis are skewed relative to one another.

In another aspect, the first and second helmet electrical contacts each comprise a spring loaded pin assembly.

In another aspect, a left side of the visor is pivotally connected to the helmet shell about the first pivot axis on a left side of the helmet shell. A right side of the visor is pivotally connected to the helmet shell about the second pivot axis on a right side of the helmet shell. A first pin axis of the spring loaded pin assembly of the first helmet electrical contact is coaxial with the first pivot axis. A second pin axis of the spring loaded pin assembly of the second helmet electrical contact is coaxial with the second pivot axis.

In another aspect, the first helmet electrical contact is biased against the first visor electrical contact. The second helmet electrical contact is biased against the second visor electrical contact.

In yet another aspect, the first and second visor electrical contacts each have a printed circuit board.

In another aspect, the first and second helmet electrical contacts each comprise a metal plate.

In yet a further aspect, the first visor electrical contact is biased against the first helmet electrical contact and the second visor electrical contact is biased against the second helmet electrical contact.

In another aspect, the first visor electrical contact is part of a first biasing conductor assembly and the second visor electrical contact is part of a second biasing conductor assembly.

In another aspect, the first visor electrical contact comprises at least one first conductive leg that is biased against the first helmet electrical contact, and the second visor electrical contact comprises at least one second conductive leg that is biased against the second helmet electrical contact.

In another aspect, the at least one first conductive leg is three first conductive legs that is arranged in a triangular formation, and the at least on second conductive leg is three second conductive legs arranged also in a triangular formation.

In a further aspect, the helmet further has a first wire having a first end and a second end. The first end is electrically connected to the first helmet electrical contact. The second end is adapted for electrically connecting to the power source. A second wire has a first end and a second end. The first end is electrically connected to the second helmet electrical contact. The second end being adapted for electrically connecting to the power source.

In another aspect, the helmet further has a receiver attached to a back of the helmet shell. The receiver is adapted for connecting to the power source. The second ends of the first wire and second wire are electrically connected to the receiver.

In another aspect, the helmet shell has an inner shell and an outer shell.

Additional and/or alternative objects, features, and advantages of the embodiments of the present invention will become apparent from the following description, the accompanying drawings, and the appended claims.

BRIEF DESCRIPTION OF THE DRAWINGS

For a better understanding of the present invention as well as other objects and further features thereof, reference is made to the following description which is to be used in conjunction with the accompanying drawings, where.

DETAILED DESCRIPTION

Turning now to FIGS. 1 to 13, a helmet 100 according to the present technology will be described.

Figure 1:
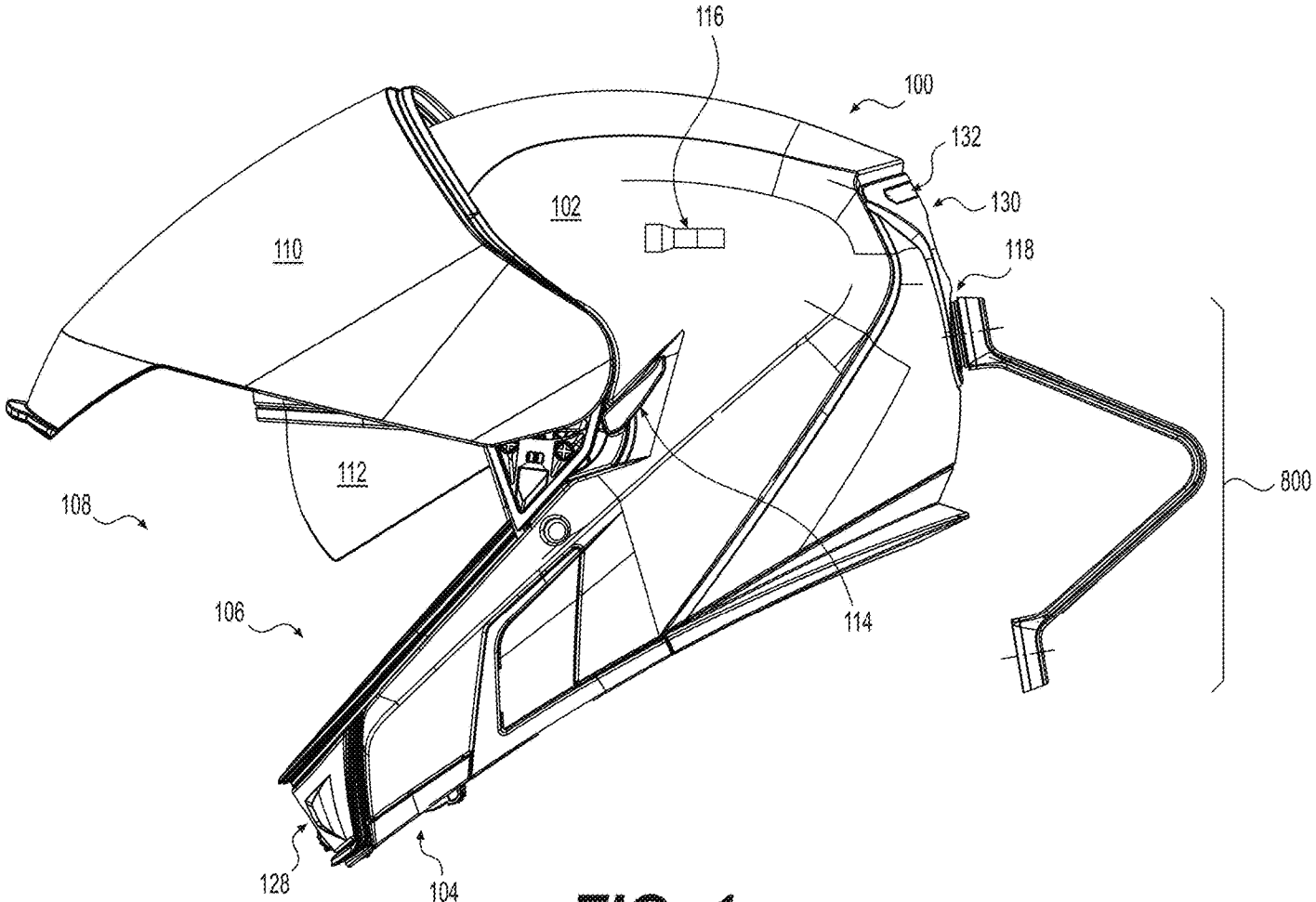
FIG. 1 is a left side elevation view of a helmet with a visor in a raised position, and an eye shield in a lowered position, and with an electrical connector assembly connected to the helmet.
Figure 2A:
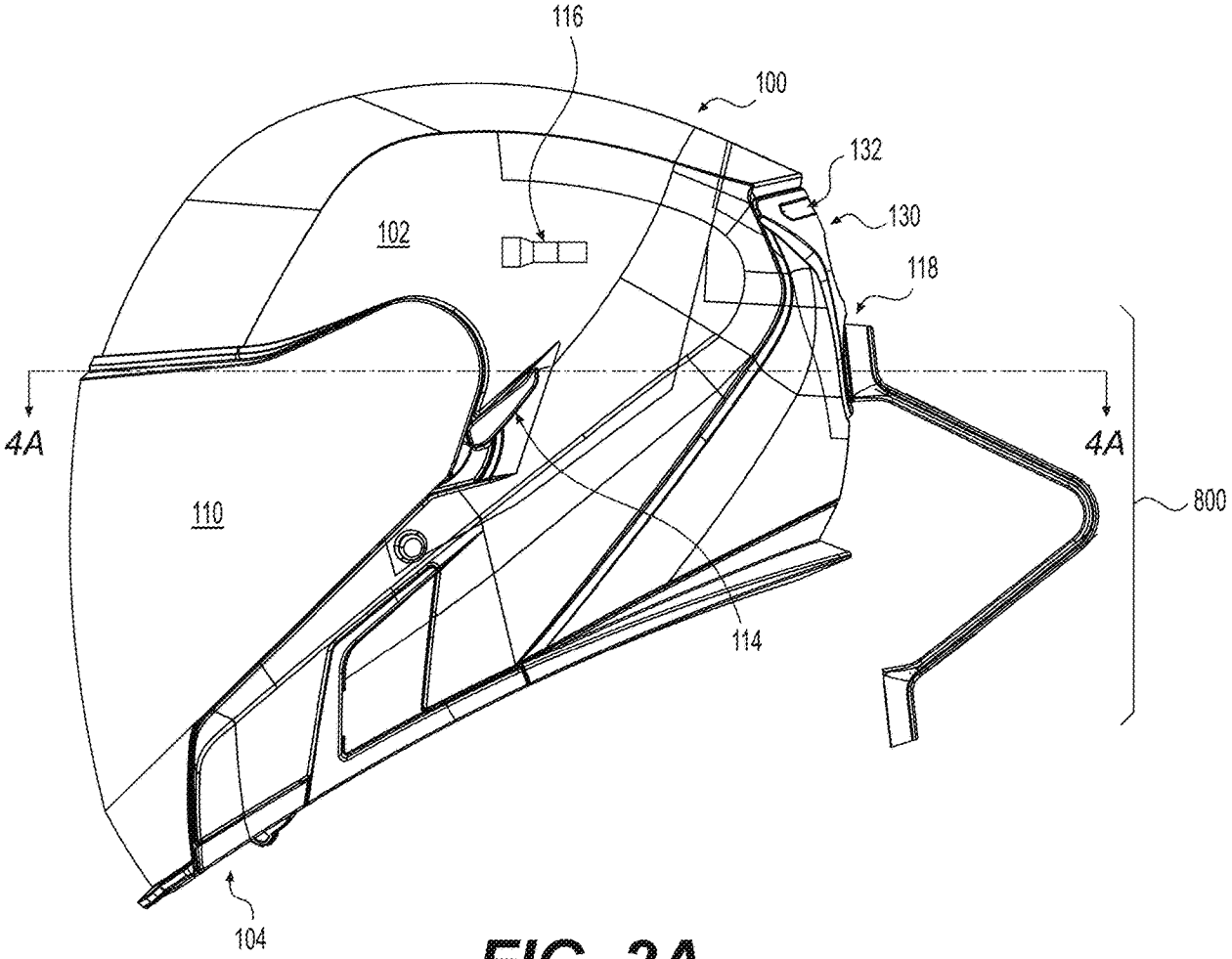
FIG. 2A is a left side elevation view of the helmet of FIG. 1 with the visor in a lowered position.
Figure 2B:
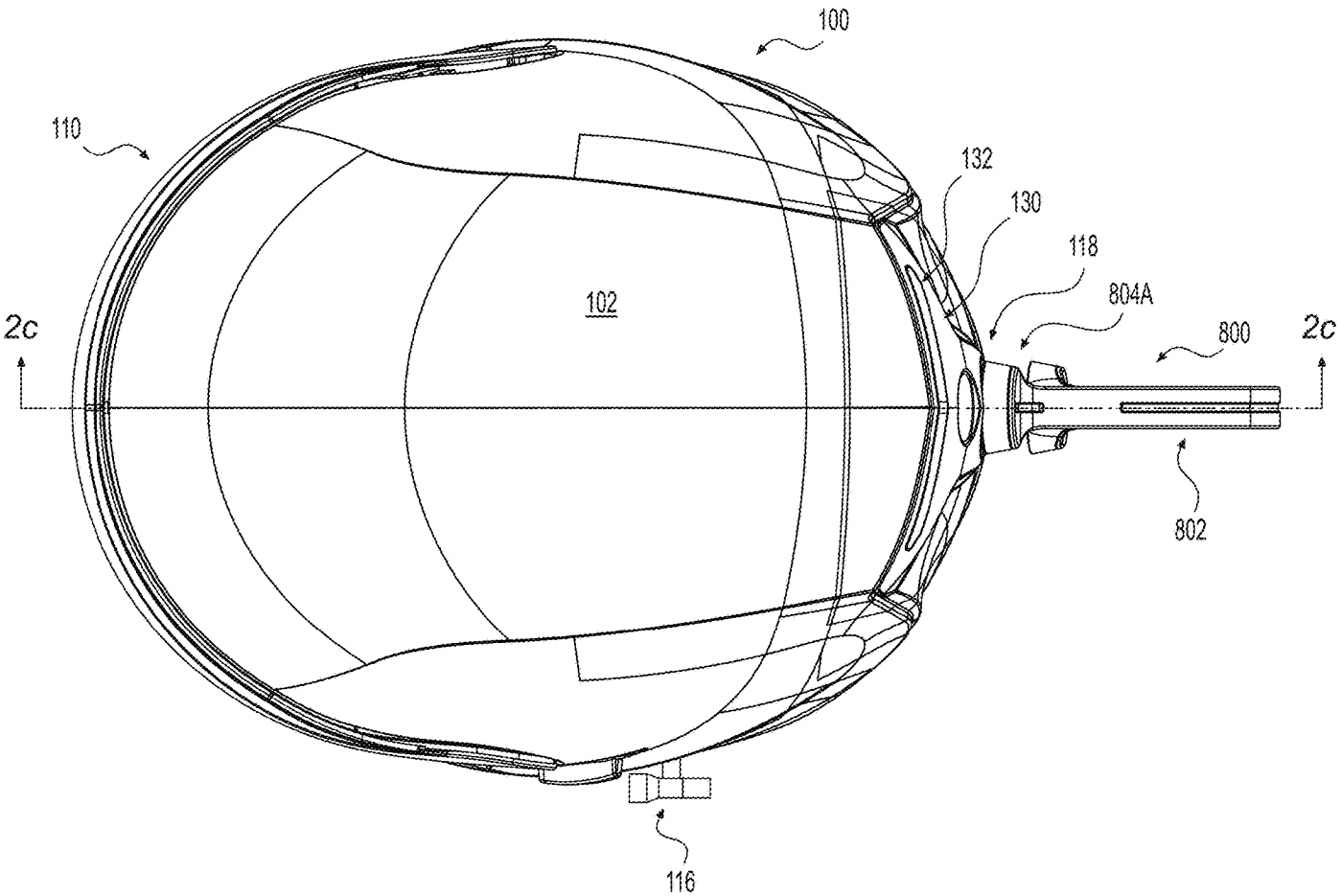
FIG. 2B is a top plan view of the helmet of FIG. 2A.
Figure 2C:
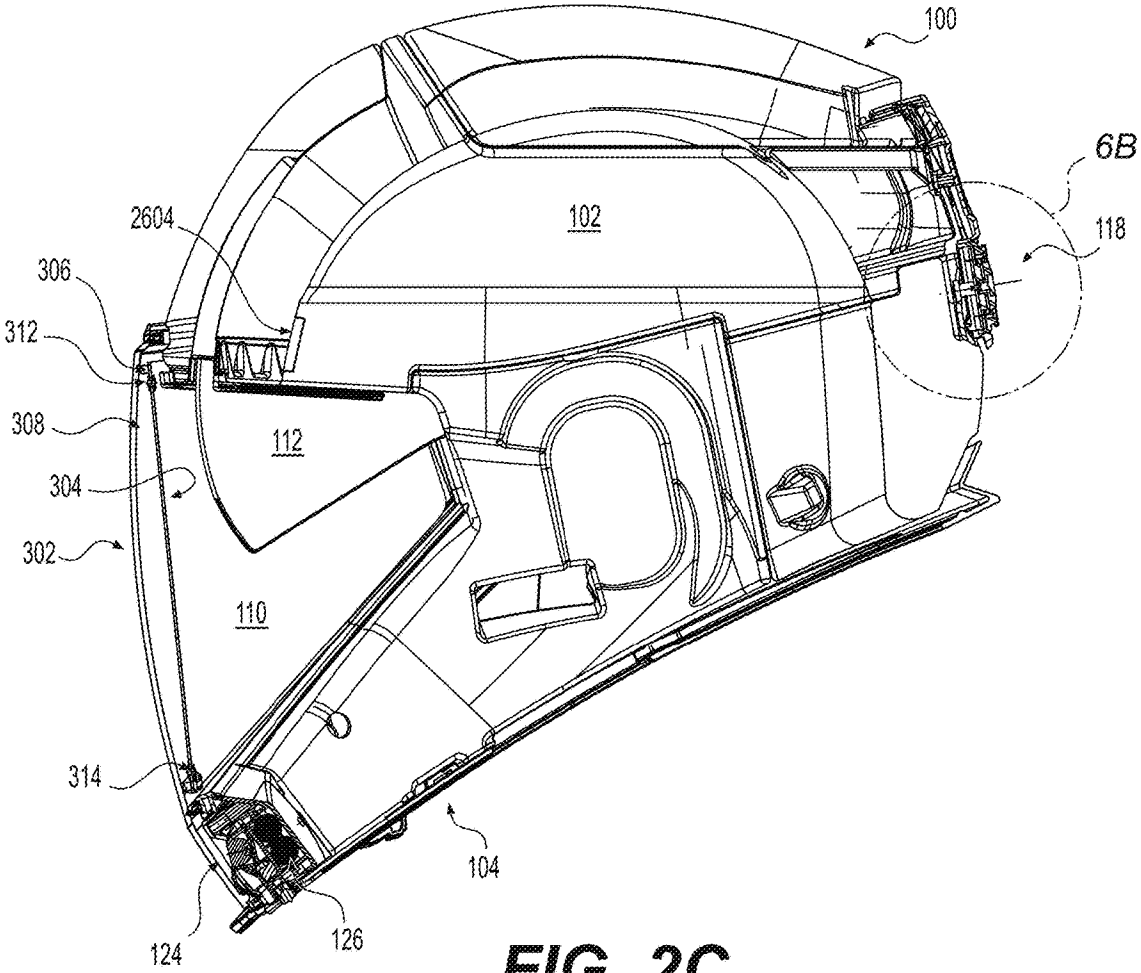
FIG. 2C is a cross-sectional view of the helmet of FIG. 2B taken through line 2C-2C of FIG. 2B, with the electrical connector assembly removed.
Figure 3:
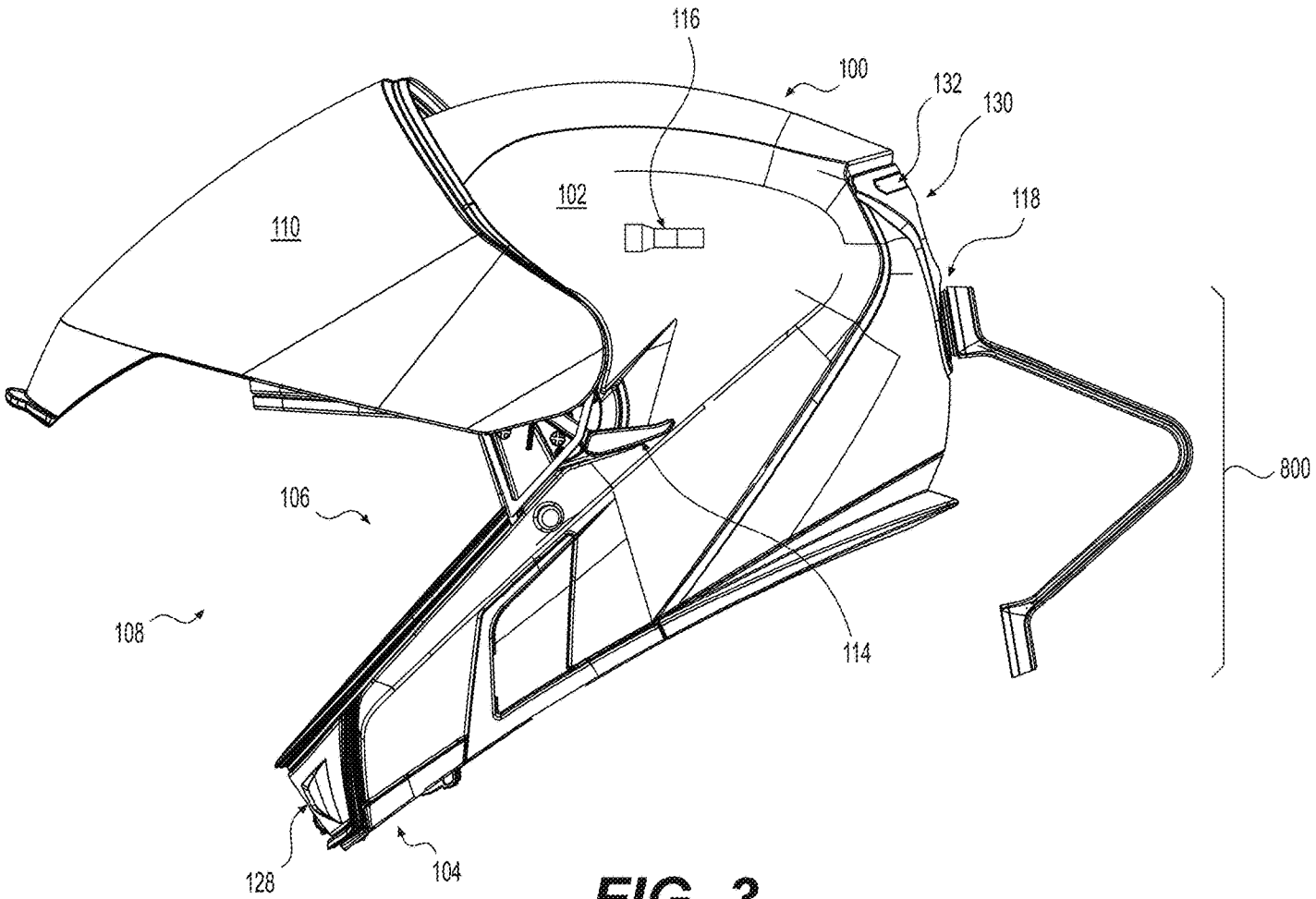
FIG. 3 is a left side elevation view of the helmet of FIG. 1 with the visor in a raised position, and the eye shield in a raised position.

Referring to FIGS. 1 to 3, the helmet 100 includes a helmet shell 102 that is adapted to protect a majority of the wearer's head. A lower forward portion of the helmet shell 102 defines a jaw shield 104. It is contemplated that the jaw shield 104 could be selectively connected to the helmet shell 102. The helmet shell 102 and the jaw shield 104 together define an inner space 106 that is shaped to accommodate the head of the wearer. A rear light frame 130 is connected to the helmet shell 102 at a back of the helmet shell 102. A rear light 132 is attached within the rear light frame 130.

The inner space 106 opens to the exterior of the helmet 100 at a semi-crescent-shaped opening 108 in front of the wearer's eyes when the wearer wears the helmet 100. The opening 108 is defined between a forward edge of the helmet shell 102 and an upper edge of the jaw shield 104.

The helmet 100 includes a visor 110 pivotally connected to the helmet shell 102. The visor 110 is pivotally movable between (a) a raised position, in which the visor 110 is at least partially above the opening 108 and substantially out of the wearer's field of vision (as shown in FIG. 1), and (b) a lowered position, in which the visor 110 closes the opening 108 in front of the wearer's eyes (as shown in FIG. 2A) as well as many positions therebetween. Furthermore, the helmet 100 includes an eye shield 112 pivotally connected to the helmet shell 102. In order to pivotally move the eye shield 112, the helmet 100 includes an eye shield lever 114. It is contemplated that the eye shield could be any type of eye shield, such as, a sunshield. The manner in which the eye shield 112 is pivotally moved using the lever 114 is well-known in the art, and will not be discussed here at much length. Suffice to say that, by pulling or pushing the lever downwardly or upwardly, respectively, the eye shield 112 can pivotally move between (a) a raised position, in which the eye shield 112 is at least partially above the opening 108 and substantially out of the wearer's field of vision (as shown in FIG. 3), and (b) a lowered position, in which the eye shield 112 is disposed in the opening 108 in front of the wearer's eyes (as shown in FIG. 1) and behind the visor 110 when the visor 110 is in the lowered position.

An optional flashlight 116 is attached to the helmet shell 102. It is contemplated that electric devices other than the flashlight 116 could be connected to the helmet shell 102 or the jaw shield 104, such as, for example, a camera, a GPS, a microphone, headphones, and the like.

Referring to FIG. 2C, the helmet 100 further includes a flashlight 124 included at the foremost part of the jaw shield 104. The flashlight 124 is powered by a set of batteries 126 provided in the jaw shield 104. The foremost part of the jaw shield 104 includes an aperture 128 in order to allow the light of the flashlight 124 to illuminate the area in front of the helmet 100 (as seen in FIG. 1). When the visor 110 is in a lowered position (as shown in FIG. 2A) the light emitted from the flashlight 124 shines through the lower portion of the visor 110 to illuminate the area in front of the helmet 100.

Referring back to FIG. 1, the helmet 100 includes a receiver 118 attached to the rear light frame 130. It is contemplated that the receiver 118 could be attached to other portions of the helmet 100, such as, the side of the helmet shell 102, the jaw shield 104, or to a portion of the back of the helmet shell 102 other than the rear light frame 130, and the like. The receiver 118 is connected to one end of an electrical connector assembly 800. As will be described in greater detail below, the receiver 118 is adapted to be electrically connected to an external power source via the electrical connector assembly 800.

Figure 4A:
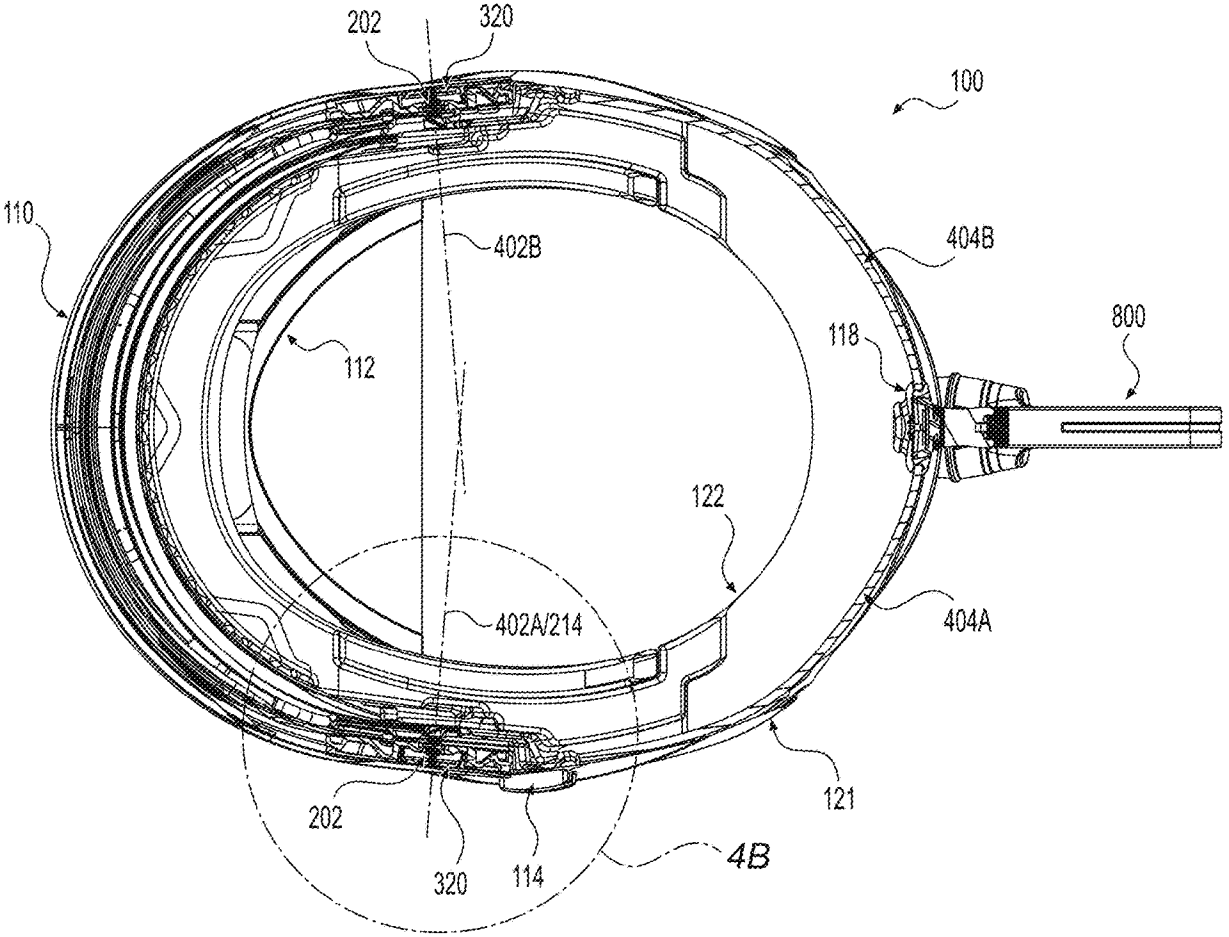
FIG. 4A is a cross-sectional view of the helmet of FIG. 2A taken through line 4A-4A of FIG. 2A.

Referring now to FIG. 4A, the helmet shell 102 consists of an outer helmet shell 121, and an inner helmet shell 122. The inner helmet shell 122 is placed within the outer helmet shell 121 and forms the inner space 106. The outer helmet shell 121 is constructed of a rigid material, and the inner helmet shell 122 is constructed of a soft cushioning material, such as an expanded polystyrene (EPS) foam. It is contemplated that additional inner protective layers may be added to the helmet shell 102.

Figure 5A:
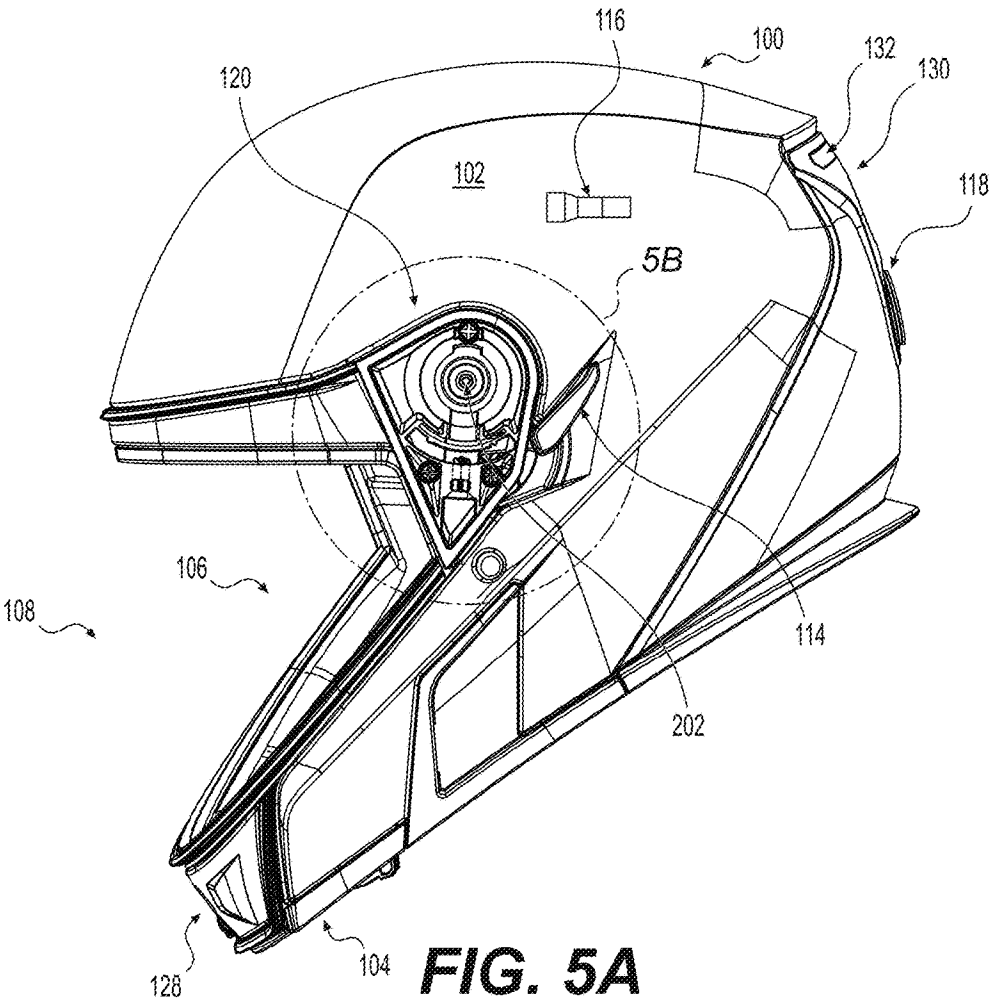
FIG. 5A is a left side view of the helmet of FIG. 1 with the electrical connector assembly, the eye shield, and the visor removed.
Figure 5B:
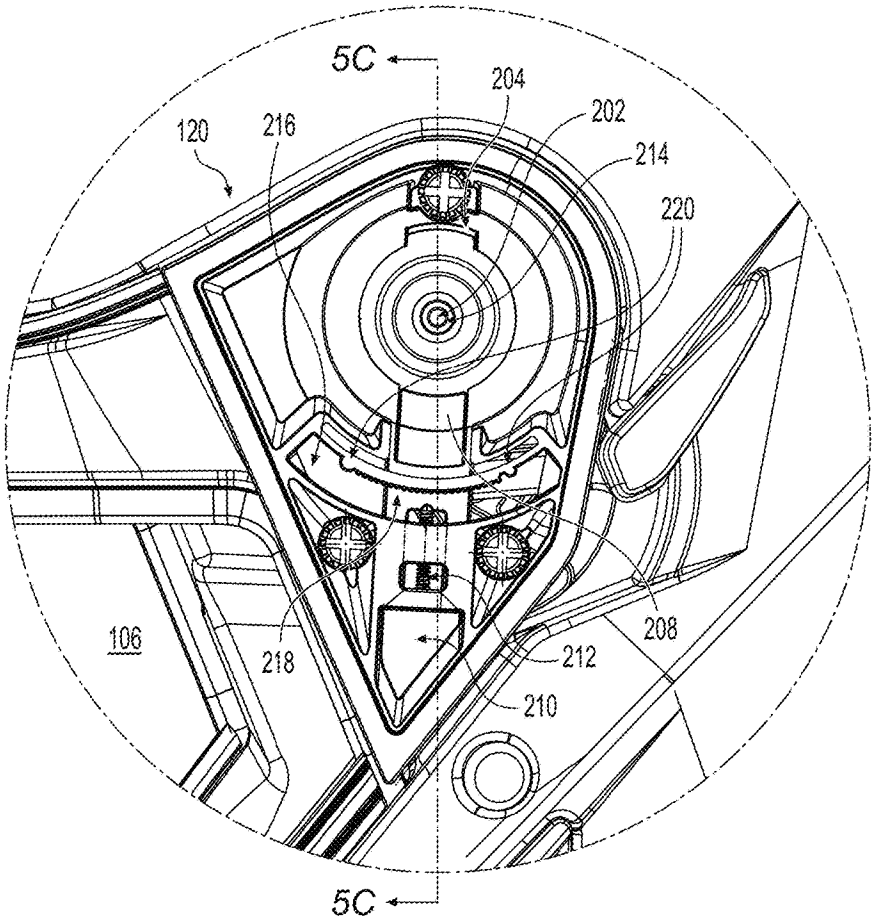
FIG. 5B is a magnified view of portion 5B of FIG. 5A.
Figure 5C:
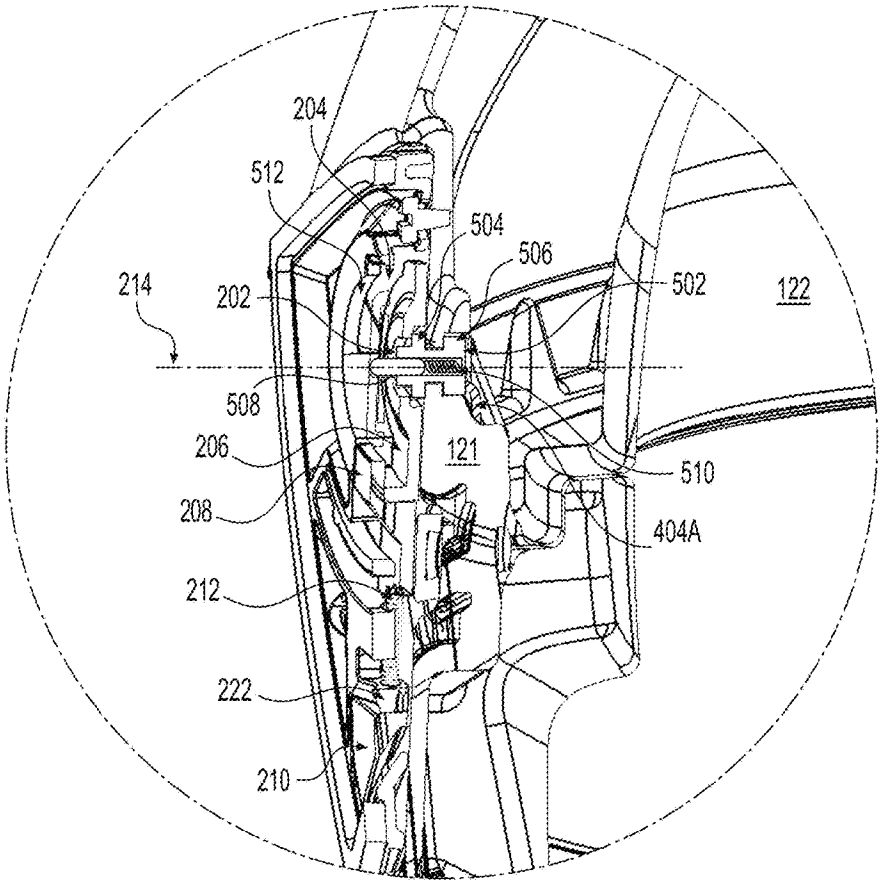
FIG. 5C is a cross-sectional view of a visor mounting portion, and neighbouring portion thereof, of the helmet of FIG. 5A taken through line 5C-5C of FIG. 5B.

As seen in FIGS. 5A, 5B and 5C the visor 110 can be detached from the helmet shell 102. When the visor 110 is removed from the helmet shell 102, two visor mounting portions 120 on each side of the helmet shell 102, on which the visor 110 is adapted to be attached, are exposed. The visor mounting portion 120 includes a helmet electrical contact 202 adapted to be connected to the power source via the receiver 118 (described below). Each of the helmet electrical contacts 202 is in the form of a spring-loaded pin assembly 202. The pin assembly 202 defines a pin axis 214. Other types of helmet electrical contact are contemplated.

As can be seen in FIG. 5C, the pin assembly 202 is placed in an opening in the outer helmet shell 121. The pin assembly 202 includes a housing 502. The housing 502 has a flange 504 connecting at a forward portion of the housing 502. A nut 506 connects to a rear portion of the housing 502.

The outer helmet shell 121 is retained between the flange 504 and the nut 506. It is contemplated that the pin assembly 202 could be connected to the outer helmet shell 121 in a different manner, for example, by an adhesive, or by one or more mechanical fasteners, and the like. The pin assembly 202 includes a pin 508 disposed in part in the housing 502. A spring 510 in the housing 502 biases the pin 508 laterally outwardly on one end, and abuts the inner portion of the housing 502 on the other end. The housing 502 is connected to a wire 404*a*.

The visor mounting portion 120 includes an upper chamber 204 and a lower chamber 206. Each of the upper chamber 204 and lower chamber 206 is partially covered by a flange 512. The visor mounting portion 120 further includes a movable lip 208. As illustrated in FIG. 5C, the lip 208 extends radially inwardly of the lower chamber 206, in relation to the pin axis 214 of the pin assembly 202. The lip 208 covers the lower chamber 206 with the flange 512. As can be seen in FIG. 5C, the top portion of the lip 208 is wedge-shaped. The lip 208 is connected to a puller 210. One end of a spring 212 abuts a portion of the puller 210. The other end of the spring 212 abuts a fixed portion 222 of the visor mounting portion 120. When the wearer pulls downwardly on the puller 210, the lip 208 is pulled downwardly by compressing the spring 212, thus exposing the lower chamber 206. Releasing the puller 210 causes the lip 208 to return to the position illustrated in FIG. 5C.

Referring to FIG. 5B, the visor mounting portion 120 also includes an arcuate aperture 216 below the pin assembly 202. A center of curvature of the arcuate aperture 216 corresponds to the pin axis 214 (as seen in FIG. 5C). The upper edge of the arcuate aperture 216 defines a set of small teeth 218, and a large tooth 220 on both sides of the set of small teeth 218.

Figure 7A:
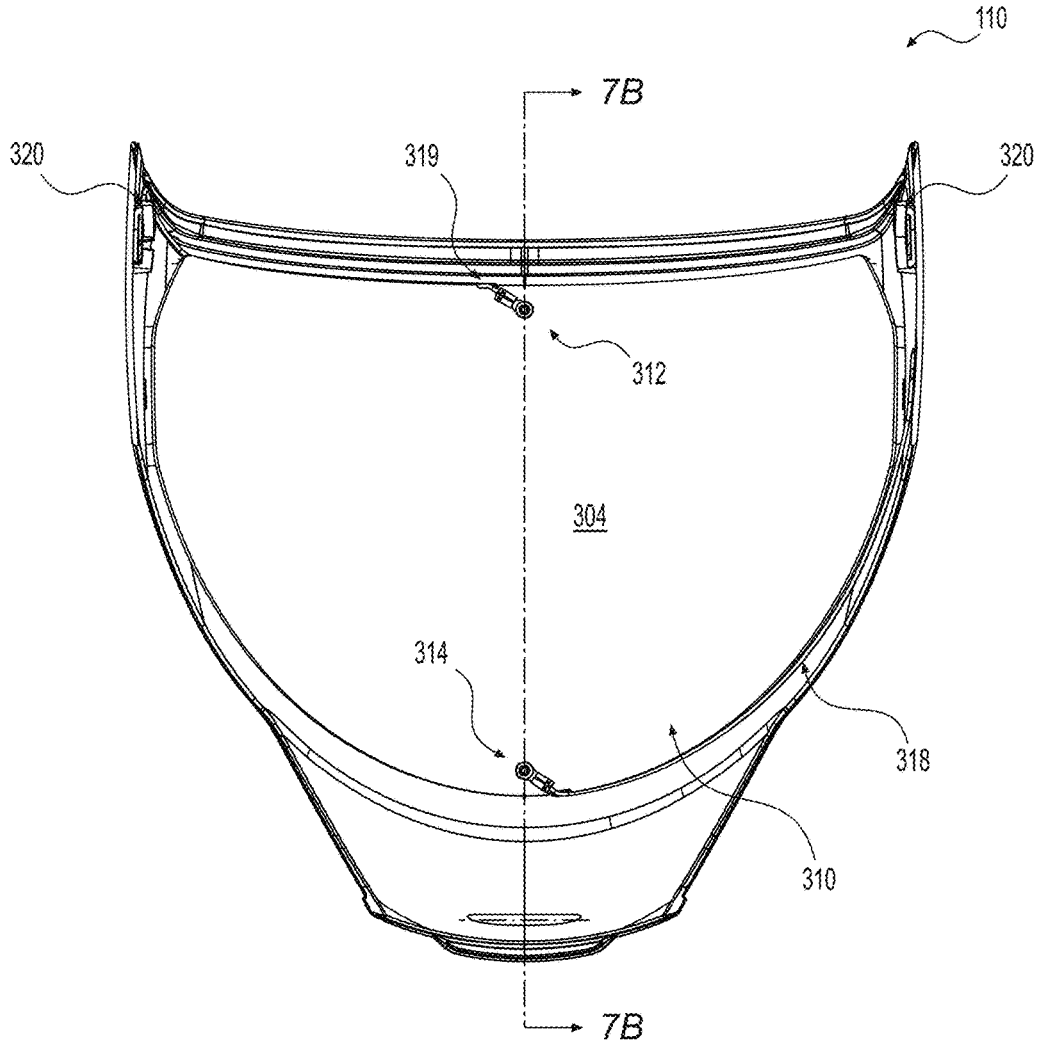
FIG. 7A is a cross-sectional view of the visor of FIG. 1 taken through the line 7A-7A of FIG. 7B.
Figure 7B:
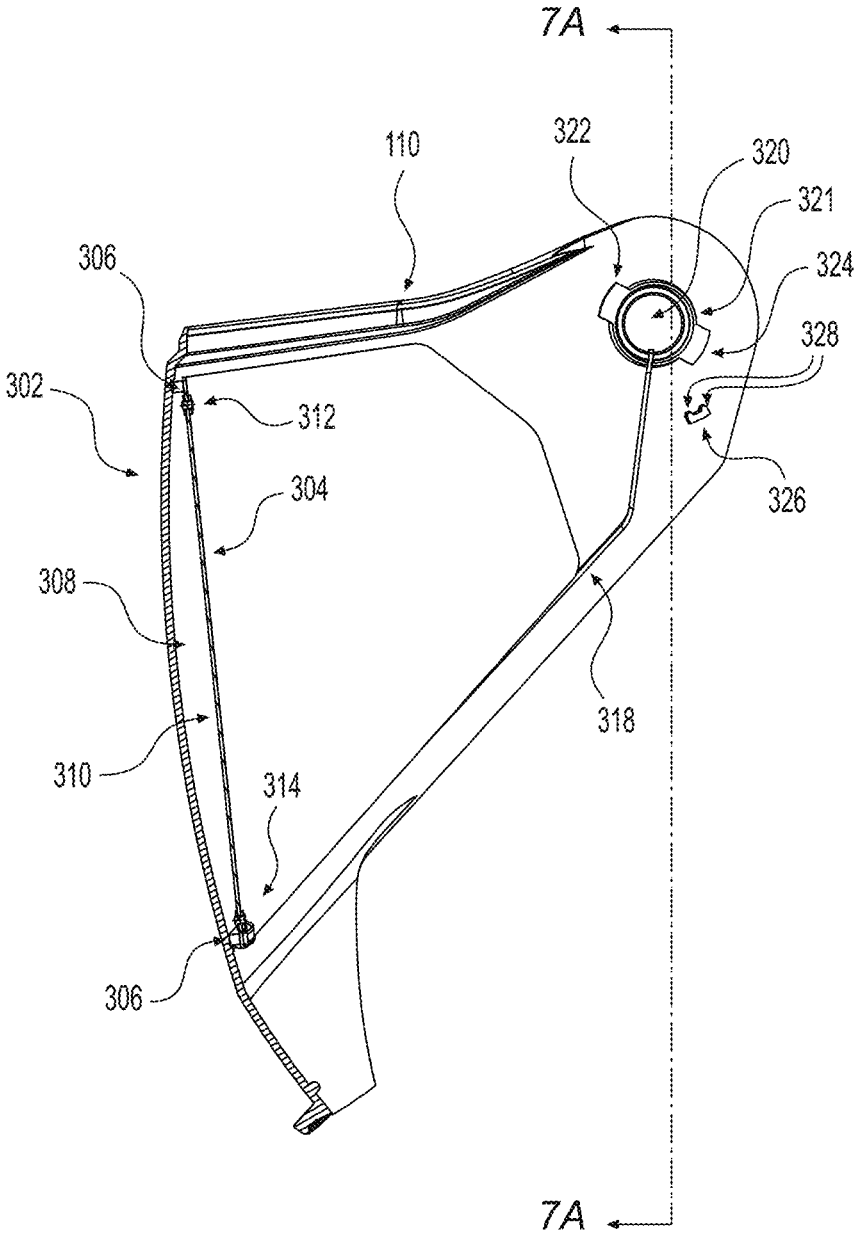
FIG. 7B is a cross-sectional view of the visor of FIG. 7A taken through line 7B-7B of FIG. 7A.

Illustrated in FIGS. 7A and 7B is the visor 110 removed from the helmet shell 102. The visor 110 is a double-layer, semi-crescent-shaped optically clear shield. The visor 110 includes an outer, semi-spherical, semi-crescent shaped visor portion 302 and a smaller inner, semi-cylindrically shaped visor portion 304. The outer visor portion 302 and inner visor portion 304 are sealed together by a die-cut one piece closed-cell foam 306, such that an air space 308 is formed between the outer visor portion 302 and inner visor portion 304. The air space 308 forms a thermal barrier that discourages condensation of the inner side of the inner visor portion 304 and the outer side of the outer visor portion 302 to ensure that the wearer has a clear field of vision through the visor 110. It is contemplated that the visor 110 may alternatively be a single layer shield. Furthermore, the inner and outer visor portions 302 and 304 could alternatively both be semi-spherically shaped or both be semi-cylindrically shaped, or both have asymmetrical shapes.

A visor heating element 310 is further attached to the inner visor portion 304. It is contemplated that the heating element 310 could be integrated within the inner visor portion 304. It is also contemplated that electric devices other than the heating element 310 could be included in the inner visor portion 304, such as, for example, a head-up display, and the like. The heating element 310 when operating, heats the air space 308 and discourages water and frost from forming on the inner visor portion 304, as a result of the heated air in the air space 308.

The manner in which the heating element 310 is implemented on the inner visor portion 304 is generally known to the art and will not be described at length here. The inner visor portion 304 includes an upper connector 312 attached about the upper edge of the inner visor portion 304, and a lower connector 314 attached about the lower edge of the inner visor portion 304. The heating element 310 establishes an electrical connection between the upper connector 312 and the lower connector 314, thereby heating the inner visor portion 304. Although the connectors 312, 314 are depicted as being attached, respectively, on the upper edge and lower edge of the inner visor portion 304, it is contemplated that the connectors 312 and 314 could be connected to the right edge and left ledge of the inner visor portion 304, or on the same edge of the inner visor portion 304.

The lower connector 314 is connected to a right visor electrical contact 320 via an electrical wire 318 which runs along the lower edge of the inner visor portion 304. It is contemplated that the electrical wire 318 could be a flexible printed circuit board (PCB). The visor electrical contact 320 is a PCB. Other types of visor electrical contact are contemplated. The upper connector 312 is electrically connected to the left visor electric contact 320 on the left side of the visor 110 via an electric wire 319. It is contemplated that the electrical wire 319 could be a flexible PCB. The left visor electric contact 320 is generally a mirror image of the right visor electrical contact 320 illustrated in FIG. 7B. However, since the upper connector 312 is attached about the upper edge of the inner visor portion 304, the electrical wire 319 connecting the upper connector 312 to the left visor electric contact 320 runs at the upper edge of the inner visor portion 304.

Each side of the visor 110 defines a receptacle 321 on a laterally inward side of the outer visor portion 302. The visor electrical contact 320 is received and is connected to its receptacle 321. Each receptacle 321 has a forward tab 322 and a rearward tab 324 for each side of the visor 110. In order for the visor electrical contacts 320 to be attached on the helmet shell 102 via the corresponding visor mounting portions 120, the forward tabs 322 are aligned with the upper chambers 204, and the rearward tabs 324 are aligned with the lower chambers 206 over the lips 208. Once aligned, the user disengages the lips 208 by pulling the levers 210, thus exposing the lower chambers 206, and pushes the sides of the visor 110 against the visor mounting portions 120. Once the rearward tabs 324 are received in the lower chambers 206, the user releases the levers 210 causing the springs 212 to bias the lips 208 back to their initial positions, covering the lower chambers 206 hosting the rearward tabs 324, thereby preventing the rearward tabs 324 from being removed from the visor mounting portions 120. While the visor 110 pivots about the helmet shell 102, the forward tabs 322 and the rearward tabs 326 are held behind the flanges 512. If the user desires to remove the visor 110, the user must align the forward tabs 322 with the upper chambers 204, and the rearward tabs 324 with the lower chambers 206. The user then disengages the lips 208 simply by pulling the levers 210, thereby allowing the visor 110 to be removed from the visor mounting portions 120.

Referring to FIG. 7B, each side of the visor 110 further has a pin 326 adapted to be inserted within its corresponding arcuate aperture 216 when mounted on the visor mounting portion 120. The pin 326 has two teeth 328, which engage with the large teeth 220 or the set of small teeth 218 as the visor 110 is pivotally moved relative to the helmet shell 102. Consequently, the visor 110 will only pivot between a plurality of positions when a certain amount of force is applied to the visor 110, such as when the visor 110 is pushed or pulled by the wearer.

Figure 4B:
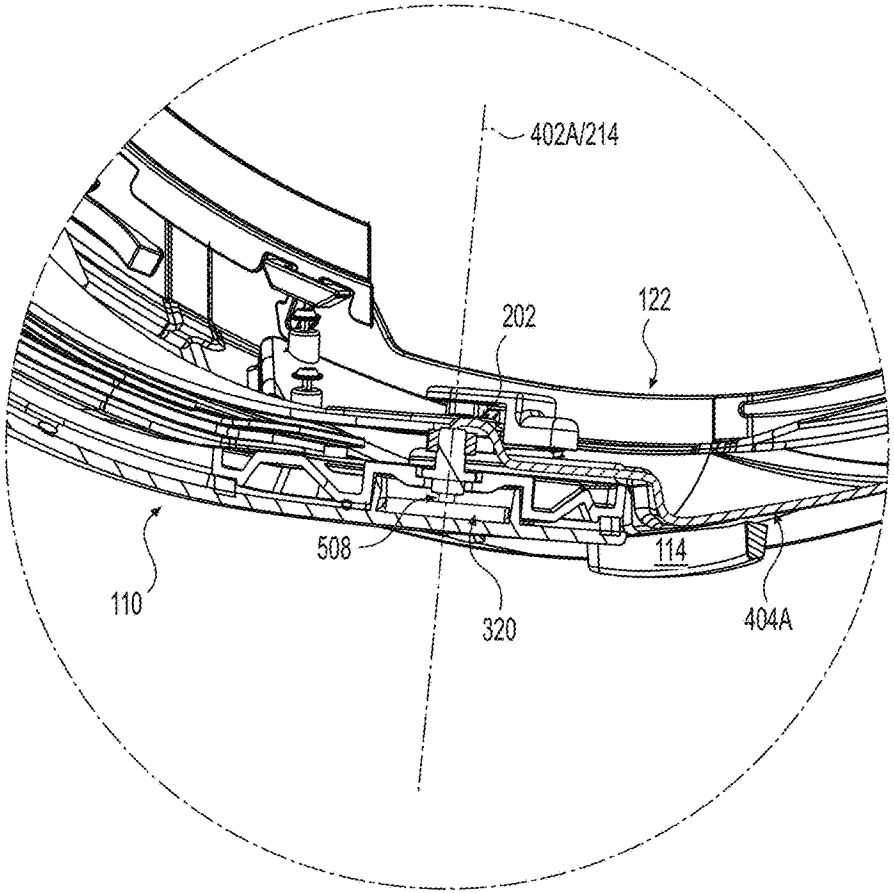
FIG. 4B is a magnified view of portion 4B of FIG. 4A.

Reference is briefly made to the left side of the helmet 100 seen in FIGS. 4A and 4B. When the visor 110 is attached to the visor mounting portion 120, the pin 508 of the pin assembly 202 is biased against the visor electrical contact 320 at the pin axis 214, which is coaxial to a pivot axis 402*a* of the visor 110. As such, an electrical connection between the pin assembly 202 and the visor electrical contact 320 is maintained as the visor 110 is pivotally moved. The right side of the helmet 100 is a mirror image of the left side. The right visor electrical contact 320 is in contact with the pin 508 of the right pin assembly 202 about a pivot axis 402*b* (as shown in FIG. 4A). The pivot axes 402*a* and 402*b* are skewed relative to one another as shown in FIG. 4A.

It is contemplated that, although the pin 508 of the pin assembly 202 is depicted as being biased against the visor electrical contact 320 (as shown in FIG. 4B), the visor electrical contact 320 may be the one biased against the pin assembly 202. It is also contemplated that the visor electrical contact 320 could be a spring-loaded pin, and the pin assembly 202 could be a PCB.

The left pin assembly 202 is electrically connected to the receiver 118 via the wire 404*a*. The right pin assembly 202 is electrically connected to the receiver 118 via the wire 404*b*. Both the wires 404*a*, 404*b* run between the outer helmet shell 121 and the inner helmet shell 122. It is contemplated that each of the wires 404*a*, 404*b* could run in the inner helmet shell 122, or along the inside of the inner helmet shell 122, or a combination thereof. It is contemplated that in some implementations, the wires 404*a*, 404*b* could connect to a power source via a connection other than the receiver 118 and the electrical connector assembly 800.

Other wires (not shown) also connect the flashlight 116 to the receiver 118. Other wires (not shown) also connect the receiver to a transmitter, such as a signal transmitter 2604 of FIG. 2C (described in more detail below). Other wires (not shown) also connect the set of batteries 126 of the flashlight 124 to the receiver 118. The set of batteries 126 is a set of rechargeable batteries that is electrically charged as it is connected to the external power source via the receiver 118. Other wires (not shown) also connect the rear light 132 to the receiver 118.

Figure 6A:
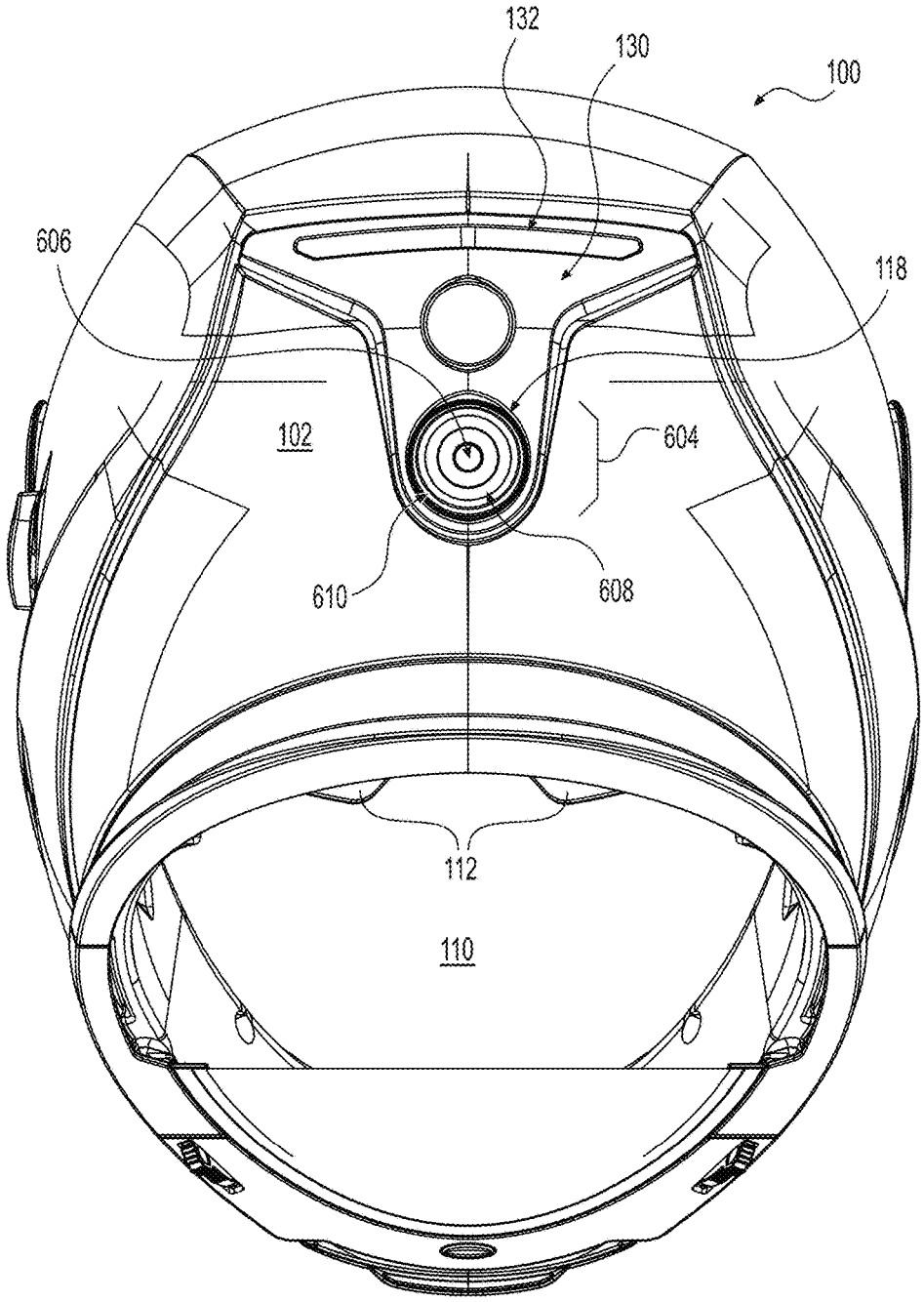
FIG. 6A is a rear elevation view of the helmet of FIG. 2A without the electrical connector assembly.
Figure 6B:
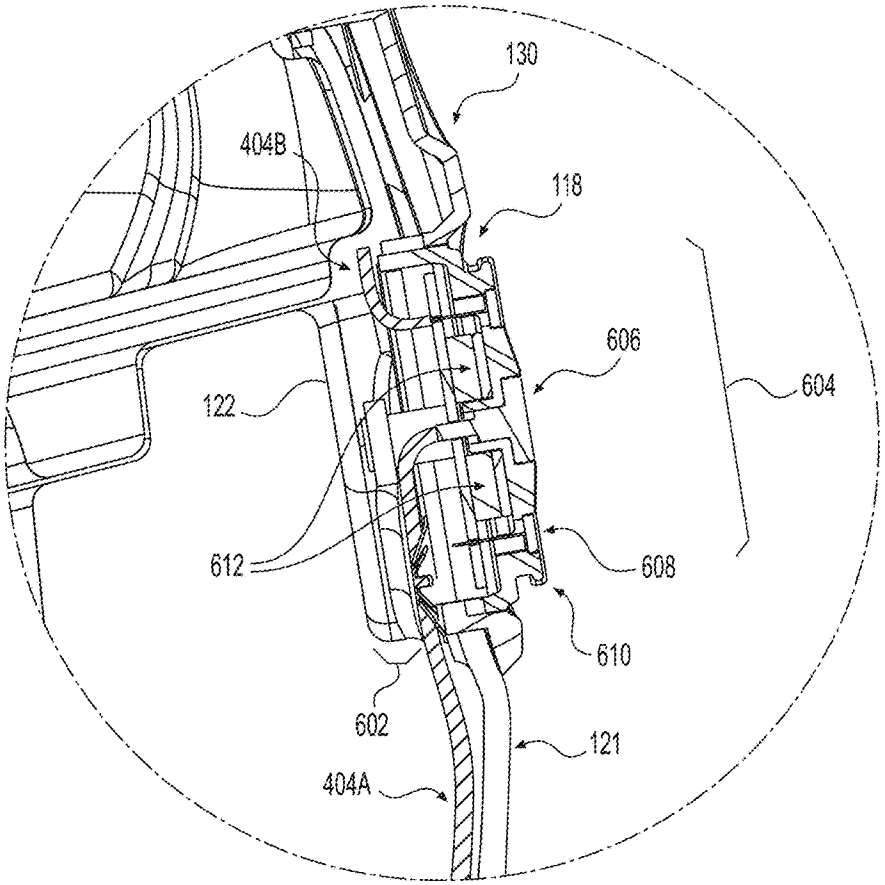
FIG. 6B is a magnified view of a portion 6B of FIG. 2C.

As seen in FIGS. 6A and 6B, the electrical connector assembly 800 can also be detached from the receiver 118. As stated previously, the receiver 118 is attached to the helmet shell 102 via the rear light frame 130. More precisely, a portion of the receiver 118 is placed in a cavity formed by an opening of the rear light frame 130 and a recess 602 formed by the inner helmet shell 122. The receiver 118 is fixed to the rear light frame 130 while having an exposed connection surface 604 at the back of the helmet 100. It is contemplated that the receiver 118 could be fixed in a different manner, for example, by an adhesive, by one or more mechanical fasteners, and the like.

On the surface 604, the receiver 118 has an electrically conductive element having an electrically conductive disk 606 and an electrically conductive ring-shaped element 608. The electrically conductive disk 606 is connected to the electrical wire 404*a*, and the electrically conductive ring 608 is connected to the electrical wire 404*b*. The surface 604 also has a circumferential recess 610 extending radially inwardly in relation to the conductive disk 606. Under the surface 604, the receiver 118 includes a pair of annular magnets 612. Although depicted as a pair of annular magnets 612, it is not limitative. As such, one annular magnet, or more than two annular magnets may be utilized. It is further contemplated that the shape of the magnets are not limitative, and a plurality of magnets may be organized in an annular manner, or in some other manner.

Figure 8A:
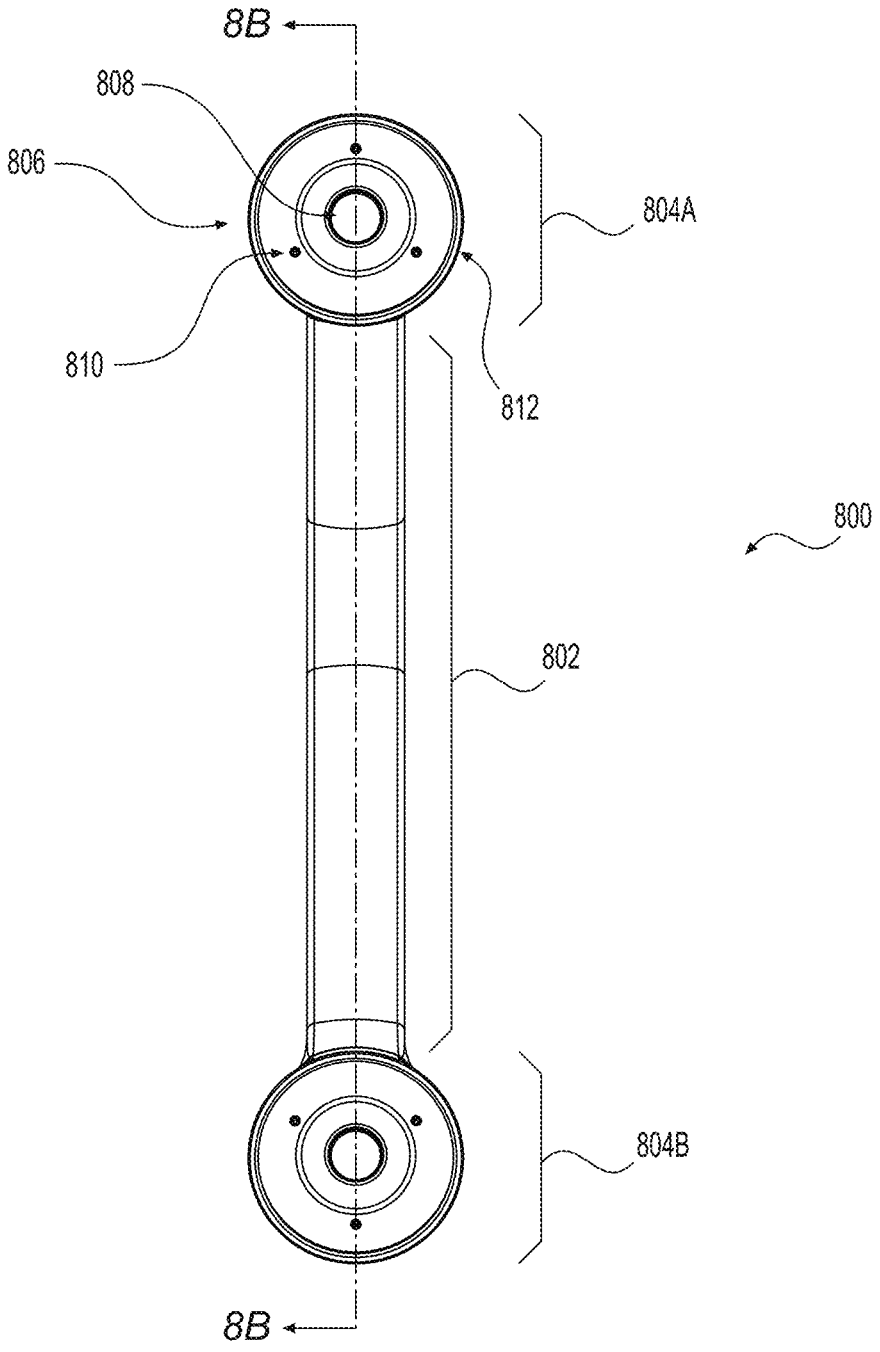
FIG. 8A is a front elevation view of the electrical connector assembly of the helmet of FIG. 1.
Figure 8B:
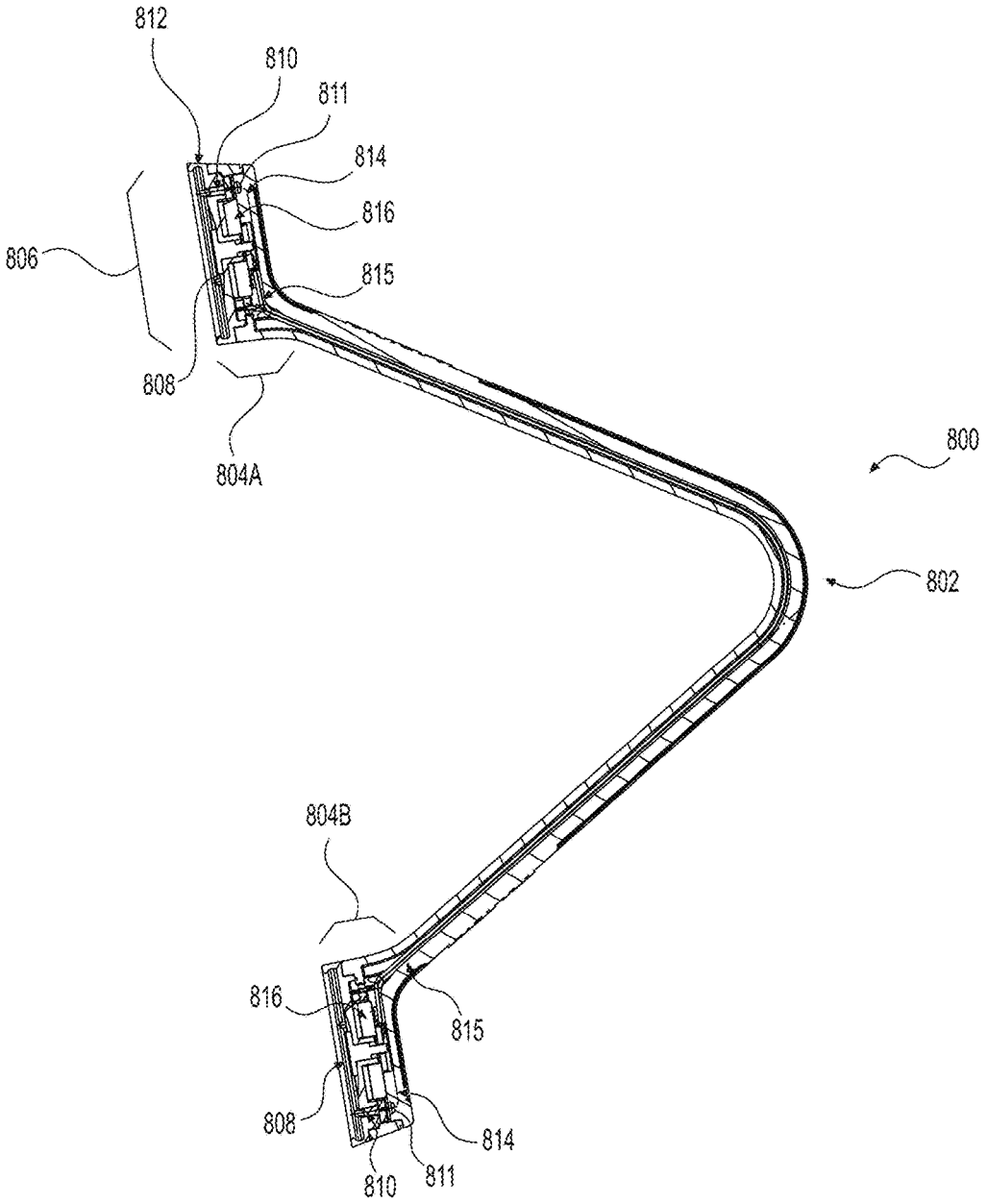
FIG. 8B is a cross-sectional view of the electrical connector assembly of FIG. 8A taken through 8B-8B of FIG. 8A.

Reference is now made to FIGS. 8A and 8B, illustrating the electrical connector assembly 800. The electrical connector assembly 800 includes a flexible member 802 and connectors 804*a*, 804*b* connected to the ends of the flexible member 802. The connectors 804*a* and 804*b* are mirror images of one another.

Each of the connectors 804*a* and 804*b* include a connection surface 806. The surface 806 includes an electrical conductive element having an electrically conductive disk 808, and three spring-loaded pins 810. Although depicted as having three spring-loaded pins 810 organized in a triangular pattern about the conductive disk 808, it is not limited as such, and it is contemplated that any number of spring-loaded pins 810 may be used. The spring-loaded pins 810 are electrically connected to an electrical wire 814 via an annular-shaped PCB 811. Although the PCB is depicted as annular-shaped, it is not limited as such, and may be shaped differently. The conductive disk 808 is connected to an electrical wire 815. It is contemplated that the conductive disk 808 could be connected to the electrical wire 815 via a PCB. The conductive disk 808 and the spring-loaded pins 810 of the connector 804*a* are electrically connected to the conductive disk 808 and the spring loaded pins 810 of the connector 804*b*, respectively, via the wires 814, 815. The wires 814, 815 are embedded within the flexible member 802. The surface 806 further includes a circumferential lip 812 extending radially inwardly in relation to the center of the surface 806. Under the surface 806, the connector 804 includes a pair of annular magnets 816. Although the magnets 816 are depicted as angular magnets, it is not limitative. As such, one annular magnet, or more than two annular magnets may be utilized. It is further contemplated that the shape of the magnets are not limitative, and a plurality of magnets may be organized in an annular manner, or in some other manner.

Figure 9:
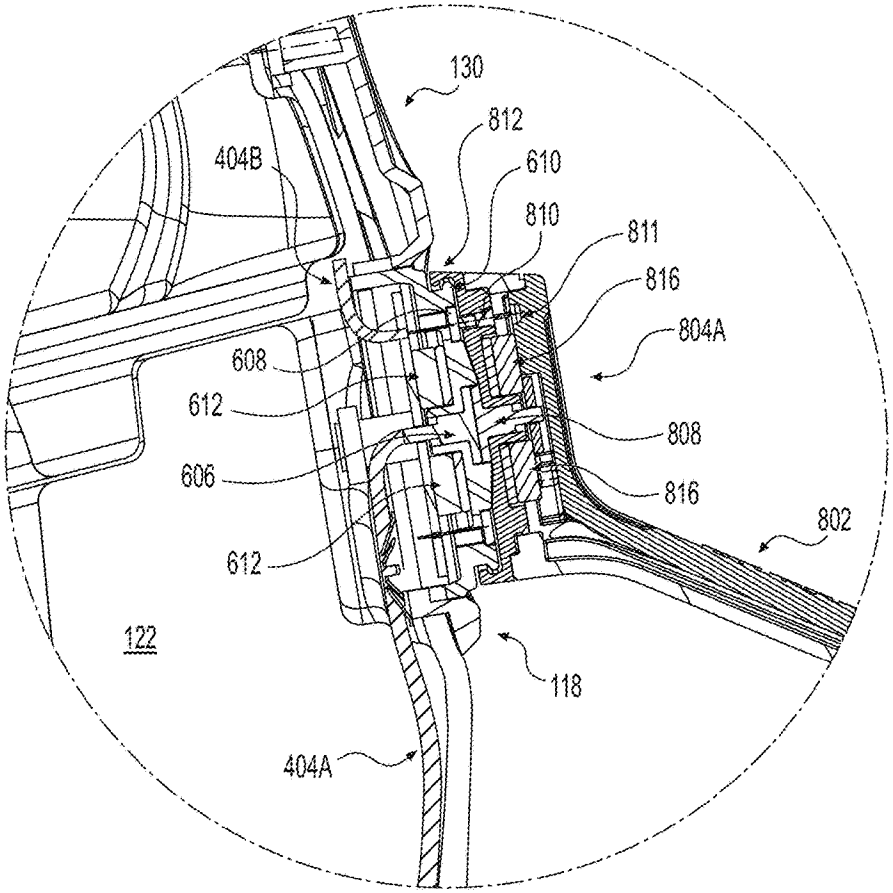
FIG. 9 is a cross-sectional view taken through a vertical longitudinal plane passing through a center of the receiver of FIG. 6B with the electrical connector assembly of FIG. 8B connected, as in FIG. 1.

Referring now to FIG. 9, the connection of the connector 804*a* to the receiver 118 as shown in FIG. 1 will be described. The connection of the connector 804*a* to the receiver 118 includes two types of connections. First, a magnetic connection is established between the magnets 816 of the connector 804*a* and the magnets 612 of the receiver 118. Second, when the connector 804*a* is pushed against the receiver 118, the lip 812 of the connector 804*a* is received in the recess 610 of the receiver 118, thereby creating a mechanical connection.

When the connector 804*a* and the receiver 118 are connected as shown, the conductive disk 606 and the conductive disk 808 are in contact with one another, thereby establishing an electrical connection. Similarly, the conductive ring 608 and the spring-loaded pins 810 are in contact with one another, thereby establishing another electrical connection.

Figure 10:
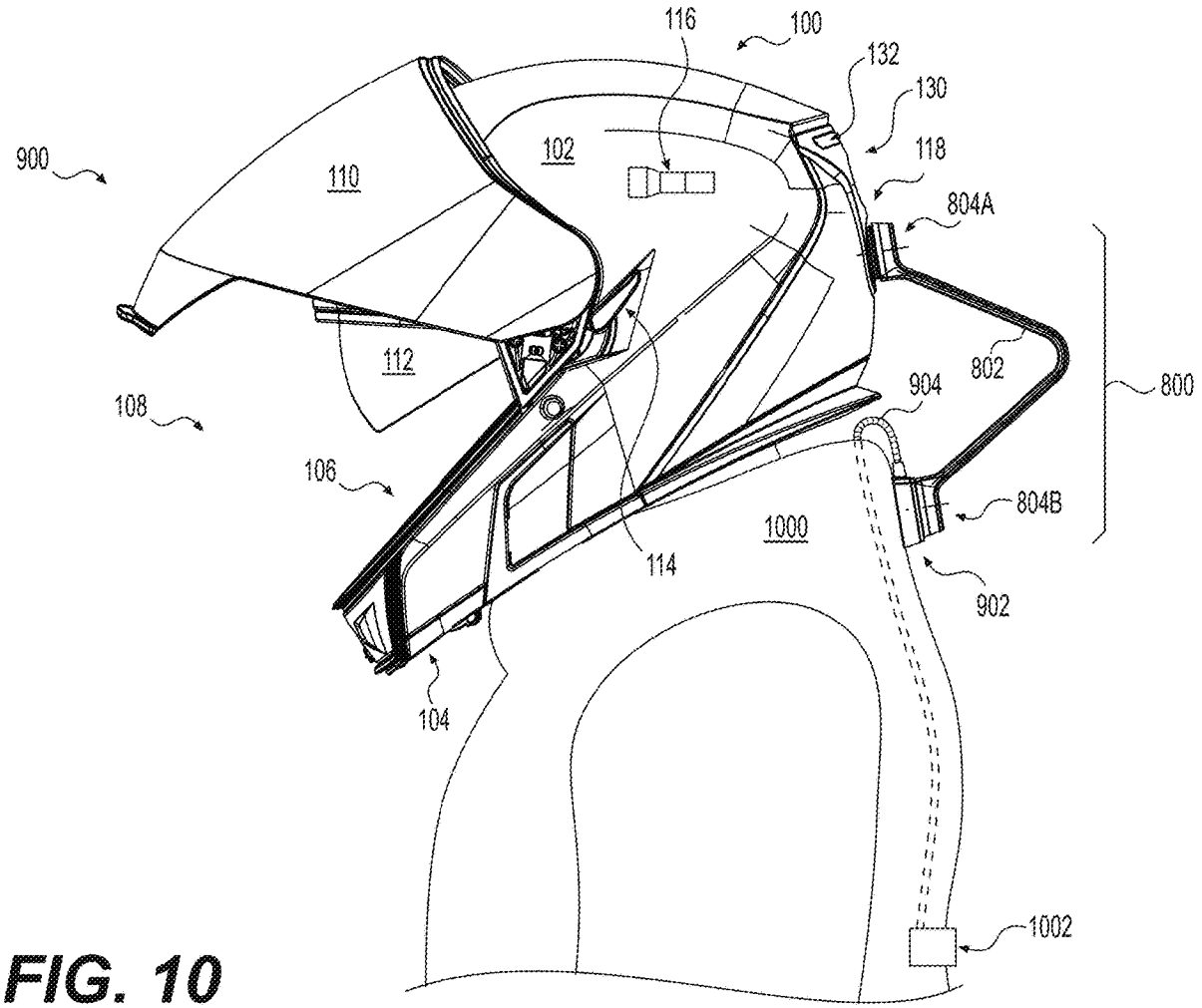
FIG. 10 is a left side elevation view of a person wearing the helmet of FIG. 1 and a garment to which the electrical connector assembly of FIG. 1 is connected.

Reference is now made to FIG. 10 illustrating a helmet and garment assembly 900. The helmet and garment assembly 900 includes the helmet 100 connected to the electrical connector assembly 800, and a garment receiver 902 attached to a garment 1000 at the back of the garment 1000. It is contemplated that the garment receiver 902 could be attached to other portions of the garment 1000, such as on the side, or the front. The connector 804*a* is connected to the receiver 118, which is connected to, inter alia, the heating element 310 (as seen in FIG. 4A). The connector 804*a* is further connected to the connector 804*b* via the flexible member 802, which is connected to the garment receiver 902. The garment receiver 902 is attached to the garment 1000, which in this implementation is a coat of the helmet wearer. It is anticipated that other types of garment may be used, such as a scarf, a neck warmer, and the like. The garment receiver 902 is electrically connected to an external battery 1002, such as the battery of a vehicle 1004 (see FIG.

31), via an electrical cable 904. The cable 904 passes inside the garment 1000 by entering the collar of the wearer, and is attached to the battery 1002. It is contemplated that the battery 1002 could be any kind of battery, such as, a rechargeable battery pack connected to or provided in the garment 1000, a portable battery, and the like.

Figure 11B:
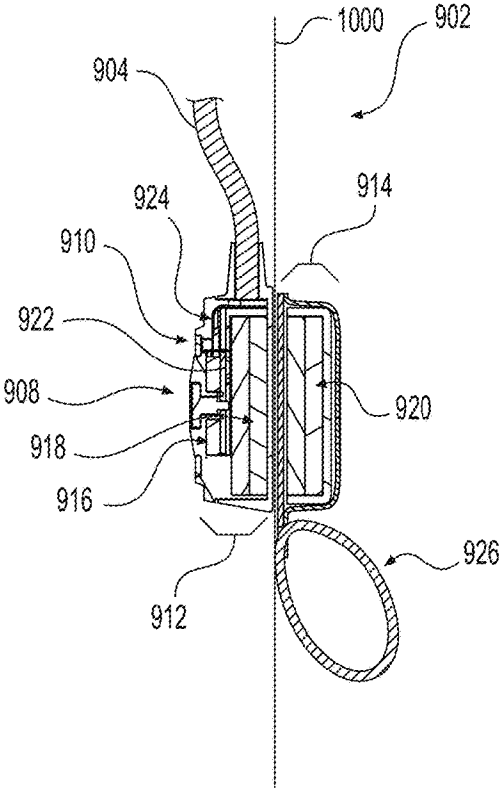
FIG. 11B is a cross-sectional view of the receiver of FIG. 11A taken through line 11B-11B of FIG. 11A.
Figure 11A:
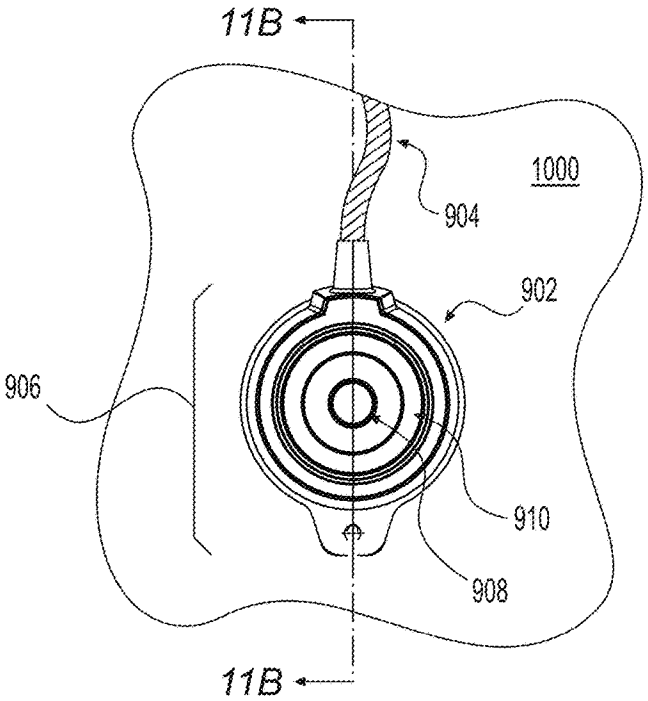
FIG. 11A is a rear elevation view of a garment receiver of FIG. 10 with the electrical connector assembly removed.

Referring to FIGS. 11A and 11B, the garment receiver 902 includes an outer component 912 and an inner component 914. As it will be described in further detail below, the outer component 912 and the inner component 914 magnetically connect to one another, with a portion of the garment 1000 retained therebetween.

The connecting surface 906 of the outer component 912 includes an electrically conductive element having an electrically conductive disk 908, and an electrically conductive ring-shaped element 910. The conductive disk 908 is electrically connected to an electrical wire 922. The conductive ring 910 is electrically connected to an electrical wire 924. The wires 922 and 924 are electrically connected to the electrical cable 904. Although the cable 904 is depicted as an integral part of the garment receiver 902, it is contemplated that the cable 904 could have a removable plug connected to the garment receiver 902.

Under the surface 906, the outer component 912 includes a set of annular magnets 916, and a set of circular magnets 918. It is contemplated that a single magnet could replace the magnets 916 and 918. It is further contemplated that although the magnets 916 are depicted as being annular, and the magnets 918 are depicted as being circular, it is not limited as such, and each may be of different shape and be arranged in a different manner.

The inner component 914 includes a set of magnets 920. The garment 1000 is placed between the magnets 918 and the magnets 920, such that the magnets 920 magnetically connect to the magnets 918, to retain the garment receiver 902 on the garment 1000. The inner component 914 is connected to a looping cord 926. The cord 926 is used to hang (for storage) the garment receiver 902 when not connected to the garment 1000 or to attach the inner component 914 with the inner surface of the garment 1000. It is contemplated that the outer component 912 could be integrated with the garment 1000 by sewing, or bonding, the outer component 912 to the outer surface of the garment 1000 and be electrically connected to the battery 1002 via the cable 904 passing between the outer surface and inner surface of the garment 1000, in which case there would be no need for the inner component 914 and the magnets 918.

Figure 12:
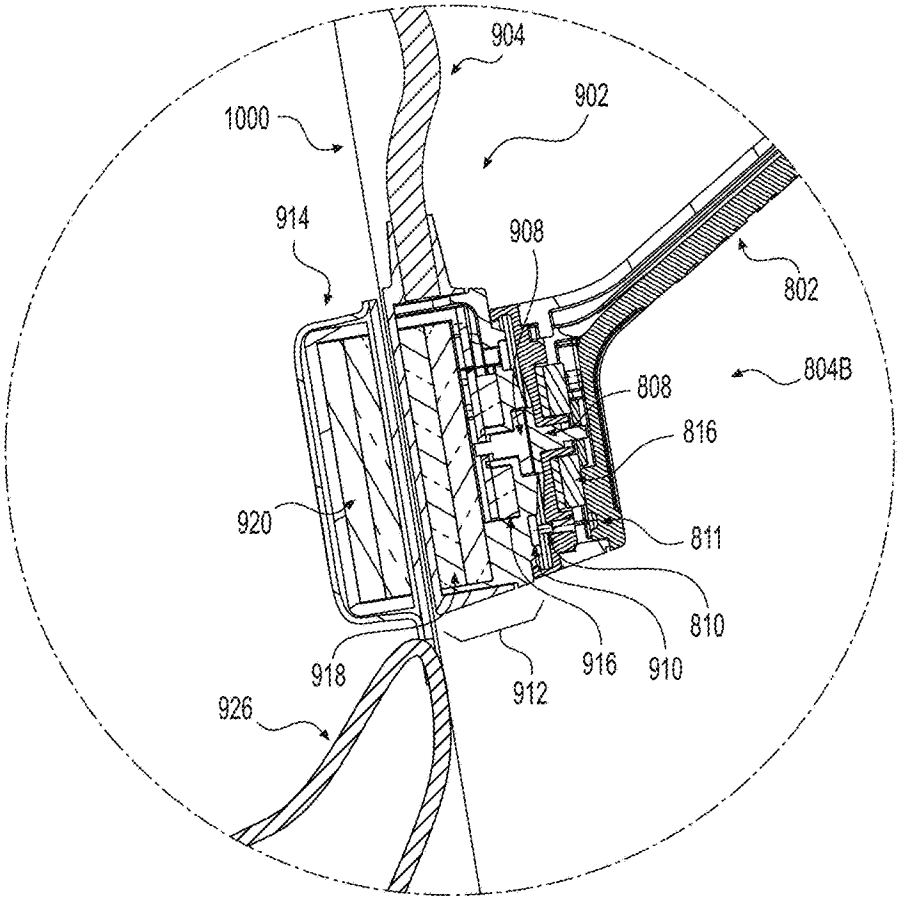
FIG. 12 is a cross-sectional view taken through a vertical longitudinal plane passing through a center of the garment receiver of FIG. 11B connected to the electrical connector assembly of FIG. 8A, as in FIG. 10.

Referring now to FIG. 12, the connection of the connector 804*b* and the garment receiver 902 as shown in FIG. 10, will be described. Since the outer component 912 does not have a recess to receive the lip 812 (as the recess 610 of the receiver 118), the connection between the connector 804*b* and the garment receiver 902 is a selective magnetic connection between the magnets 816 and the magnets 916.

When the connector 804*b* and the outer component 912 are magnetically connected as shown, the conductive disk 808 and conductive disk 908 are in contact with one another, thereby establishing an electrical connection. Similarly, the conductive ring 910 and the spring-loaded pins 810 are in contact with one another, thereby establishing another electrical connection. Since the connectors 804*a*, 804*b* are mirror images of one another, it is contemplated that each of the connectors 804*a*, 804*b* can be connected to either one of the receiver 118 and the garment receiver 902.

It is to be understood that the garment receiver 902 and the electrical connector assembly 800 may form an electrical connection kit for a helmet. As such, the user having a helmet 100 with a receiver 118 may simply install the garment receiver 902 on his/her garment 1000 and connect it to the receiver 118 using the electrical connection assembly 800.

Figure 13A:
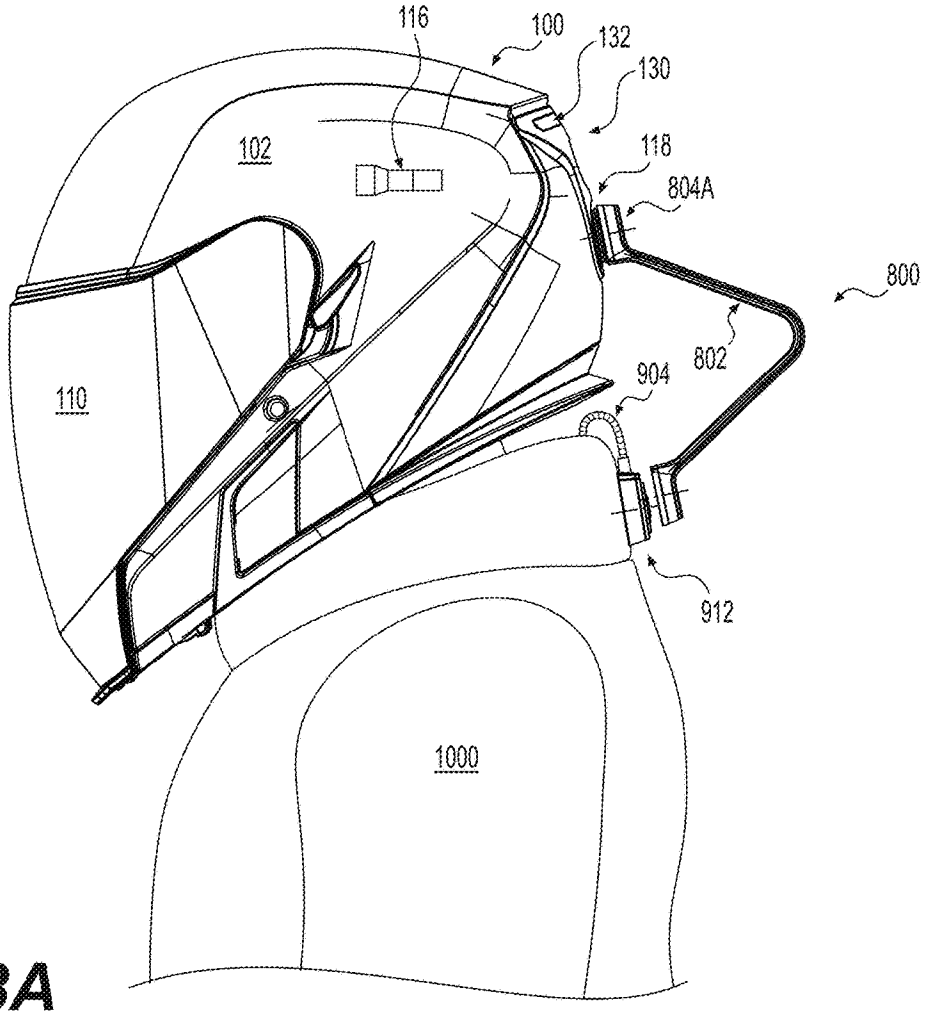
FIG. 13A is a left side elevation view of a person wearing the helmet of FIG. 1 connected to the electrical connector assembly of FIG. 1, and also wearing the garment of FIG. 10, with the electrical connector assembly disconnected from the garment receiver of FIG. 11B.
Figure 13B:
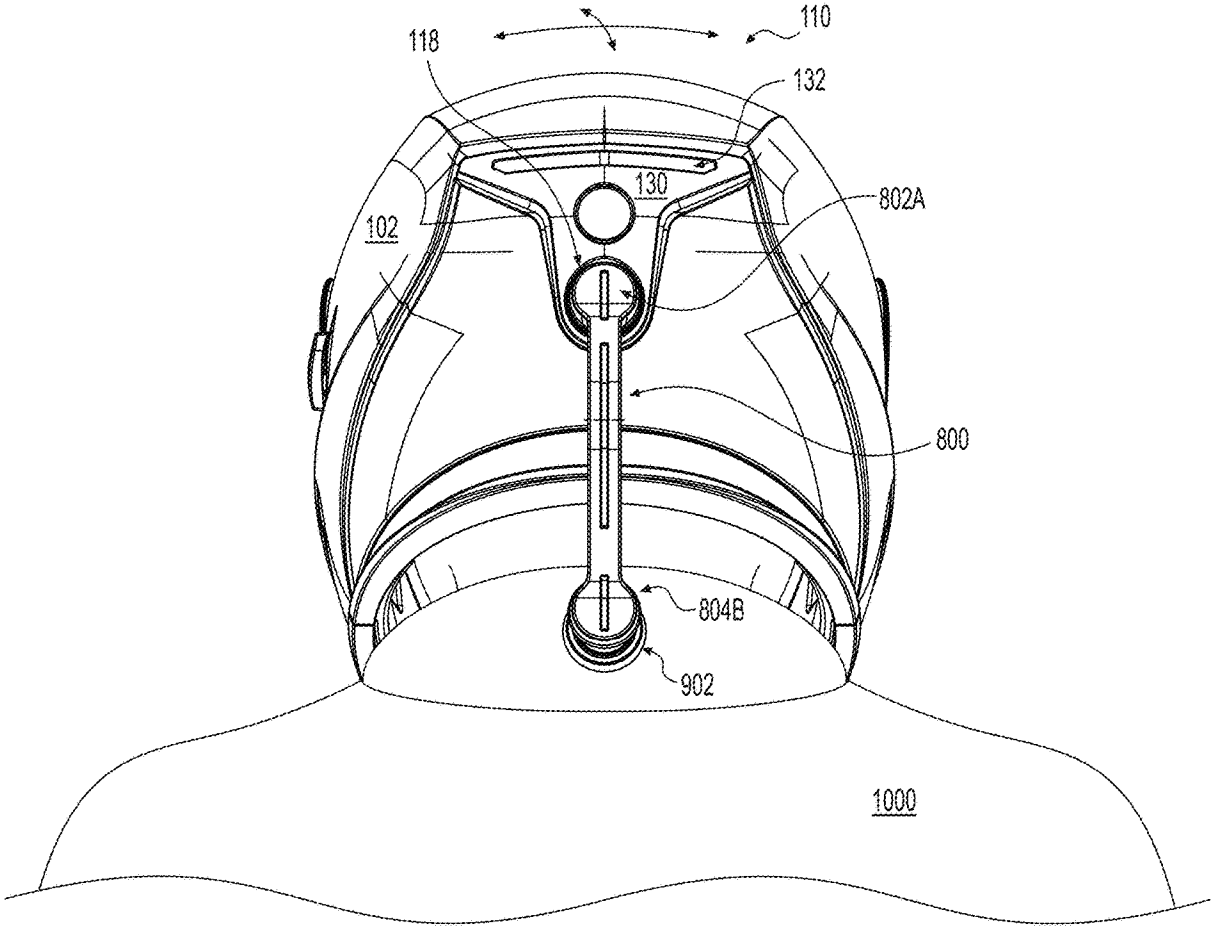
FIG. 13B is rear side elevation view of a person wearing the helmet of FIG. 1 connected to the electrical connector assembly of FIG. 1, and also wearing the garment of FIG. 10, with the electrical connector assembly disconnected from the garment receiver of FIG. 11B.
Figure 13C:
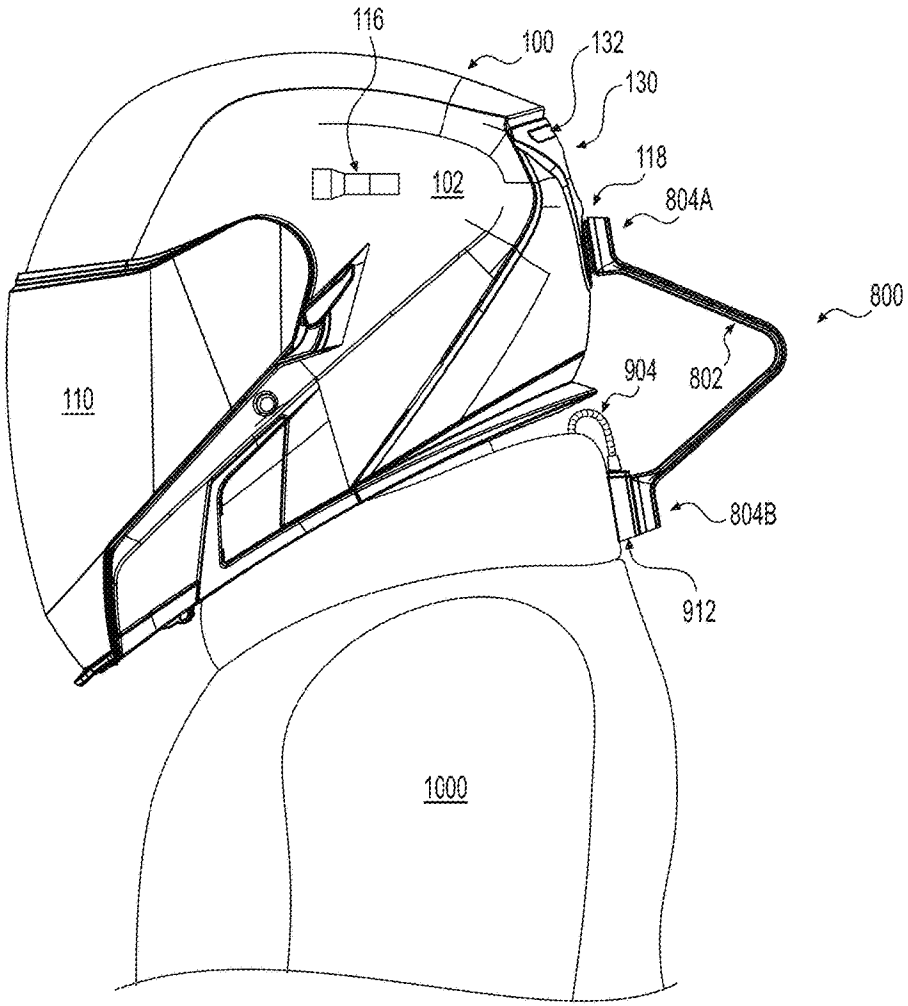
FIG. 13C is a left side elevation view of a person wearing the helmet of FIG. 1 and a garment of FIG. 10 to which the electrical connector assembly of FIG. 1 is connected.

Reference is now made to FIG. 13A to 13C. The wearer wears a helmet 100 with the electrical connector assembly 800 connected to it (i.e. the connector 804*a* is connected to the receiver 118). The wearer also wears a garment 1000 with the garment receiver 902. Initially when the wearer puts on the helmet 100, since the connector 804*b* is not attached to anything, it is freely movable. To connect the connector 804*b* to garment the receiver 902, the wearer simply has to move his/her head until the connector 804*b* is in proximity to the garment receiver 902 (as shown in FIG. 13A, 13B). When the connector 804*b* is in proximity to the garment receiver 902, the magnetic forces of the magnets 916, 816 cause the connector 804*b* to automatically connect, hands-free, to the garment receiver 902 and to establish an electrical connection (as shown in FIG. 13C). In the event where the connector 804*b* is inadvertently disconnected from the garment receiver 902, the wearer simply has to move his/her head until the connector 804*b* is again in proximity to the garment receiver 902, causing the connector 804*b* to automatically re-connect, hands-free, to the garment receiver 902, via the magnetic forces of the magnets 916, 816.

Disconnecting the connector 804*b* from the garment receiver 902 can also be done without direct manual interaction on the electrical connector assembly 800. As stated previously, the connection between the connector 804*a* and the receiver 118 is a mechanical connection (via the recess 610 and the lip 812) as well as a magnetic connection (via the magnets 816, 612) whereas the connection between the connector 804*b* and the garment receiver 902 is only a magnetic connection (via the magnets 816, 916). Due to the types of connection, disconnecting the connector 804*a* from the receiver 118 requires a larger force than the force required to disconnect the connector 804*b* from the garment receiver 902. Thus, when the wearer removes the helmet 100, the helmet 100 is pulled away from the garment 1000, causing the connector 804*b* to disconnect from the garment receiver 902, but without disconnecting the connector 804*a* from the receiver 118.

Figure 14A:
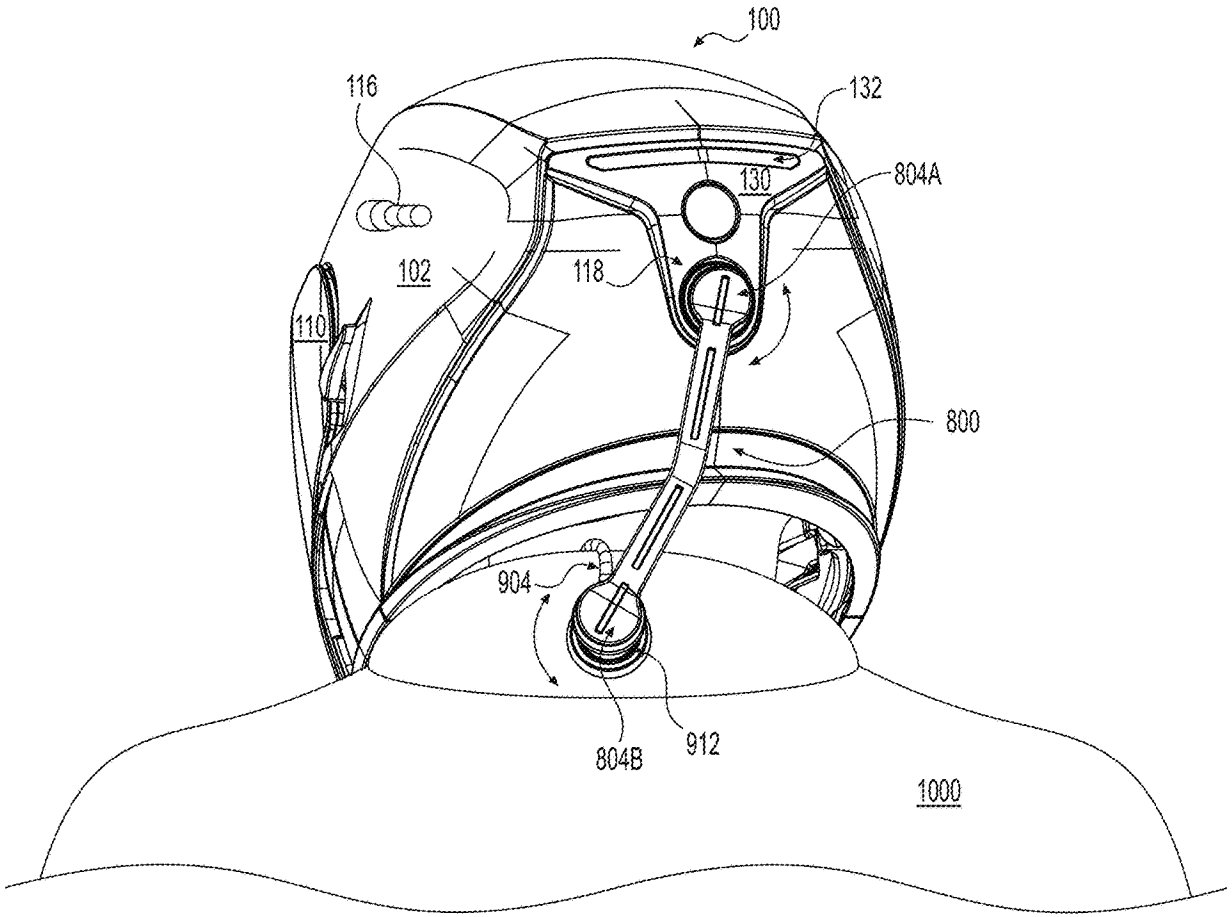
FIG. 14A is a rear elevation view of a person wearing the helmet of FIG. 1 and the garment of FIG. 10 to which the electrical connector assembly of FIG. 1 is connected, with the wearer's head turned slightly left.
Figure 14B:
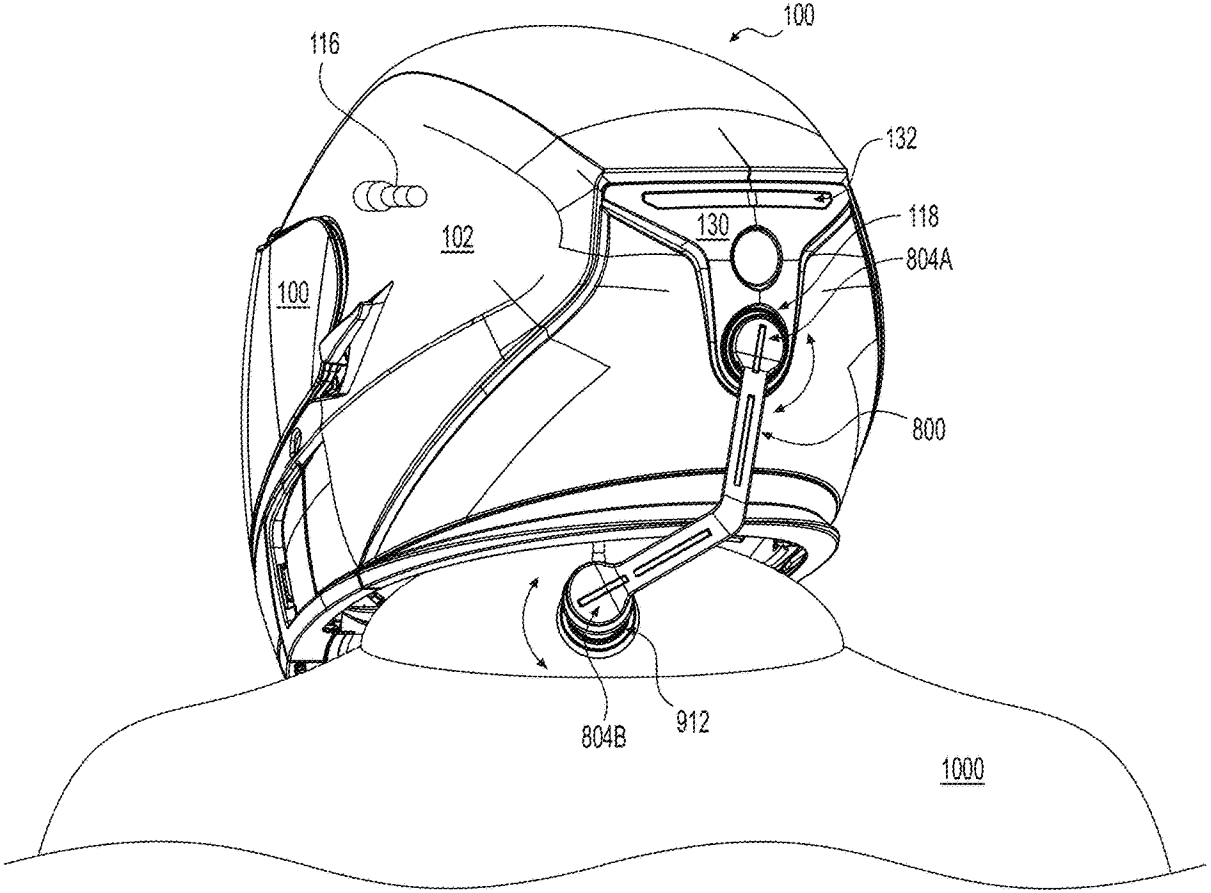
FIG. 14B is a rear elevation view of a person wearing the helmet of FIG. 1 and the garment of FIG. 10 to which the electrical connector assembly of FIG. 1 is connected, with the wearer's head turned further left than in FIG. 14A.
Figure 14C:
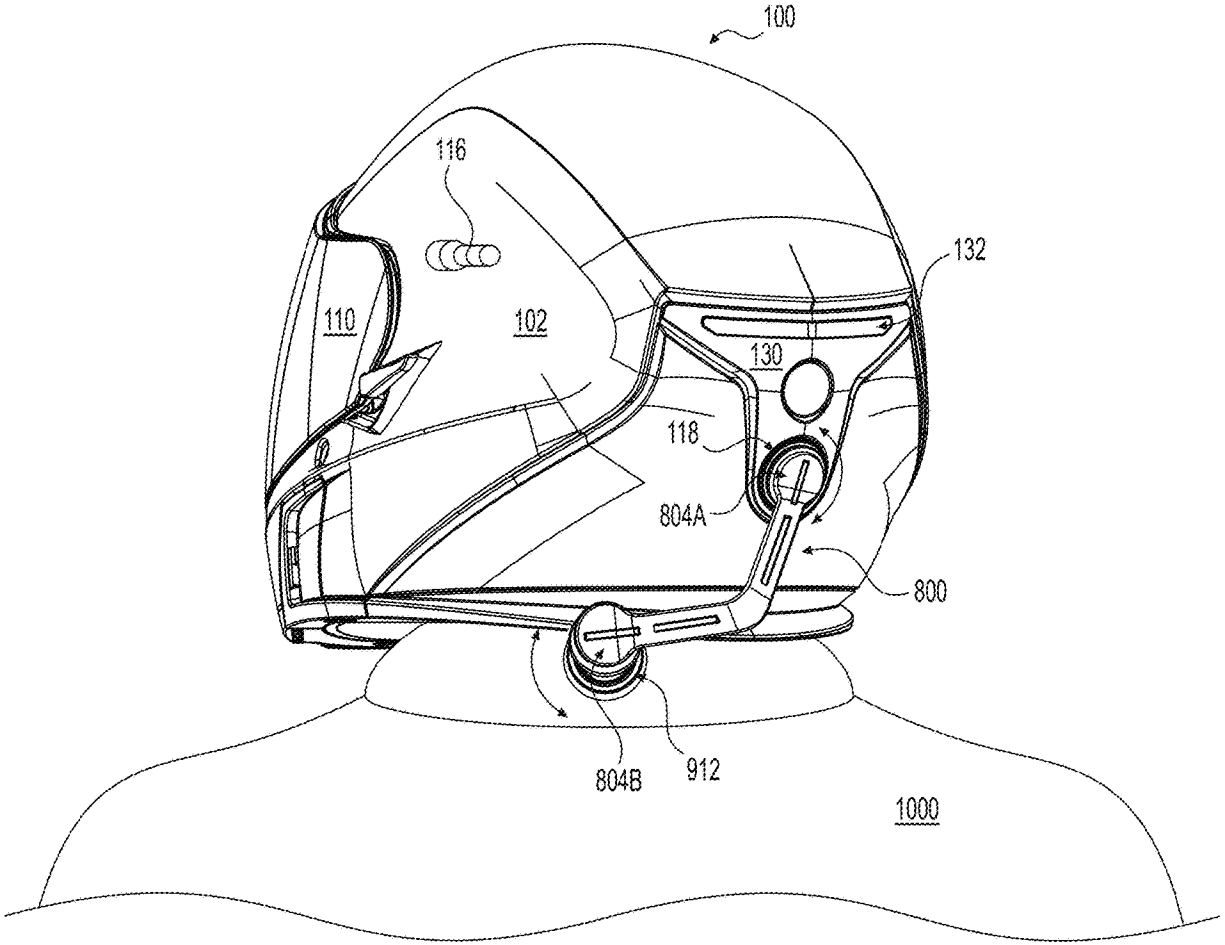
FIG. 14C is a rear elevation view of a person wearing the helmet of FIG. 1 and the garment of FIG. 10 to which the electrical connector assembly of FIG. 1 is connected, with the wearer tilting the head backwards with his head tuned left.

Reference is now made to FIG. 14A to 14C. When the connector 804*a* and the receiver 118 are connected, the spring-loaded pins 810 are biased against the conductive ring 608, thereby ensuring an electrical connection between the connector 804*a* and the receiver 118. The connection remains established even when the connector 804*a* pivots about the receiver 118, as a result of the wearer moving around his head as shown in FIGS. 14A to 14C. Similarly, when the connector 804*b* and the outer component 912 are connected, the spring-loaded pins 810 are biased against the conductive ring 910, thereby ensuring an electrical connection between the connector 804*b* and the outer component 912. The connection remains established even when the connector 804*b* pivots about the outer component 912, as a result of the wearer moving around his head as shown in FIGS. 14A to 14C.

Once the cable 904 is connected to the battery 1002 of the vehicle 1004, an electrical connection is established between the battery 1002 and the heating element 310. More precisely, the electrical current passes between the battery 1002 and the garment receiver 902 via the cable 904. The electrical current then passes between the garment receiver 902 and the connector 804*b* via the contact of the disks 908, 808 and the contact of the conductive ring 910 with the spring loaded pins 810. The electrical current then passes between the connector 804*b* and the connector 804*a* via the wires 814, 815. The electrical current then passes between the connector 804*a* and the receiver 118 via the contact of the disks 806, 606 and the contact of the spring loaded pins 810 with the conductive ring 608. The electrical current then passes between the receiver 118 and the pin assemblies 202 via the wires 404*a*, 404*b*. The electrical current finally passes between the pin assemblies 202 and the heating element 310 via the visor electrical contacts 320 and the wires 318, 319.

Turning now to FIGS. 15 to 23, there is depicted a helmet 1500 having a visor 2000 which are different implementations from, respectively, the helmet 100 and the visor 110 described above. For simplicity, elements of the helmet 1500 and the visor 2000 that are similar to those of the helmet 100 and the visor 110 have been labelled with the same reference numerals and will not be described again in detail herein.

Figure 15:
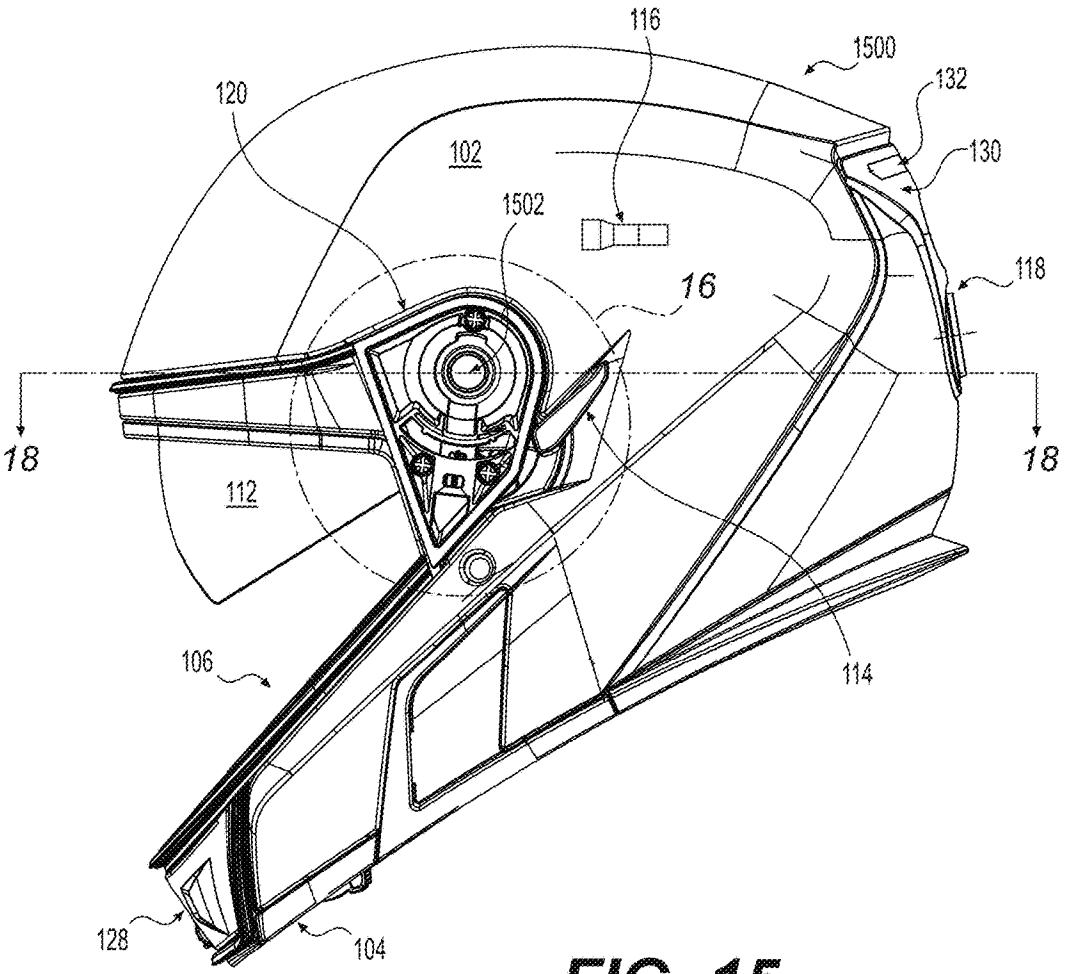
FIG. 15 is a left side elevation view of the helmet of FIG. 1 with a different helmet electrical contact without the electrical connector assembly, and the visor.
Figure 16:
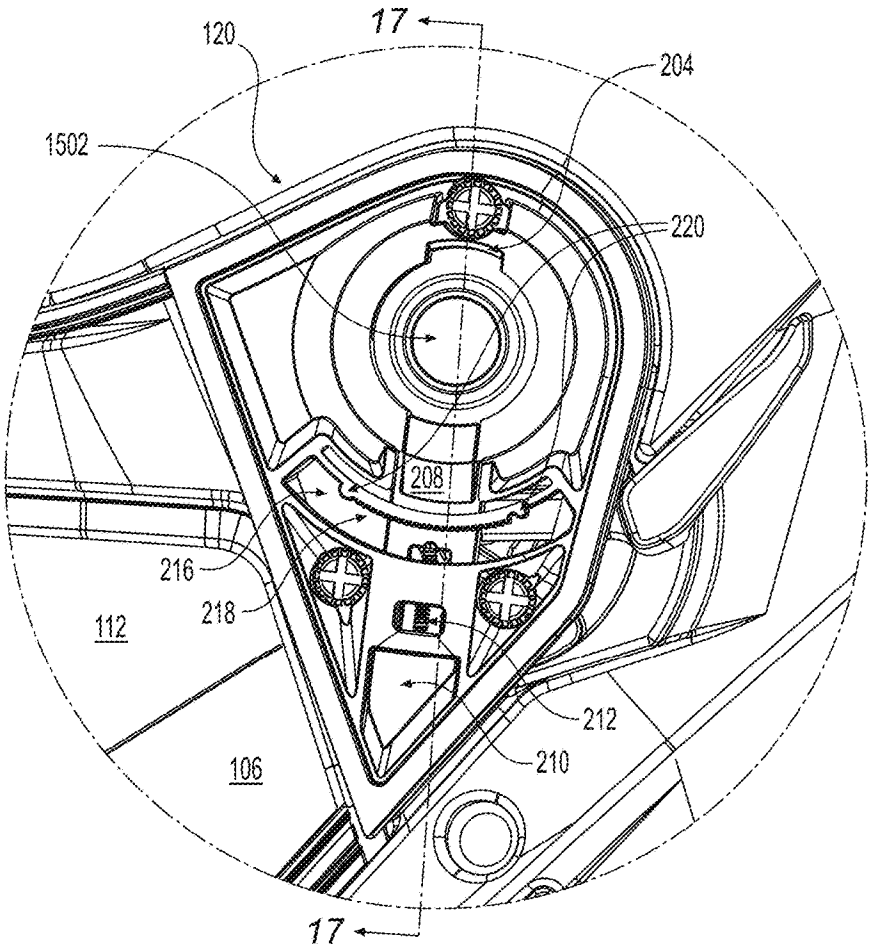
FIG. 16 is a magnified view of portion 16 of FIG. 15.
Figure 17:
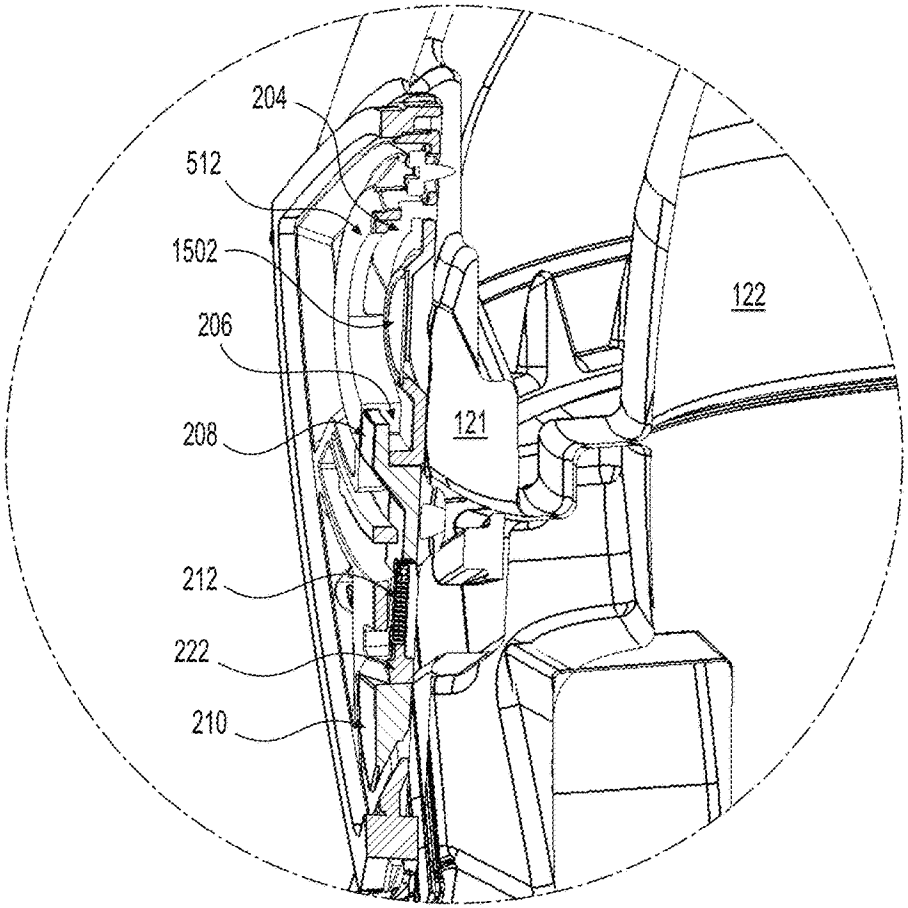
FIG. 17 is a cross-sectional view of the helmet electrical contact of the visor mounting portion, and neighbouring portion thereof, of the helmet of FIG. 15 taken through line 17-17 of FIG. 16.

As can be seen for the left side in FIGS. 15 to 17, when the visor 2000 is detached from the helmet shell 102, two visor mounting portions 120, one on each side of the helmet shell 102, are exposed. The two visor mounting portions 120 mount the visor 2000 to the helmet shell 102. The visor mounting portion 120 includes a helmet electrical contact 1502 adapted to be connected to the power source via the receiver 118. In this particular implementation, each of the helmet electrical contacts 1502 is in the form of a metal plate 1502.

As can be seen in FIG. 17, the metal plate 1502 is moulded in the visor mounting portion 120. It is contemplated that the metal plate 1502 could be connected to the visor mounting portion 120 by other means such as adhesive, or by one or more mechanical fastener, and the like.

Figure 18:
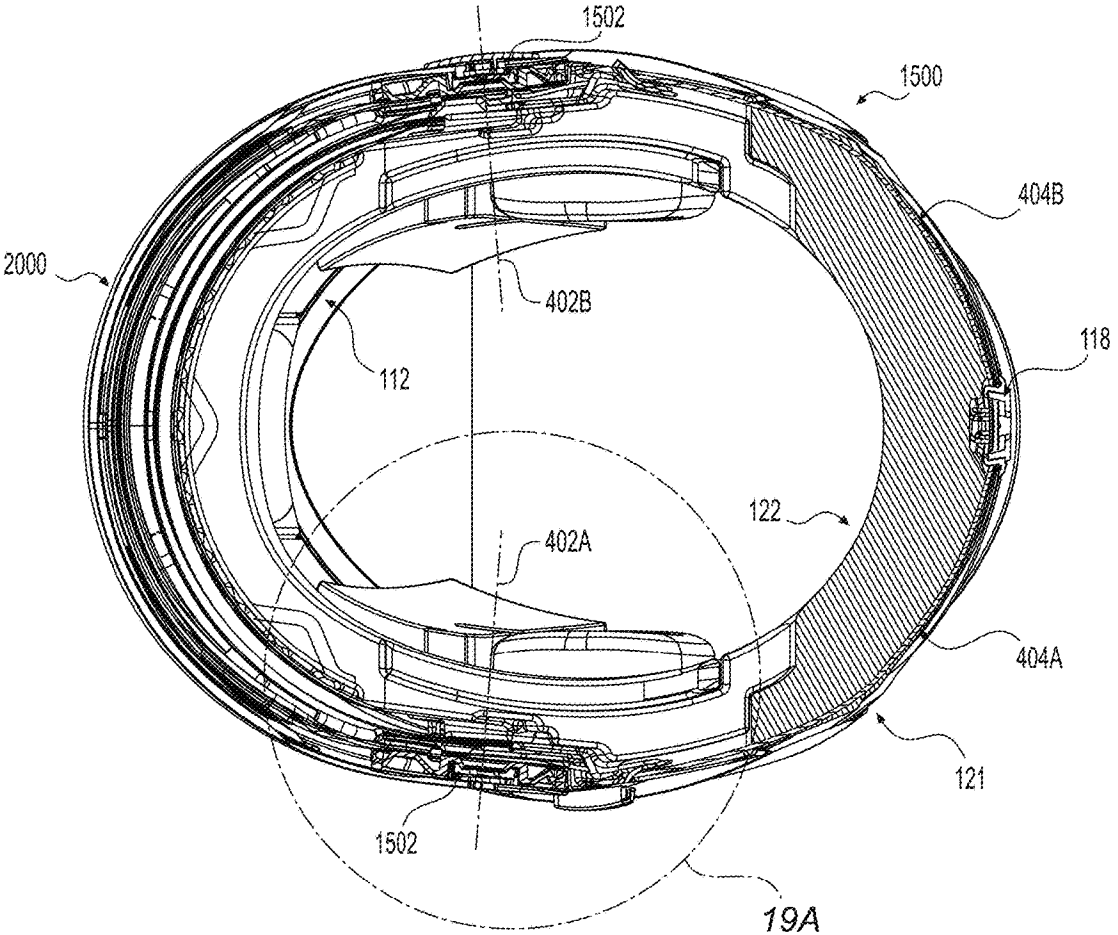
FIG. 18 is a cross-sectional view of the helmet of FIG. 15 taken through line 18-18, with the visor of FIG. 21.
Figure 19A:
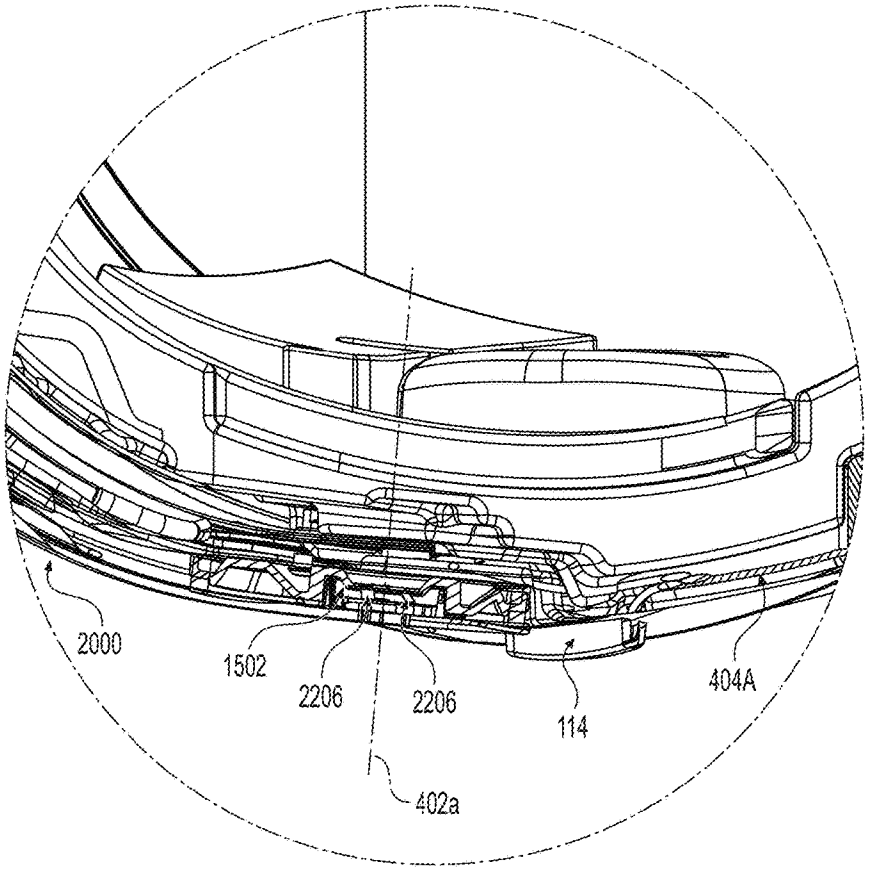
FIG. 19A is a magnified view of portion 19A of FIG. 18.
Figure 19B:
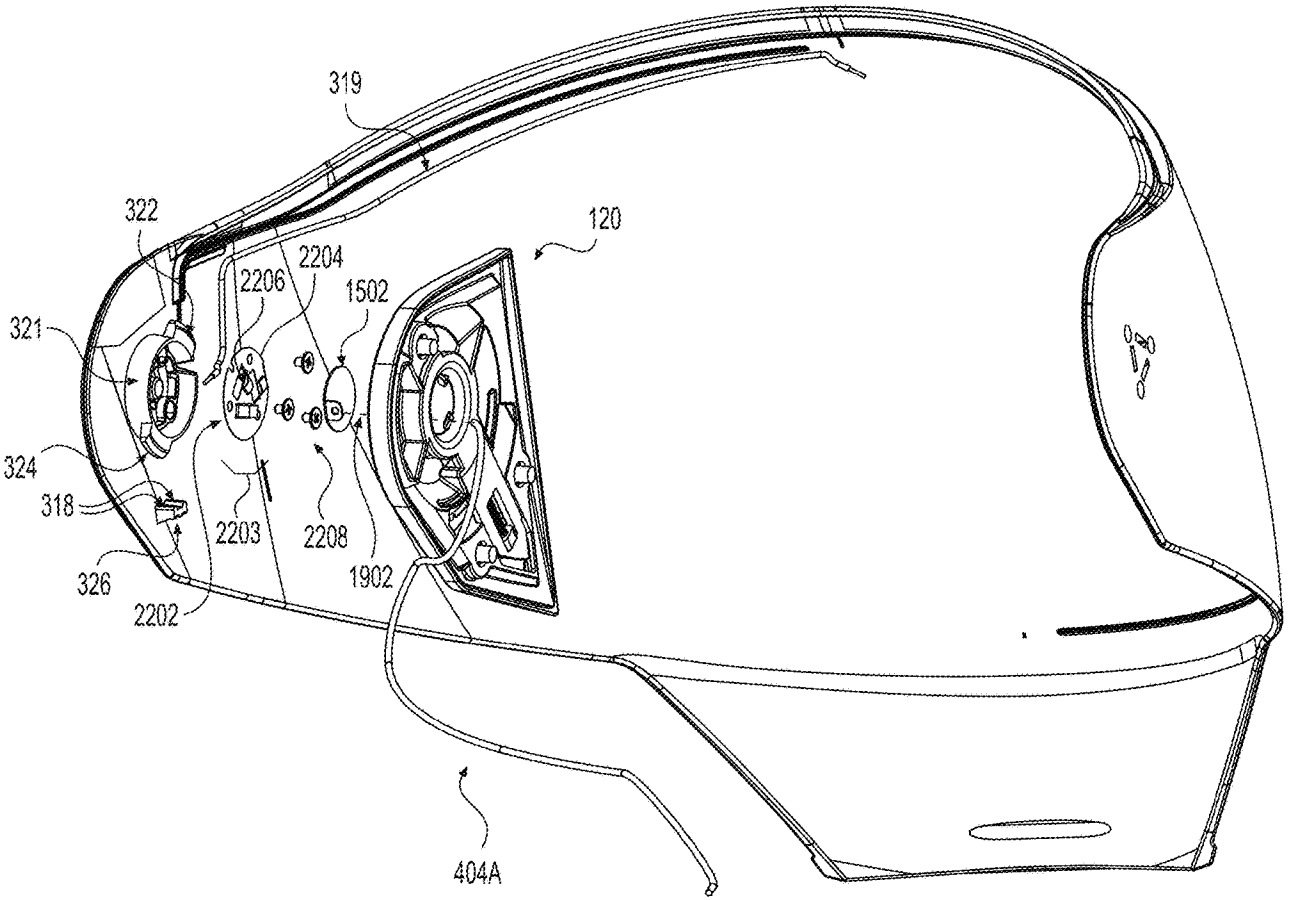
FIG. 19B is a perspective view taken from a rear right side of the visor of FIG. 20, with the left visor electrical contact and the left helmet electrical contact of FIG. 15 shown exploded.

As illustrated in FIGS. 18 to 19B, the left metal plate 1502 is connected to the wire 404*a* (as shown by a dotted line 1902), and the right metal plate 1502 is connected to the wire 404*b*.

Figure 20:
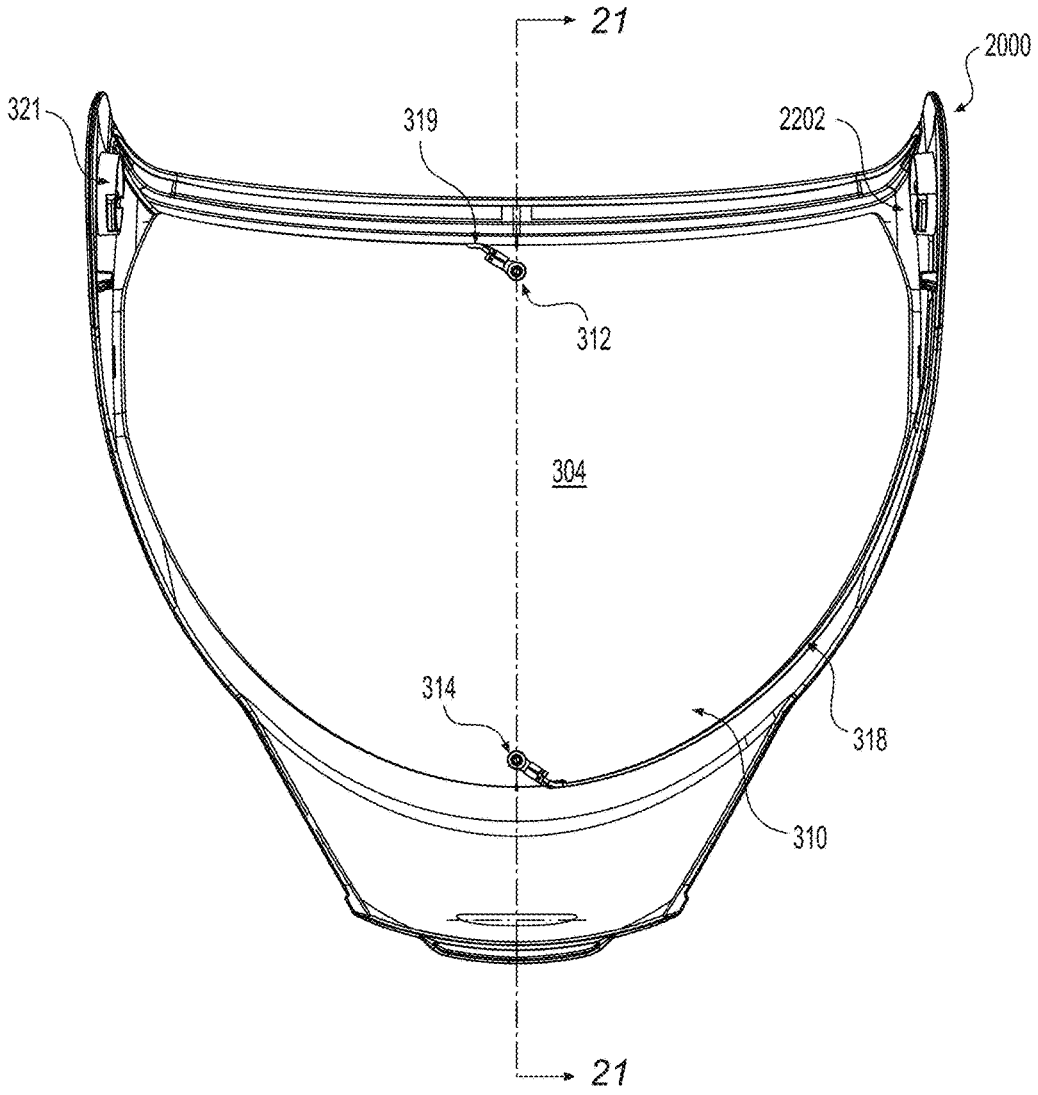
FIG. 20 is a rear elevation view of the visor of FIG. 1 with a different visor electrical contact.
Figure 21:
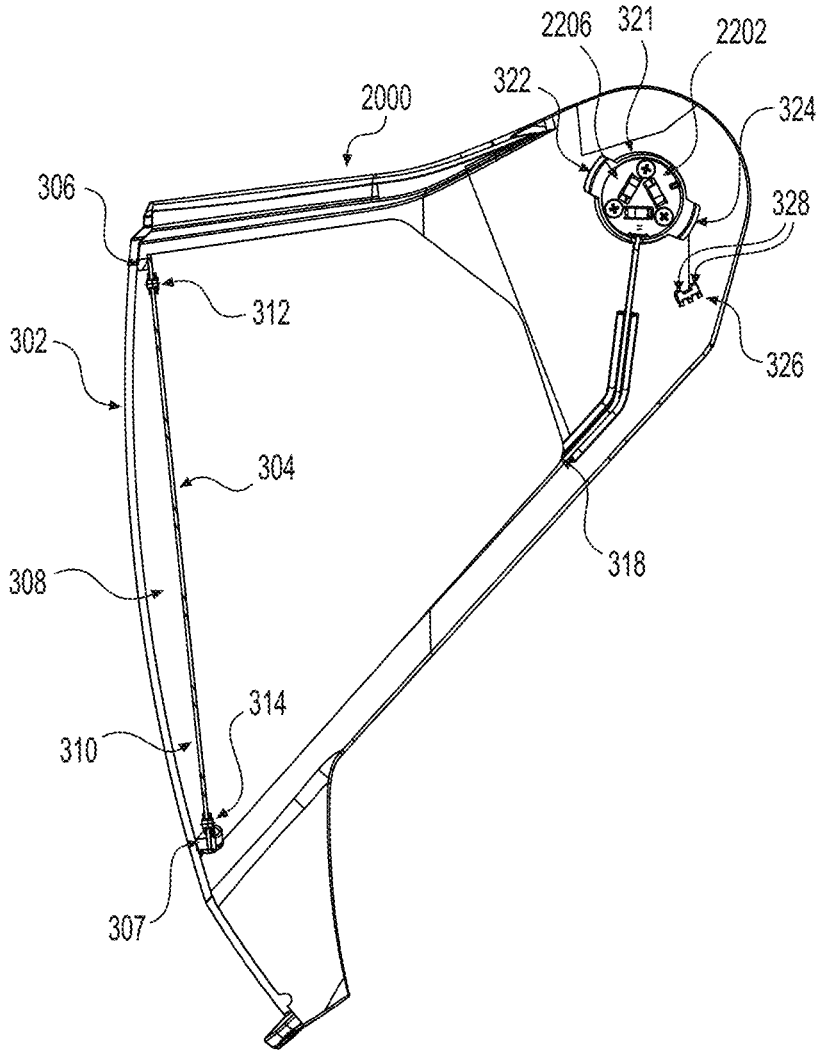
FIG. 21 is a cross-sectional view of the visor of FIG. 20 taken through line 21-21 of FIG. 20.
Figure 22:
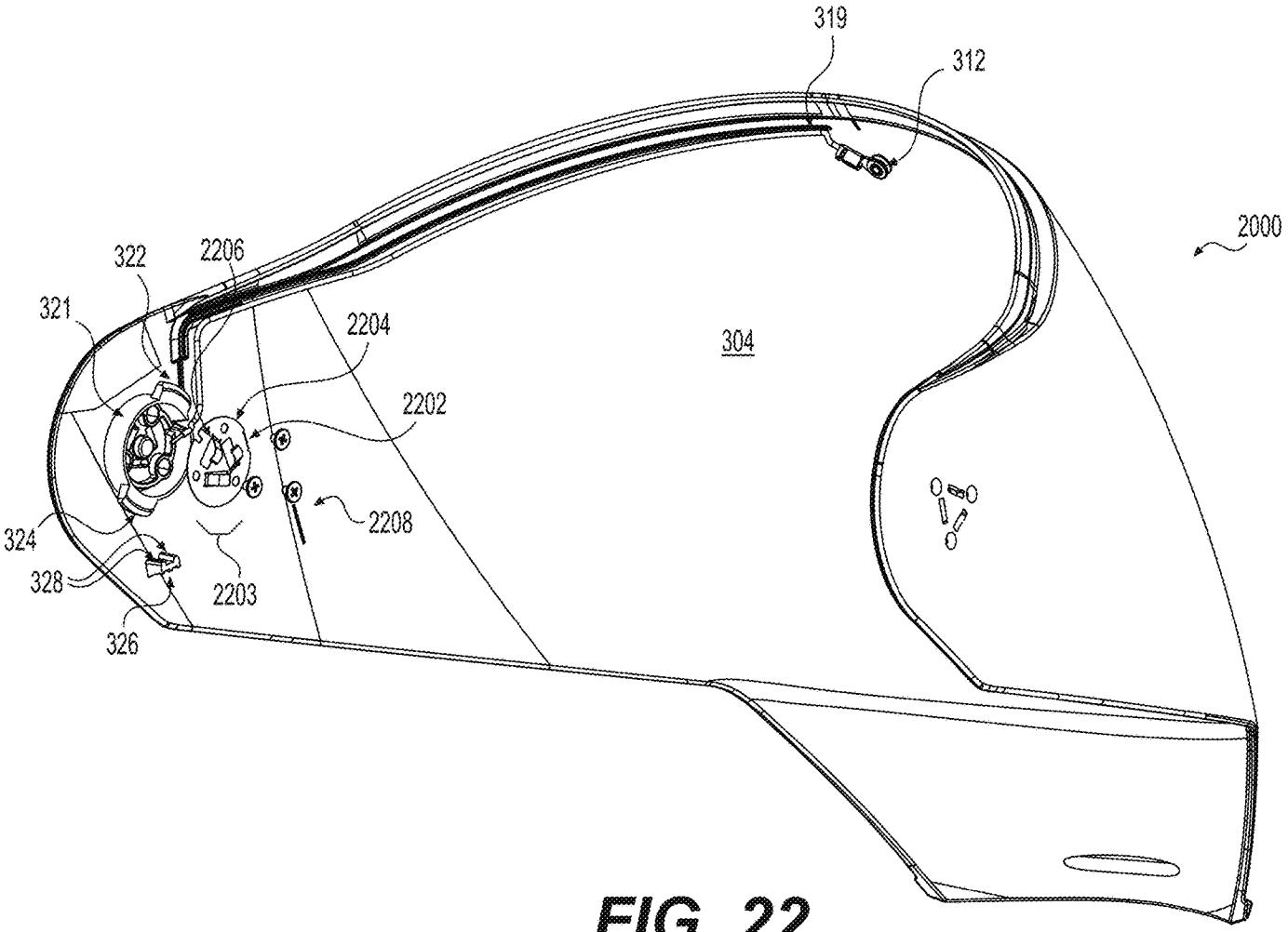
FIG. 22 is a perspective view taken from a rear right side of the visor of FIG. 20 with the left visor electrical contact shown exploded.

The visor 2000 is removed from the helmet shell 102 in FIGS. 20 to 22. The lower connector 314 is connected to a right visor electrical contact 2202 via the electrical wire 318, while the upper connector 312 is connected to a left visor electrical contact 2202 on the left side of the visor 2000 via the electric wire 319. The left visor electric contact 2202 is generally a mirror image of the right visor electrical contact 2202 illustrated in FIG. 21.

In this particular implementation shown in FIG. 22, each of the visor electrical contacts 2202 is made of three conductive legs 2206. The three conductive legs 2206 are part of a biasing conductor assembly 2203. The biasing conductor assembly 2203 comprises a conductive plate 2204, and the three conductive legs 2206. In the present implementation, the three conductive legs 2206 are integrally formed with the plate 2204. It is contemplated that each visor electrical contact 2202 could have more or less than three conductive legs 2206. In the present implementation, the legs 2206 are arranged in a triangular formation, but other arrangements are contemplated. The biasing conductor assembly 2203 is received and attached to its receptacle 321 via three screws 2208. It is contemplated that fasteners other than screws 2208 could be used, and/or that more or less than three fasteners could be used.

With reference to FIGS. 16, 17 and 21, the attachment of the visor 2000 to the helmet shell 102 will be explained. As stated previously, each receptacle 321 has the forward tab 322 and the rearward tab 324 for each side of the visor 2000, as shown in FIG. 21. In order for the visor electrical contact 2202 to be attached on the helmet shell 102 via the corresponding visor mounting portions 120 (see FIG. 16), the forward tabs 322 (see FIG. 21) are aligned with the upper chambers 204 (see FIG. 16), and the rearward tabs 324 (see FIG. 21) are aligned with the lower chambers 206 over the lips 208 (see FIG. 16). Once aligned, the user disengages the lips 208 (see FIG. 16) by pulling the levers 210 (see FIG. 16), thus exposing the lower chambers 206 (see FIG. 16), and pushes the sides of the visor 2000 against the visor mounting portions 120 (see FIG. 16). Once the rearward tabs 324 (see FIG. 21) are received in the lower chambers 206 (see FIG. 16), the user releases the levers 210 (see FIG. 16) causing the springs 212 (see FIG. 16) to bias the lips 208 (see FIG. 16) back to their initial positions, covering the lower chambers 206 (see FIG. 16) hosting the rearward tabs 324 (see FIG. 21), thereby preventing the rearward tabs 324 from being removed from the visor mounting portions 120 (see. FIG. 16). While the visor 2000 pivots about the helmet shell 102, the forward tabs 322 and the rearward tabs 324 (see FIG. 21) are held behind the flanges 512 (see FIG. 17). If the user desires to remove the visor 2000, the user must align the forward tabs 322 (see FIG. 21) with the upper chambers 204 (see FIG. 16), and the rearward tabs 324 (see FIG. 21) with the lower chambers 206 (see FIG. 16). The user then disengages the lips 208 simply by pulling the levers 210 (see FIG. 16), thereby allowing the visor 2000 to be removed from the visor mounting portions 120.

Each side of the visor 2000 further has the pin 326 (see FIG. 21) adapted to be inserted within its corresponding arcuate aperture 216 when mounted on the visor mounting portion 120 (see FIG. 16). As described above, the pin 326 has two teeth 328 (see FIG. 21), which engage with the large teeth 220 or the set of small teeth 218 (see FIG. 16) as the visor 2000 is pivotally moved relative to the helmet shell 102. Consequently, the visor 2000 will only pivot between a plurality of positions when a certain amount of force is applied to the visor 2000, such as when the visor 2000 is pushed or pulled by the wearer.

Figure 23:
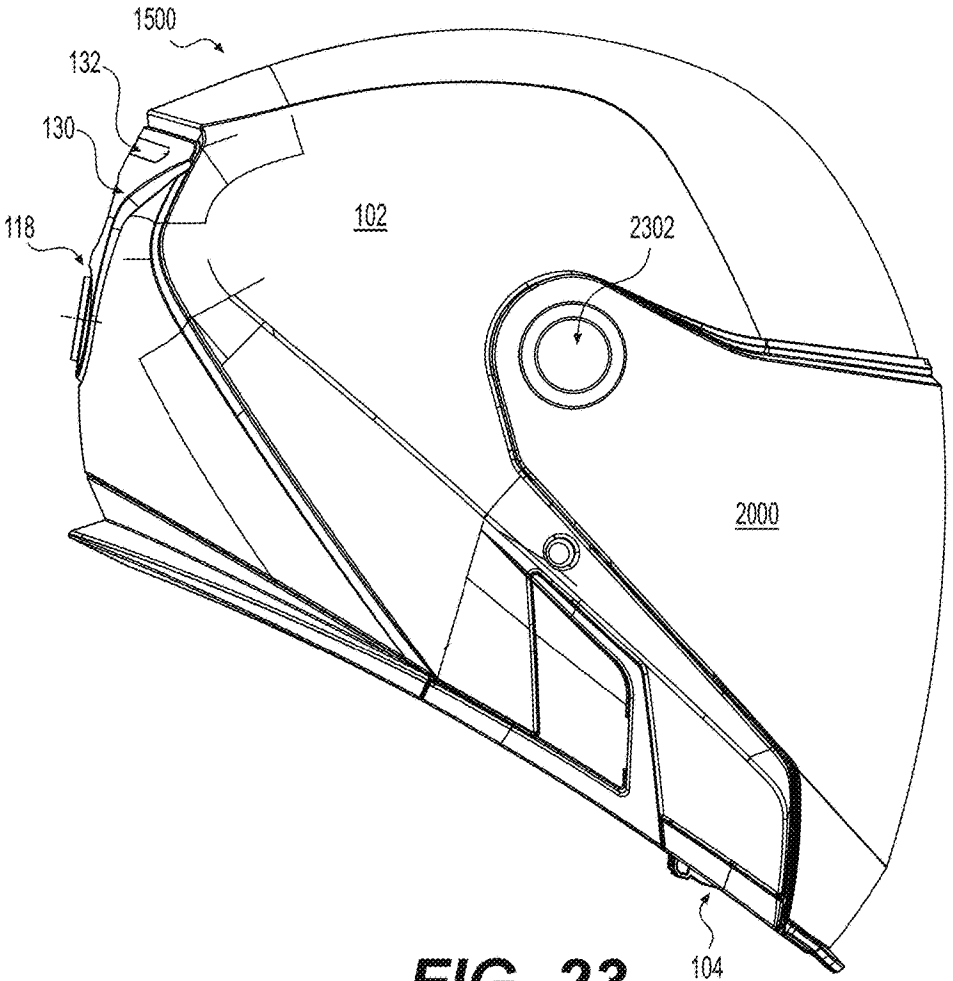
FIG. 23 is a right side elevation view of the helmet of FIG. 15 with the visor of FIG. 20 attached, thereto in a lowered position.

With reference to the right side of the helmet 1500 seen in FIG. 23, a cover 2302 is attached on the right side of the outer visor portion 302 about the right biasing conductor assembly 2202. The left side of the outer visor portion 302 has a similar cover (not shown).

Reference is now made to the left side of the helmet 1500 seen in FIGS. 18 to 19B. As shown in FIG. 19B, the biasing conductor assembly 2202 is aligned with the metal plate 1502 when the visor 2000 is mounted to the visor mounting portion 120. Thus, when the visor 2000 is attached to the visor mounting portion 120, the legs 2206 of the biasing conductor assembly 2202 are biased against the metal plate 1502, as seen in FIGS. 18 and 19A. As such, an electrical connection between the metal plate 1502 and the biasing conductor assembly 2202 is maintained as the visor 2000 is pivotally moved. The right side of the helmet 1500 is a mirror image of the left side.

Turning now to FIGS. 24 to 31, there is depicted a receiver 2502 and an electrical connector assembly 2802 which are different implementations from the receiver 118 and the electrical connector assembly 800 described above. For simplicity, elements of the receiver 2502 and the electrical connector assembly 2802 that are similar to those of the receiver 118 and the electrical connector assembly 800 have been labelled with the same reference numerals and will not be described again in detail herein.

Figure 24:
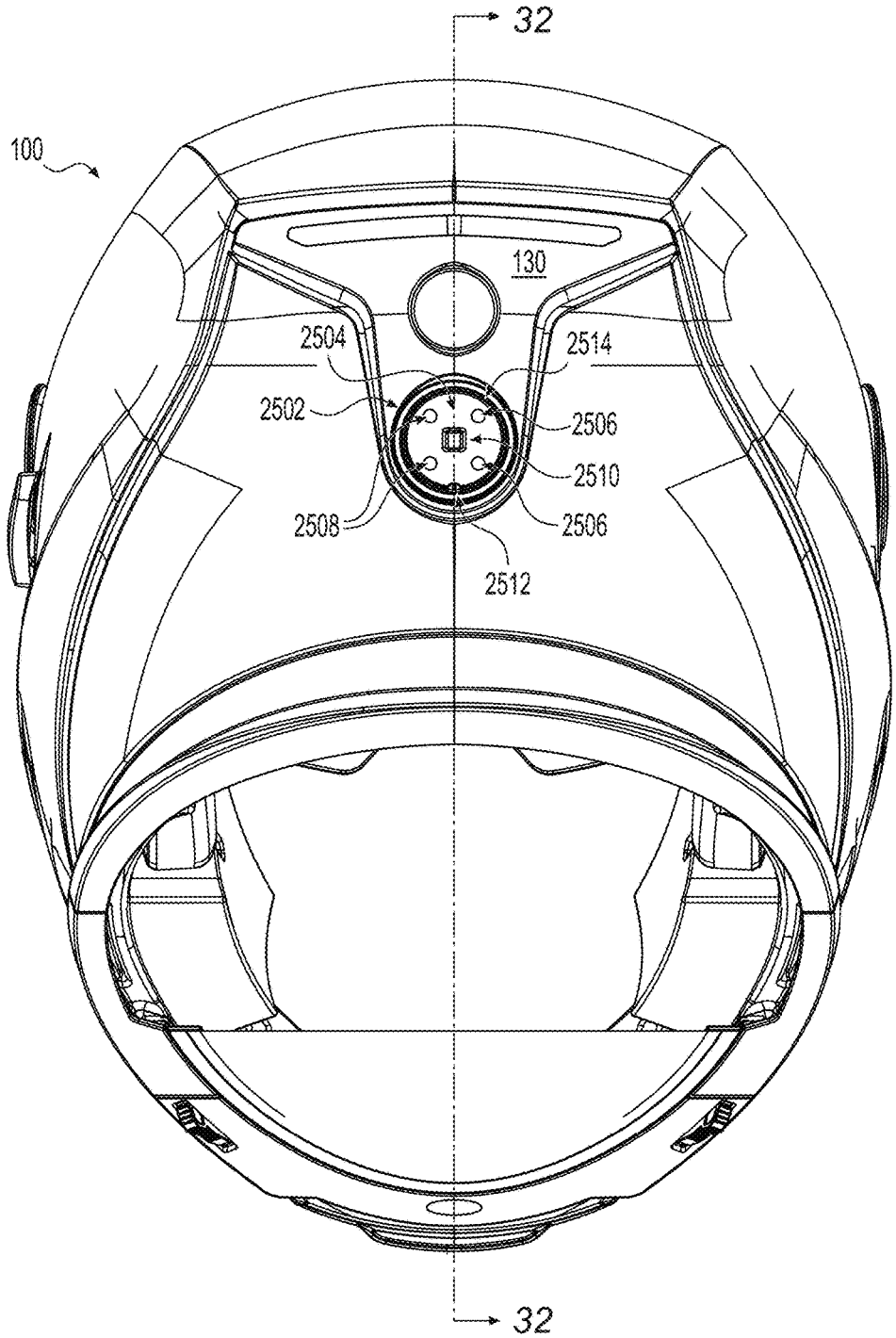
FIG. 24 is a rear elevation view of the helmet of FIG. 2A with a different receiver and without the electrical connector assembly.
Figure 25:
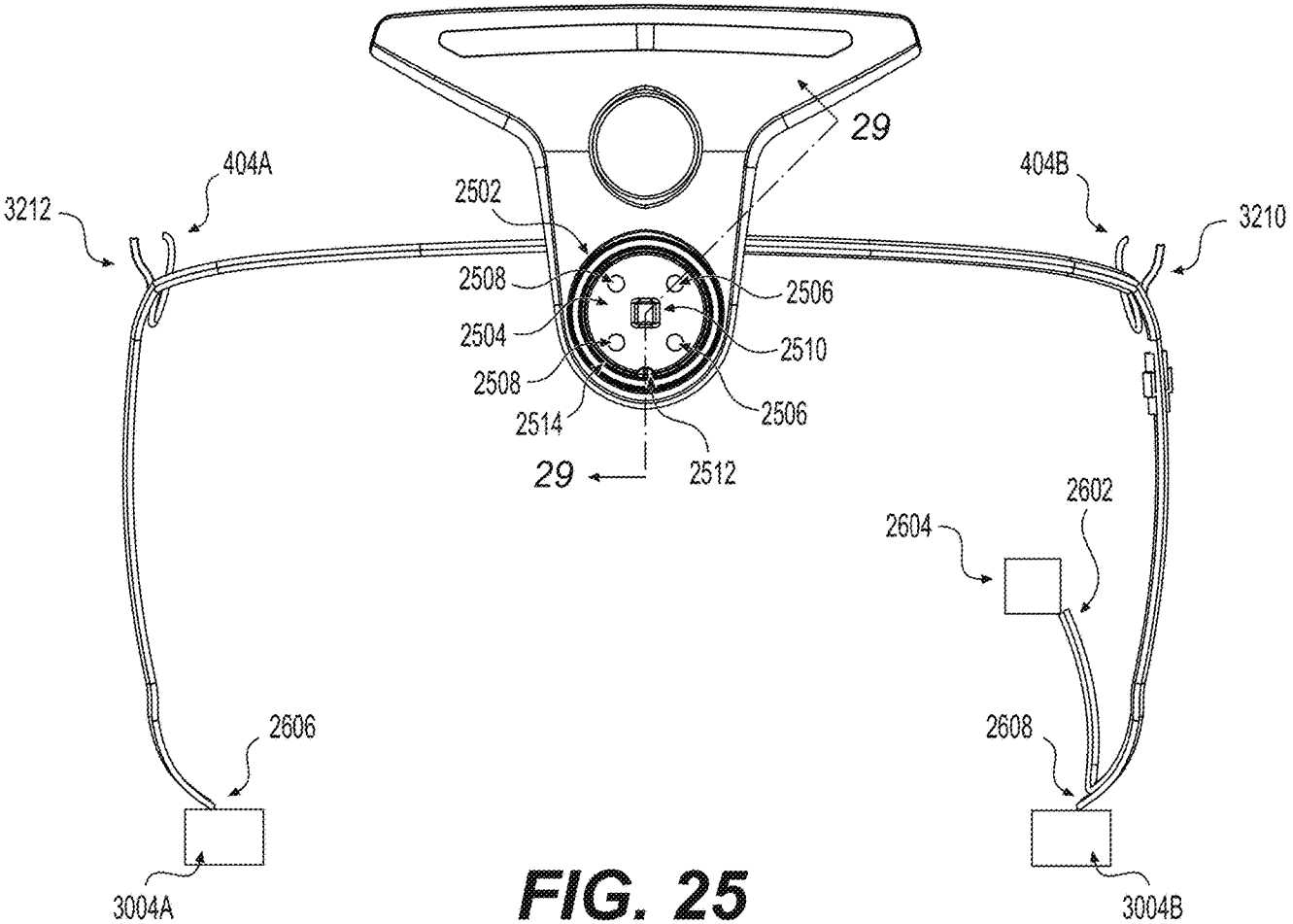
FIG. 25 is a rear elevation view of a rear light frame of the helmet of FIG. 24 without the inner and outer helmet shell.
Figure 26:
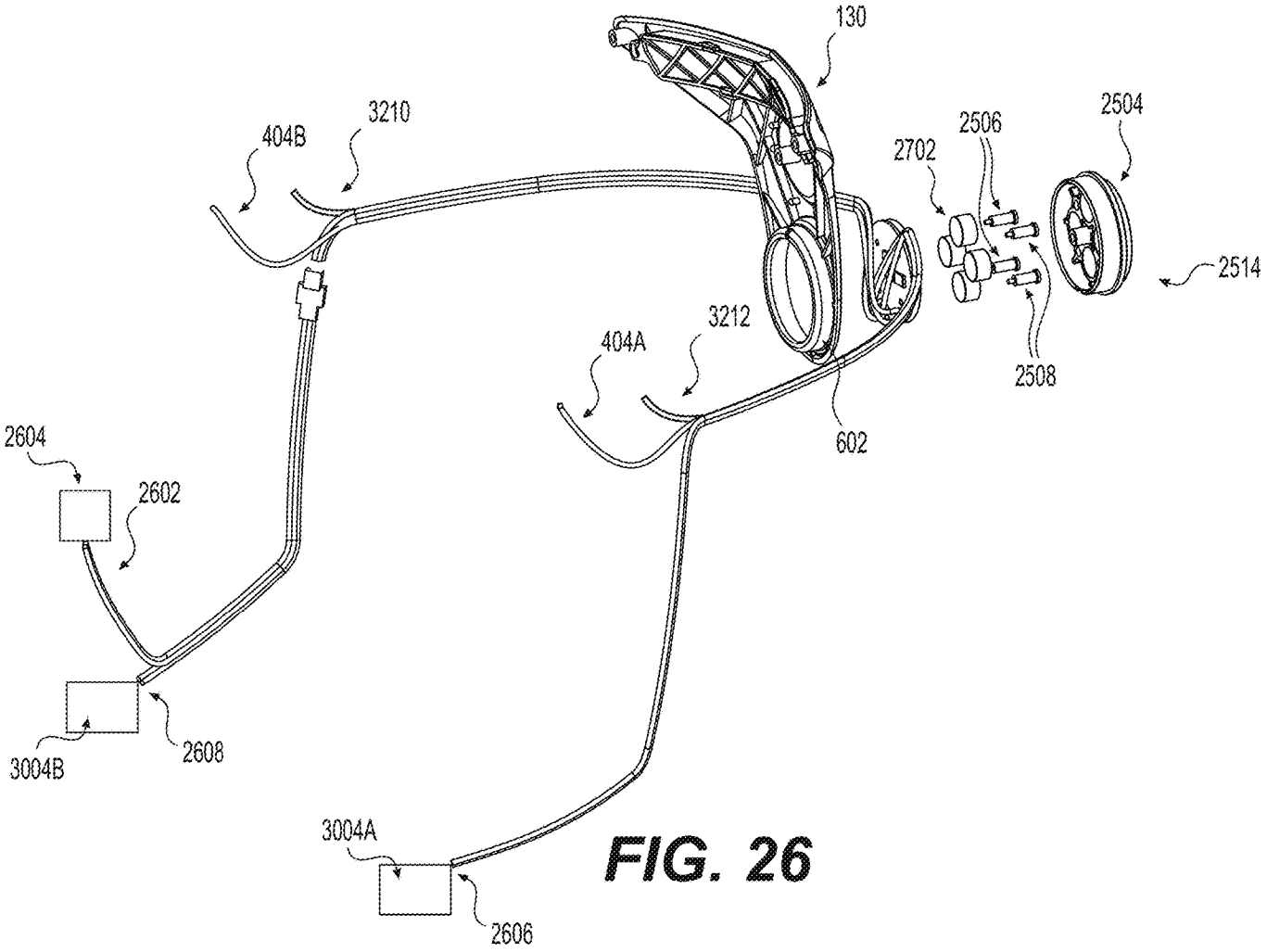
FIG. 26 is an exploded view of the receiver shown in FIGS. 24 and 25.

As seen in FIGS. 24 to 26, the receiver 2502 is attached to the helmet shell 102 via the rear light frame 130. More precisely, a portion of the receiver 2502 is placed in a cavity formed by an opening of the rear light frame 130 and the recess 602 formed by the inner helmet shell 122. The receiver 2502 is fixed to the rear light frame 130 while having an exposed connection surface 2504 at the back of the helmet 100. It is contemplated that the receiver 2502 could be fixed in different manners, for example by an adhesive, by one or more mechanical fasteners, and the like.

On the surface 2504, the receiver 2502 has two right conductive elements 2506 that are connected to the electrical wire 404*b*, and two left conductive elements 2508 that are connected to the electrical wire 404*a*. Although depicted as having two right conductive elements 2506 and two left conductive elements 2508 organized in a square pattern about the surface 2504, it is not limited as such, and it is contemplated that any number of right and left conductive elements 2506, 2508 may be used in different patterns. The surface 2504 also has a central recess 2510 extending inwardly in relation to the surface 2504 and a lower recess 2512 at the bottom of the surface 2504. The surface 2504 also has an arcuate rib 2514, extending axially outwardly in relation to the surface 2504 from both sides of the lower recess 2512. The receiver 2502 further includes four cylindrical magnets 2702 under the surface 2504. Although the magnets 2702 are depicted as cylindrical magnets, it is not limitative. As such, more or less than four cylindrical magnets may be utilized. Although the magnets 2702 are arranged in a square pattern rotated 45 degrees from the square pattern formed by the right and left conductive elements 2506, 2508, other patterns are contemplated for the magnets 2702.

Figure 27:
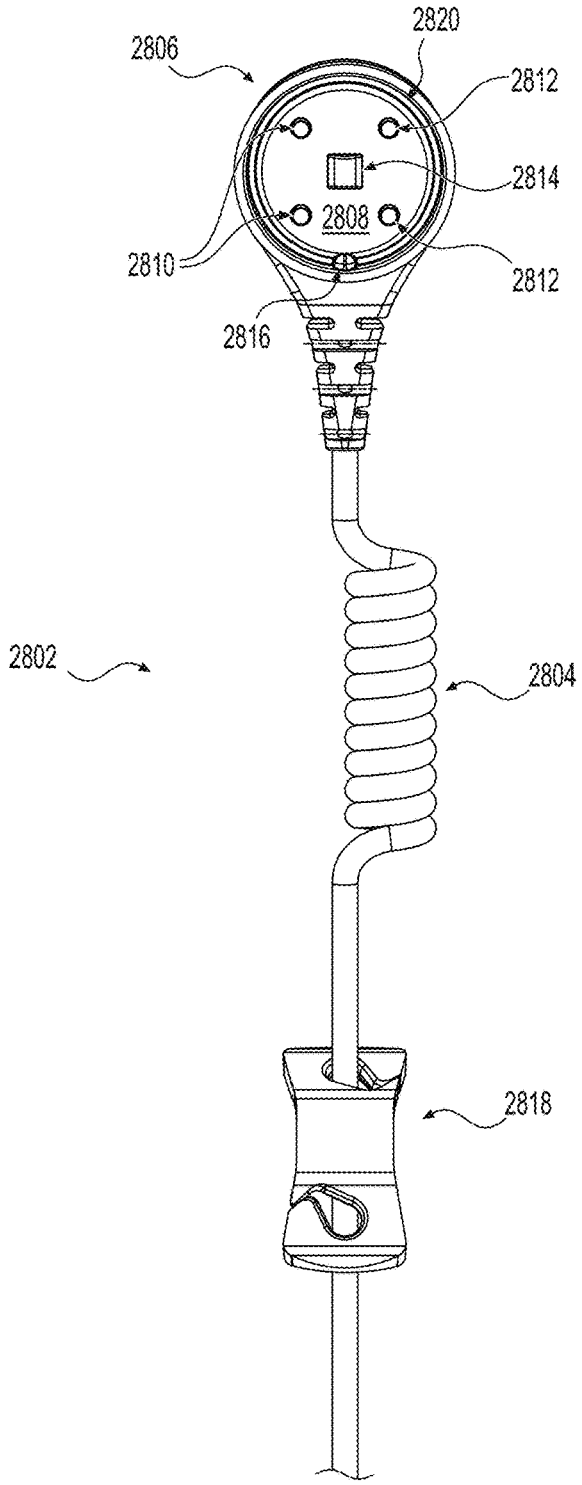
FIG. 27 is a partial front elevation view of a different electrical connector assembly.
Figure 28:
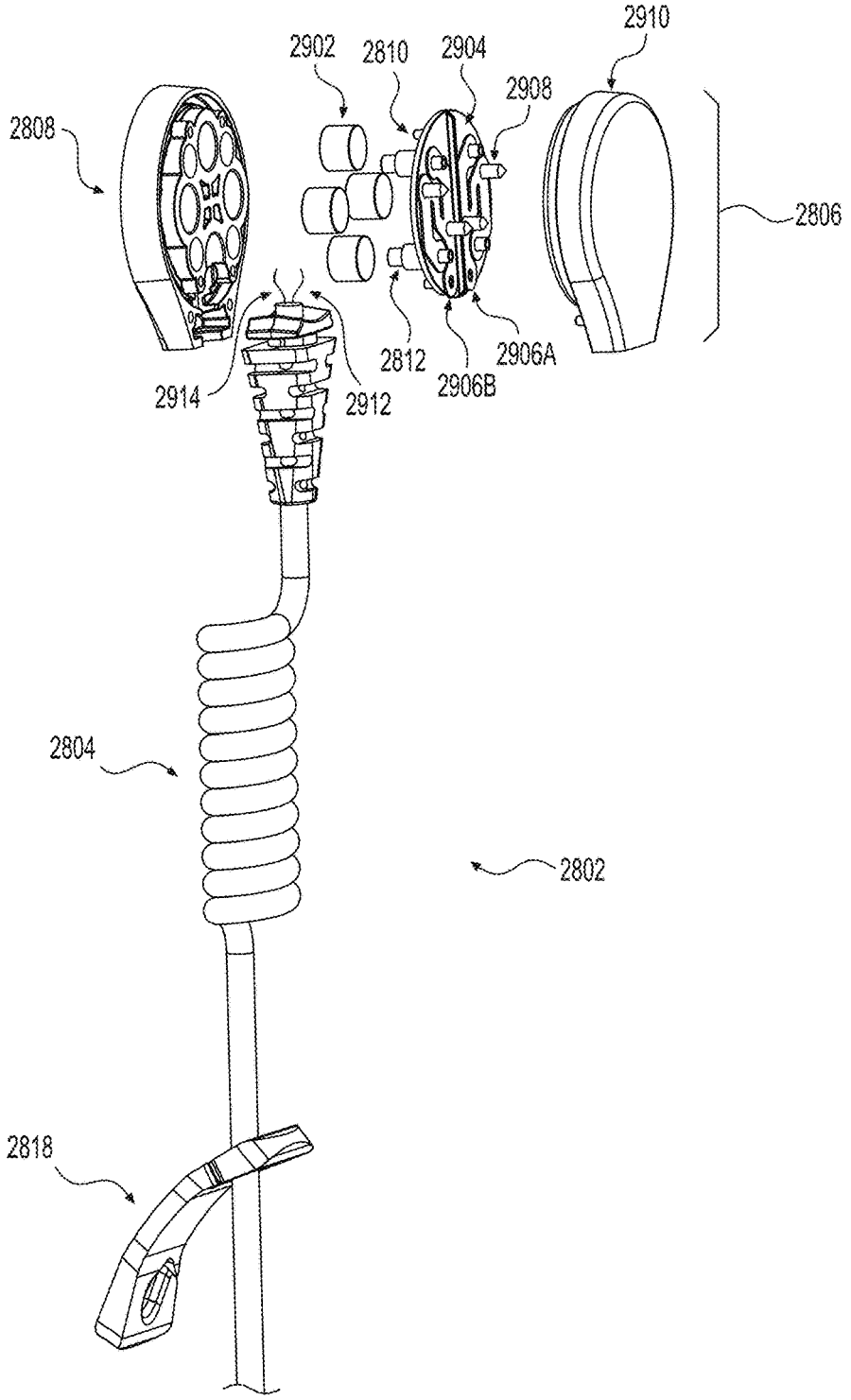
FIG. 28 is an exploded view of the connector shown in FIG. 27.
Figure 30A:
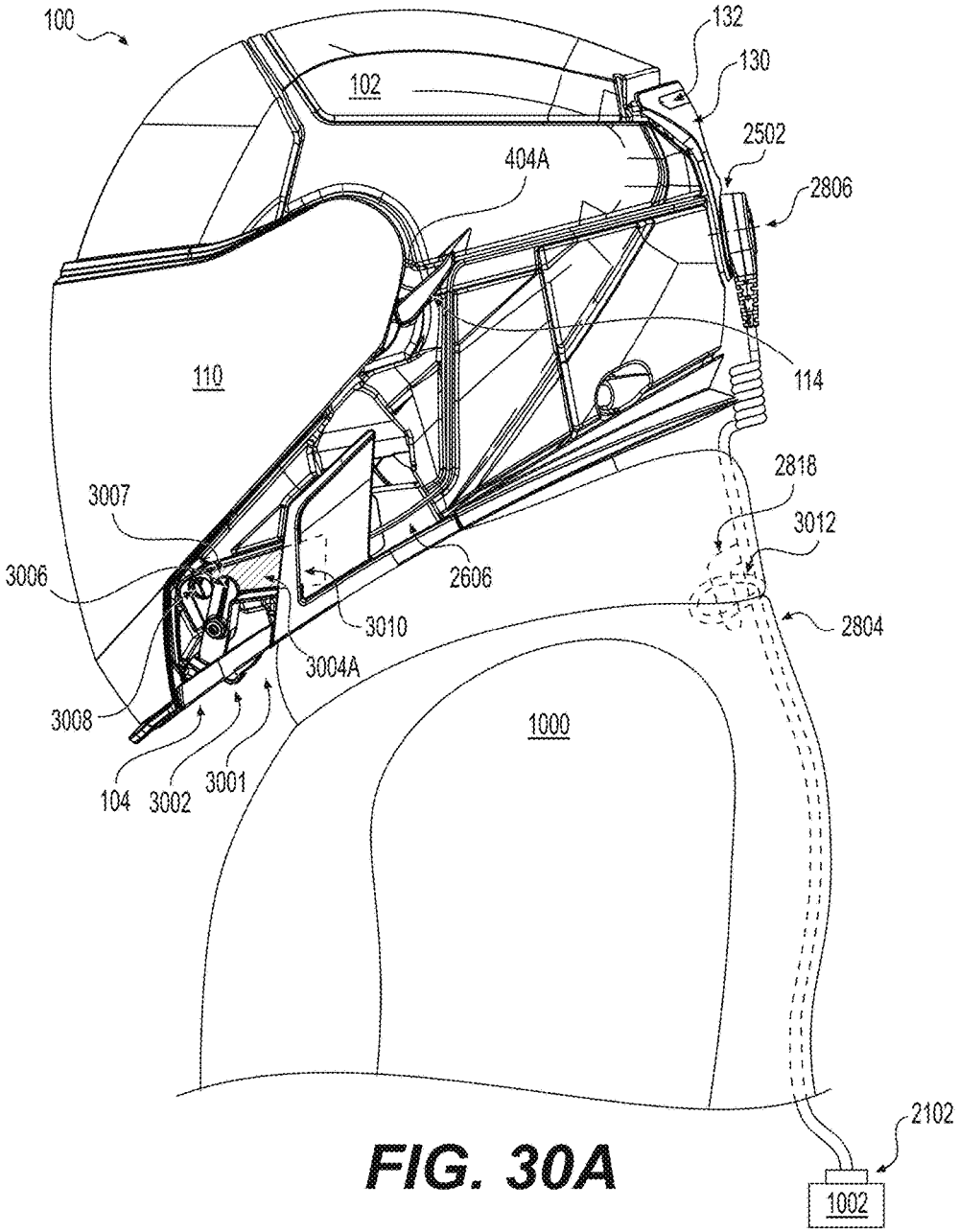
FIG. 30A is a left side elevation view of a person wearing a garment and the helmet of FIG. 24 connected to the electrical connector assembly of FIG. 27, wherein the outer helmet shell of the jaw shield, and surrounding portion thereof, is removed, and a vent lever of the jaw shield is in an opened position.
Figure 30B:
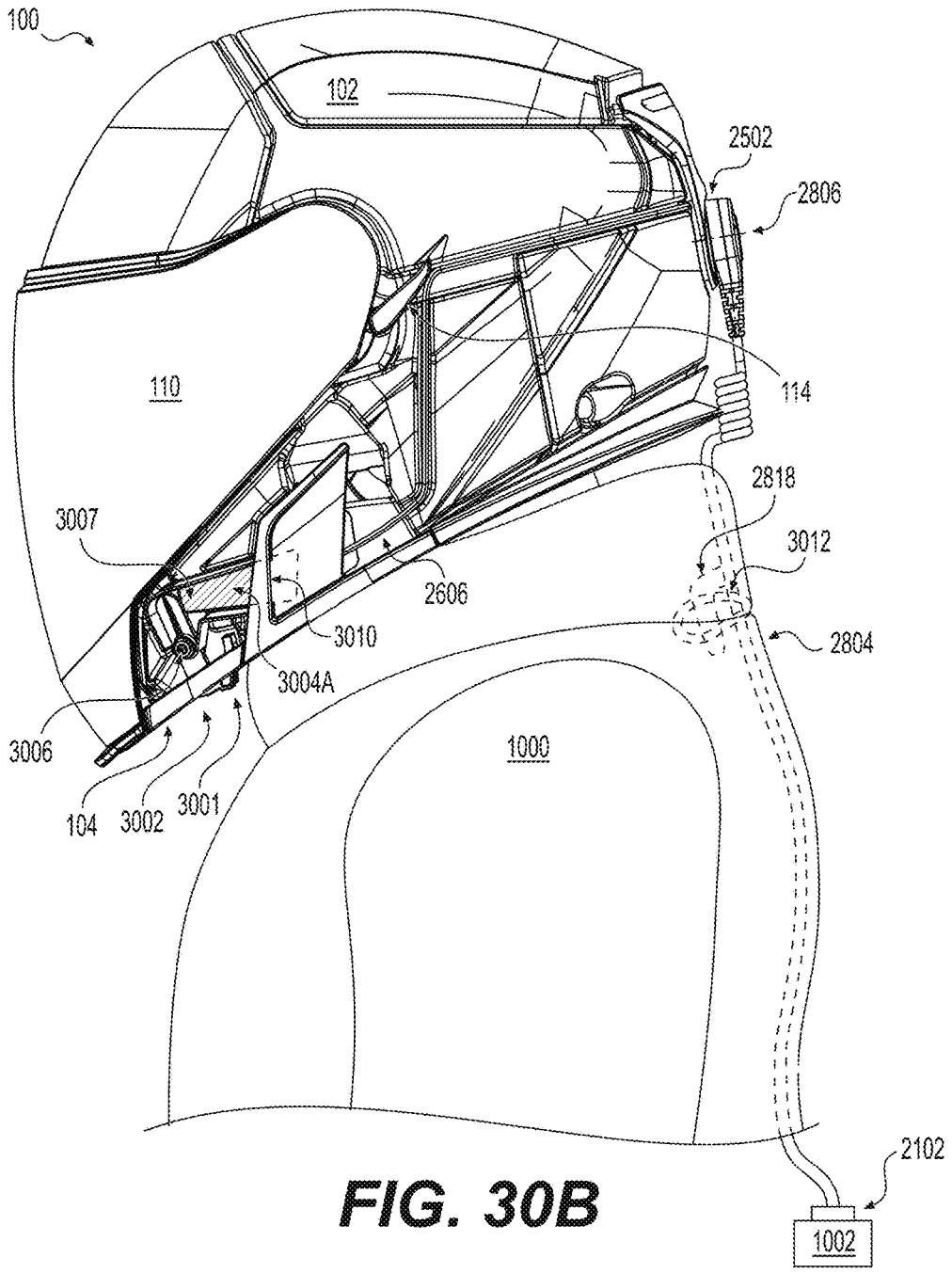
FIG. 30B is a left side elevation view of the helmet of FIG. 30A, with the vent lever of the jaw shield in a closed position.
Figure 31:
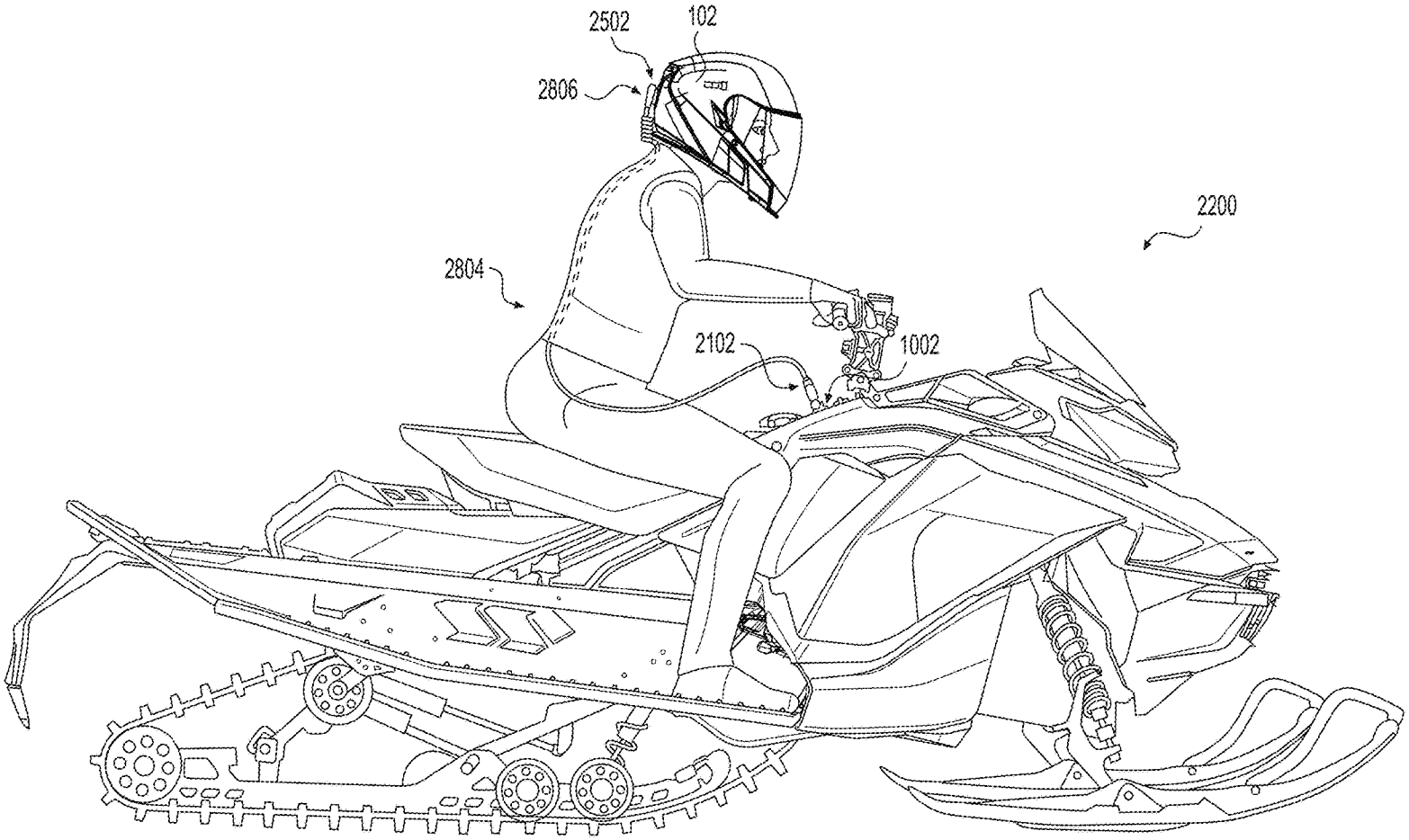
FIG. 31 is a right elevation view of the person of FIG. 30A mounted on a snowmobile.

Reference is now made to FIGS. 27 and 28, illustrating the electrical connector assembly 2802 used to connect to the receiver 2502. The electrical connector assembly 2802 includes a flexible member in the form of a flexible cord 2804, and a connector 2806 connected to one end of the flexible cord 2804. As depicted in FIGS. 30A to 31, the flexible cord 2804 is connected to a power connector 2102 at the opposing end, which is adapted to be connected to the external battery 1002.

The connector 2806 includes a connection surface 2808. The surface 2808 includes two right electrically conductive pins 2810 and two left electrically conductive pins 2812. Although depicted as having two right electrically conductive pins 2810 and two left electrically conductive pin 2812 organized in a square pattern about the surface 2808, it is not limited as such, and it is contemplated that any number of right and left electrically conductive pins 2810, 2812 may be used. The right electrically conductive pins 2810 are electrically connected to an electrical wire 2912 embedded within the flexible cord 2804, and the left electrically conductive pins 2812 are electrically connected to an electrical wire 2914 embedded within the flexible cord 2804.

The surface 2808 also includes a central projection 2814 about the middle of the surface 2808 and a lower projection 2816 about the bottom of the surface 2808. Both the central and lower projections 2814, 2816 extend outwardly in relation to the surface 2808. The surface 2808 further includes an arcuate recess 2820, extending axially inwardly in relation to the surface 2808 from both sides of the lower projection 2816.

Under the surface 2808, the connector 2806 includes four cylindrical magnets 2902. Although the magnets 2902 are depicted as cylindrical magnets, it is not limitative. As such, more or less than four cylindrical magnets may be utilized. Although the magnets 2902 are arranged in a square pattern rotated 45 degrees from the square pattern formed by the right and left electrically conductive pins 2810, 2812, other patterns are contemplated for the magnets 2902. The right and left conductive pins 2810, 2812 pass through a plate 2904 that is placed behind the magnets 2902 to be attached to respective right and left biasing plates 2906*a*, 2906*b*. Although the right biasing plate 2906*a* has the form of a plate with two arms connected at a base, it is not limitative and other shapes are contemplated. The left biasing plate 2906*b* is a mirror image of the right biasing plate 2906*a*. Each arm of the right biasing plate 2906*a* is attached to one of the two right conductive pins 2810 and to the electrical wire 2912 at the base. Each arm of the left biasing plate 2906*b* is attached to one of the two left conductive pins 2812 and to the electrical wire 2914 at the base. The right and left biasing plates 2906*a*, 2906*b* are superimposed on the plate 2904 and partially attached to the plate 2904 at their respective bases. Two pins 2908 are attached to the right and left biasing plate 2906*a*, 2906*b* on one surface, respectively, and are configured to receive and attach a cover 2910.

The flexible cord 2804 is attached to a garment holder 2818. The garment holder 2818 is configured to be attached to the garment 1000 via a fabric loop 3012 near the neck area (as seen in FIGS. 30A and 30B).

Figure 29:
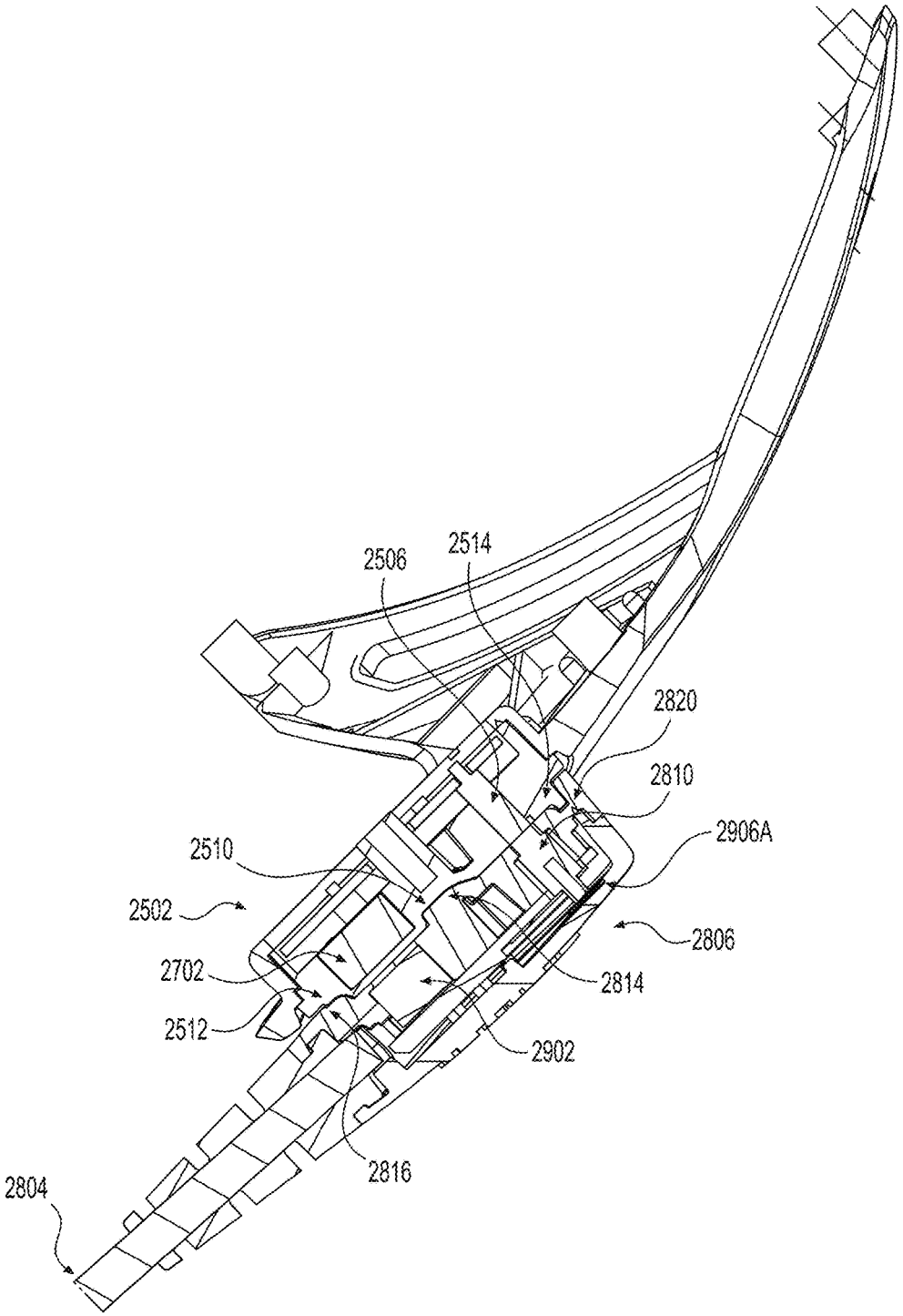
FIG. 29 is a cross-sectional view of the electrical connector assembly of FIG. 27 attached to the receiver of FIGS. 24 to 26 taken through 29-29 of FIG. 25.

Referring now to FIG. 29, the connection of the connector 2806 to the receiver 2502 will be described. The connection of the connector 2806 to the receiver 2502 includes a magnetic connection between the magnets 2702 of the receiver 2502 and the magnets 2902 of the connector 2806.

In order for the connector 2806 to be attached to the receiver 2502, (i) the central projection 2814 and the lower projection 2816 are aligned with the central recess 2510 and the lower recess 2512, respectively, and (ii) the arcuate rib 2514 is also aligned with the arcuate recess 2820. To connect the connector 2806 to the receiver 2502, the user places the receiver 2502 close to the connector 2806 such that magnets 2702 and 2904 attract each other. If the central and lower projections 2814, 2816 are not aligned with the central and lower recesses 2510, 2512 respectively, the user rotates the connector 2806 until they are aligned and at which point the connector 2806 and receiver 2502 will fully mate with each other and the electrical connection will be made. When the central and lower projections 2814, 2816 mate with the central and lower recesses 2510, 2512 respectively, the connector 2806 magnetically connects to the receiver 2502 and the user will feel and hear a distinctive clicking sound. The lower projection 2816 and the lower recess 2512 prevent the connector 2806 from being connected to the receiver 2502 in any other orientation, thereby preventing a short circuit. The arcuate rib 2514 and the arcuate recess 2820 prevent any precipitation to fall and/or accumulate between the surfaces 2504, 2808.

When the connector 2806 and the receiver 2502 are connected as shown, the right biasing plate 2906*a* bends about its base and biases the right conductive pins 2810 against the right conductive elements 2506, as the biasing plate 2906*a* is partially attached to the plate 2904 at its base, thereby establishing an electrical connection. Similarly, the left biasing plate 2906*b* bends about its base and biases the left conductive pins 2812 against the left conductive elements 2508, as the biasing plate 2906*b* is partially attached to the plate 2904, thereby establishing another electrical connection.

In some implementations of the present technology, the receiver 2502 is electrically connected to the signal transmitter 2604 via a wire 2602 as shown in FIG. 25. The signal transmitter 2604 may be attached to the inner helmet shell 122 (as shown in FIG. 2C), and is configured to transmit a signal, such as a light signal, to the wearer of the helmet 100 indicating the electrical connection between the receiver 2502 and the external battery 1002 is established. It is further contemplated that the signal transmitter 2604 could be electrically connected to the heating element 310 and configured to transmit a further signal, such as another light signal, to the wearer of the helmet 100 indicating that the heating element 310 is powered.

Although the receiver 2502 has been depicted as being implemented on the helmet 100, it is contemplated that the receiver 2502 could also be implemented on the helmet 1500.

Reference is now made to FIGS. 30A to 31 illustrating the connector 2806 attached to the helmet 100 via the receiver 2502. As stated previously the garment holder 2818 is configured to be attached to the garment 1000 via the fabric loop 3012, thereby preventing the flexible cord 2804 to be freely displaceable. Although the flexible cord 2804 is depicted running between the garment 1000 and the body of the wearer to connect to the external battery 1002 of a snowmobile 2200, it is not limitative. It is contemplated that the flexible cord 2804 could run outside the garment 1000, or inside the garment 1000, to connect to the external battery 1002.

Reference is now made to FIGS. 30A and 30B. In some implementations of the present technology, the helmet 100 is adapted to exhaust the air exhaled within the inner space 106 (depicted in FIG. 1) by the wearer of the helmet 100 outside the helmet 100. As such, in some implementations, there is provided a vent 3001 to allow air to flow from the inner space 106 to the atmosphere and vice versa. The vent 3001 comprises an aperture 3008 within the jaw shield 104, which is adapted to let the air from the inner space 106 to travel into a passage 3007 formed within the jaw shield 104. The passage 3007 is fluidly connected to an opening 3010 that is formed in a portion of the outer helmet shell 121. The jaw shield 104 further includes a vent lever 3006 pivotally connected about the bottom of the jaw shield 104. In order to pivotally move the vent lever 3006 from an opened to a closed position, a lower portion 3002 of the vent lever 3006 extends below the jaw shield 104 and can be actuated by the user. By pulling or pushing the lower portion 3002, the vent lever 3006 can pivotally move between a closed position as shown in FIG. 30B and an opened position as shown in FIG. 30A. In the closed position (FIG. 30B), the vent lever 3006 blocks the aperture 3008 thereby preventing the air in the inner space 106 from venting between the inner space 106 and the opening 3010 via the aperture 3008 and the passage 3007. In the opened position (FIG. 30A), the vent lever 3006 is pivotally displaced from the aperture 3008, thereby allowing air in the inner space 106 to vent between the aperture 3008 and the opening 3010 via the passage 3007. Although only shown on the left side of the helmet 100 in FIGS. 30A and 30B, an aperture 3008, a passage 3007, an opening 3010, a vent lever 3006 and a lower portion 3002 are also provided on the right side of the helmet 100. It is contemplated that only one side of the helmet 100 could be provided with an aperture 3008, a passage 3007, an opening 3010, a vent lever 3006 and a lower portion 3002.

In some implementations of the present technology, the receiver 2502 is electrically connected to a left vent heating element 3004A and a right vent heating element 3004B via wires 2608 and 2606, respectively (see, FIG. 26). As illustrated in FIGS. 30A and 30B, the left vent heating element 3004A is disposed within the passage 3007 and extends from the aperture 3008 to the opening 3010 and extends further behind the portion of the helmet shell 121 defining the opening 3010. The right vent heating element 3004B is similarly disposed within the passage 3007 and extends from the aperture 3008 to the opening 3010, and extends further behind the portion of the helmet shell 121 defining the opening 3010 on the right side of the helmet 100. The right and left vent heating elements 3004A, 3004B are adapted to prevent the formation of ice within the passage 3007, the aperture 3008 and/or near the openings 3010, resulting from the humid air exhaled by the wearer exiting the inner space 106.

Although the vent 3001 has been depicted as being implemented on the helmet 100, it is contemplated that the vent 3001 could also be implemented on the helmet 1500 as well.

Figure 32:
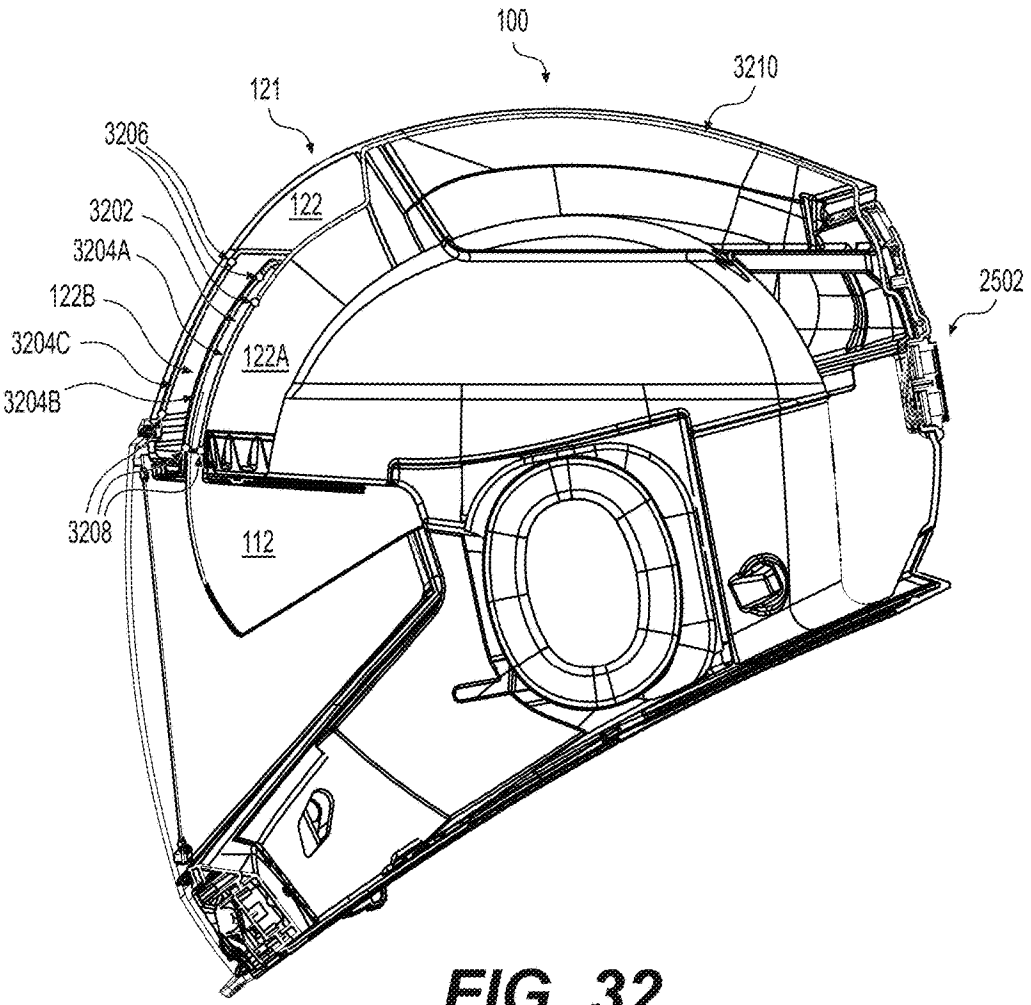
FIG. 32 is a cross-sectional view taken through line 32-32 of the helmet of FIG. 24 with eye shield heating elements.
Figure 33:
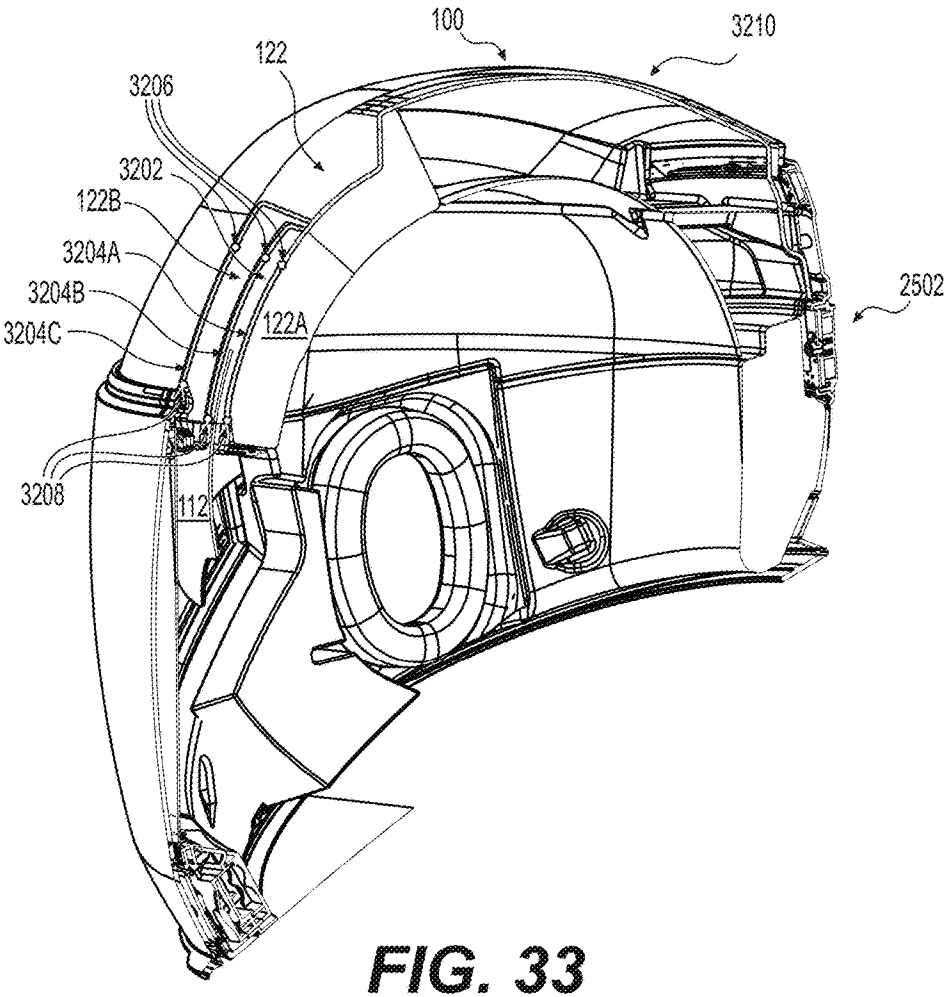
FIG. 33 is a front, left side perspective view of the cross-section of FIG. 32.

Reference is now made to FIGS. 32 and 33. As stated previously, the helmet 100 includes the eye shield 112 that can pivotally move between (a) the raised position (as shown in FIG. 5A), and (b) the lowered position (as shown in FIG. 32) by using the lever 114 (see FIG. 1). When in the lowered position, the eye shield 112 is disposed at least partially within a cavity 3202 (as shown in FIGS. 32 and 33), which is an opening formed within the material forming the inner helmet shell 122. Although the cavity 3202 is depicted as being formed between an inner portion 122A and an outer portion 122B of the inner helmet shell 122, it is contemplated that the cavity 3202 may be formed between the inner side of the outer helmet shell 121 and the inner portion 122A, by removing the material of the outer portion 122B.

The helmet 100 further includes a first eye shield heating element 3204A, a second eye shield heating element 3204B, and a third eye shield heating element 3204C. The first eye shield heating element 3204A is placed on the rear side of the cavity 3202 with the use of an adhesive. The second eye shield heating element 3204B is placed on the front side of the cavity 3202 with the use of an adhesive. The third eye shield heating element 3204C is placed between the outer helmet shell 121 and the outer portion 122B with the use of an adhesive. It is contemplated that the third eye shield heating element 3204C could be placed on the inner side of the outer helmet shell 121 when the outer portion 122B is removed (as described above). It is contemplated that the first, second and third eye shield heating elements 3204A, 3204B, 3204C could be placed in different manners, by one or more mechanical fasteners, and the like. Although the helmet 100 is depicted as having three eye shield heating elements 3204A, 3204B and 3204C, it is contemplated that the helmet 100 could have only one or two of the eye shield heating elements 3204A, 3204B and 3204C, or more than three eye shield heating elements.

Although the first and second eye shield heating elements 3204A, 3204B are depicted as covering only a portion of the surface of the cavity 3202 it is placed on, it is contemplated that the first and second eye shield heating elements 3204A, 3204B could cover more or less of the surface of the cavity 3202 it is placed on.

The manner in which the first eye shield heating element 3204A is implemented is now described. The cavity 3202 includes an upper connector 3206 attached about the upper edge of the first eye shield heating element 3204A, and a lower connector 3208 attached about the lower edge of the first eye shield heating element 3204A. The upper connector 3206 is electrically connected to the receiver 118 via a wire 3210. The lower connector 3208 is electrically connected to the receiver 118 via a wire 3212 (see FIG. 25). The first eye shield heating element 3204A establishes an electrical connection between the upper connector 3206 and the lower connector 3208, thereby heating the cavity 3202. Although the connectors 3206 and 3208 are depicted as being attached, respectively on the upper edge and lower edge of the first eye shield heating element 3204A, it is contemplated that the connectors 3206 and 3208 could be connected to the right edge and left ledge of the first eye shield heating element 3204A, or on the same edge of the first eye shield heating element 3204A. The manner in which the second and third eye shield heating element 3204B, 3204C are implemented is similar to the manner in which the first eye shield heating element 3204A is implemented, and as such, will not be described in detail herein.

Conventionally, when the eye shield 112 was placed in the raised position, low temperature surrounding the helmet 100 would chill the eye shield 112, thereby causing condensation on the eye shield 112 when lowered, as a result of the humid air exhaled by the wearer contacting the chilled eye shield 112. In the current implementation, since the eye shield 112 is heated by the eye shield heating elements 3204A, 3204B, 3204C when in the raised position, condensation on the eye shield 112 is discouraged when lowered. Alternatively, when condensation on the eye shield occurs while in the lowered position, the wearer may raise the eye shield 112, thereby eliminating the condensation by heating the eye shield 112 with the eye shield heating element 3204A, 3204B, 3204C.

Although the eye shield heating element 3204A, 3204B, 3204C have been depicted as being implemented on the helmet 100, it is not limitative, and it is contemplated that the eye shield heating element 3204A, 3204B, 3204C could be implemented on the helmet 1500 as well.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A helmet comprising:

a helmet shell;

a visor pivotally connected to the helmet shell, the visor pivoting between a first position and a second position;

an electrical device attached to the visor;

a first helmet electrical contact attached to the helmet, the first helmet electrical contact being adapted for electrically connecting to an electrical power source;

a first visor electrical contact attached to the visor, the first visor electrical contact being electrically connected to the electrical device, the first visor electrical contact being pivotally connected to the helmet shell about a first pivot axis passing through the first helmet electrical contact, one of the first helmet electrical contact and the first visor electrical contact being biased against an other one of the first helmet electrical contact and the first visor electrical contact, the first visor electrical contact contacting the first helmet electrical contact at all positions between the first position and the second position of the visor;

a second helmet electrical contact attached to the helmet, the second helmet electrical contact being adapted for electrically connecting to the electrical power source; and a second visor electrical contact attached to the helmet, the second visor electrical contact being electrically connected to the electrical device, the second visor electrical contact being pivotally connected to the helmet shell about a second pivot axis passing through the second helmet electrical contact, one of the second helmet electrical contact and the second visor electrical contact being biased against an other one of the second helmet electrical contact and the second visor electrical contact, the second visor electrical contact contacting the second helmet electrical contact at all positions between the first position and the second position of the visor.

2. The helmet of claim 1, wherein the visor is removable.

3. The helmet of claim 1, wherein the electrical device is a visor heating element.

4. The helmet of claim 3, wherein the visor comprises an outer visor and an inner visor, the visor heating element being attached to the inner visor.

5. The helmet of claim 3, wherein the visor comprises an outer visor and an inner visor, the visor heating element being integrated within the inner visor.

6. The helmet of claim 1, wherein:

a left side of the visor is pivotally connected to the helmet shell about the first pivot axis on a left side of the helmet shell; and a right side of the visor is pivotally connected to the helmet shell about the second pivot axis on a right side of the helmet shell.

7. The helmet of claim 6, wherein the first pivot axis and the second pivot axis are skewed relative to one another.

8. The helmet of claim 1, wherein the first and second helmet electrical contacts each comprise a spring loaded pin assembly.

9. The helmet of claim 8, wherein:

a left side of the visor is pivotally connected to the helmet shell about the first pivot axis on a left side of the helmet shell;

a right side of the visor is pivotally connected to the helmet shell about the second pivot axis on a right side of the helmet shell;

a first pin axis of the spring loaded pin assembly of the first helmet electrical contact is coaxial with the first pivot axis; and, a second pin axis of the spring loaded pin assembly of the second helmet electrical contact is coaxial with the second pivot axis.

10. The helmet of claim 1, wherein;

the first helmet electrical contact is biased against the first visor electrical contact; and, the second helmet electrical contact is biased against the second visor electrical contact.

11. The helmet of claim 1, wherein the first and second visor electrical contacts each comprise a printed circuit board.

12. The helmet of claim 1, wherein the first and second helmet electrical contacts each comprise a metal plate.

13. The helmet of claim 12, wherein:

the first visor electrical contact is biased against the first helmet electrical contact; and the second visor electrical contact is biased against the second helmet electrical contact.

14. The helmet of claim 13, wherein the first visor electrical contact is part of a first biasing conductor assembly and the second visor electrical contact is part of a second biasing conductor assembly.

15. The helmet of claim 14, wherein the first visor electrical contact comprises at least one first conductive leg biased against the first helmet electrical contact, and the second visor electrical contact comprises at least one second conductive leg biased against the second helmet electrical contact.

16. The helmet of claim 15, wherein the at least one first conductive leg is three first conductive legs arranged in a triangular formation, and the at least one second conductive leg is three second conductive legs arranged in a triangular formation.

17. The helmet of claim 1, further comprising:

a first wire having a first end and a second end, the first end being electrically connected to the first helmet electrical contact, and the second end being adapted for electrically connecting to the power source; and a second wire having a first end and a second end, the first end being electrically connected to the second helmet electrical contact, and the second end being adapted for electrically connecting to the power source.

18. The helmet of claim 17, further comprising a receiver attached to a back of the helmet shell, the receiver being adapted for connecting to the power source, wherein the second ends of the first wire and second wire are electrically connected to the receiver.

19. The helmet of claim 1, wherein the helmet shell comprises of an inner shell and an outer shell.

* * * * *